US005824912A

United States Patent [19]

Stankus et al.

[11] Patent Number: 5,824,912

[45] Date of Patent: Oct. 20, 1998

[54] METHOD OF ROOF CONTROL IN AN UNDERGROUND MINE

[75] Inventors: John C. Stankus, Canonsburg, Pa.; Song Guo, Morgantown, W. Va.

[73] Assignee: Jennmar Corporation, Pittsburgh, Pa.

[21] Appl. No.: 967,220

[22] Filed: Oct. 29, 1997

Related U.S. Application Data

[63] Continuation of Ser. No. 659,037, Jun. 3, 1996, abandoned.

[51] Int. Cl.[6] ..... G01B 5/30; G01M 5/00

[52] U.S. Cl. ..... 73/786; 73/760; 405/133

[58] Field of Search ..... 405/230, 251, 405/133, 134; 73/760, 774, 786, 787, 783

[56] References Cited

U.S. PATENT DOCUMENTS

| | | | |
|---|---|---|---|
| 3,778,108 | 12/1973 | Pennington et al. | 299/11 |
| 4,134,270 | 1/1979 | Small et al. | 405/302 |
| 4,281,547 | 8/1981 | Hinshaw et al. | 73/579 |
| 4,300,397 | 11/1981 | Brest van Kempen | 73/818 |
| 4,318,302 | 3/1982 | Choi | 73/761 |
| 4,415,294 | 11/1983 | Ringe | 405/259 |
| 4,523,881 | 6/1985 | Ringe | 405/259 |
| 4,531,403 | 7/1985 | de Korompay et al. | 73/38 |
| 4,581,712 | 4/1986 | Perry et al. | 73/784 |
| 4,699,547 | 10/1987 | Seegmiller | 405/288 |
| 4,846,607 | 7/1989 | Spross et al. | 405/303 |
| 4,962,668 | 10/1990 | Preston et al. | 73/784 |
| 5,215,411 | 6/1993 | Seegmiller | 405/374 |
| 5,381,690 | 1/1995 | Kanduth et al. | 73/784 |
| 5,425,601 | 6/1995 | Calandra, Jr. et al. | 405/288 |
| 5,542,788 | 8/1996 | Stankus et al. | 405/288 |

OTHER PUBLICATIONS

Duk–Won Park, "Numerical Modeling As a Tool For Mine Design", 1992, *Proceedings of the Workshop on Coal Pillar Mechanics and Design,* 1992, cover page plus pp. 250–268.

J. Riefenberg et al., "A Test of Predictive Numerical Models to Simulate Entry Design Changes Using Field Measurements from a Longwall Mining Gateroad", 1993, *Ground Control in Mining–12th International Conference,* cover page plus pp. 84–91.

X. Wu et al., "Mathematical Modeling of Strong Roof Beds in Longwall Mining", 1993, *Ground Control in Mining–12th International Conference,* pp. 175–183.

J. Hematian, "Design of Roadway Support Using a Strain Softening Model", 1994, *Ground Control in Mining–13th International Conference,* cover page plus pp. 50–57.

G. Karabin et al., "Experience With the Boundary Element Method of Numerical Modeling as a Tool to Resolve Complex Ground Control Problems", 1994, *Ground Control in Mining–13th International Conference,* pp. 201–213.

E. Hosca et al., "Influence of Support Capacity and Geometry on Tailgate Support", 1994, *Ground Control in Mining–13th International Conference,* pp. 161–165.

V. Scovazzo, "Comparison of Empirical, Analytical, and Numerical Methods of Pillar Design and the Development of a Site Specific Pillar Formula", 1995, *Ground Control in Mining–14th International Conference,* cover page plus pp. 116–123.

K. Biswas et al., "Influence of Partings in a Coal Seam on Long Term Pillar Stability", 1995, *Ground Control in Mining–14th International Conference,* pp. 80–93.

McGraw–Hill Dictionary of Scientific and Technical Terms, Third Edition, Copyright 1984, pp. 1136–1137.

*Primary Examiner*—Max H. Noori

*Attorney, Agent, or Firm*—Webb Ziesenheim Bruening Logsdon Orkin & Hanson, P.C.

[57] ABSTRACT

Stresses in an underground mine are determined by analyzing mechanical properties of mine site stratum including Young's modulus. The mechanical properties are combined with the physical layout of the mine. From the application of the mechanical properties, stresses in the mine are determined.

29 Claims, 9 Drawing Sheets

METHOD OF ROOF CONTROL IN AN UNDERGROUND MINE

This application is a continuation of application Ser. No. 08/659,037 filed on Jun. 3, 1996 now abandoned.

BACKGROUND OF THE INVENTION

1. Field of the Invention

The present invention relates to underground mining and, more specifically, to the design of roof control for underground coal mines.

2. Description of the Prior Art

It has only been within the past few years that computer-aided analytic techniques have expanded into the mining industry and specifically into the coal mining industry as an aid for establishing roof control plans. Before this, the establishment of an effective roof control plan depended in large part on the experience of individual mining engineers utilizing rules of thumb or simple analytic techniques. Unfortunately, such experienced based techniques yielded inconsistent results with the outcome being either over design of the roof control plan with corresponding increased expense and/or waste of potentially useable material, or under design of the roof control plan with under supported roofs and corresponding undesired roof failures.

With the advent of computer-aided analytic techniques, the mining engineers are better able to design an appropriate roof control plan that avoids exclusive reliance on the above-mentioned experience based or simple analytic techniques. One such computer analytic technique includes Finite Element Analysis (FEA) of the various strata comprising a mine and, more specifically, the strata of material to be mined out and the material adjacent the opening formed by the mined out material. The use of FEA aids the mining engineer in determining stresses, not only of the mining components, but also of the surrounding mine rock during mining. Taking into account these stresses, the mining engineer is better able to design a roof support plan that includes, without limitation, appropriate location and size of pillars to be formed in the material to be mined out.

Some commercially available finite element programs, such as ANSYS, ABAQUS, NASTRAN, ADINA and the like, are useful tools in performing FEA. Such commercially available programs, however, are not specially developed for FEA of mine conditions. Accordingly, the success of utilizing these programs relies, in large part, on the input of variables into the program, such as, without limitation, a mesh size selected to achieve the desired precision in a domain of interest, properties of the various materials being analyzed, boundary conditions between elements in the mesh and the like. Moreover, with the proliferation of roof bolts in the mining industry, successful FEA analysis of mines necessarily requires taking into account the effect such roof bolts have on the stability of the mine roof and, more specifically, the interaction such roof bolts have with surrounding strata in providing acceptable roof support.

The analysis of stresses in a mine utilizing one of the commercially available FEA programs has provided the mining engineer with useful data that enables the formulation of a roof support plan with improved results over the experienced based roof control plan. In spite of the improved results, however, it is believed that the full capability of such FEA programs, as applied to determining stresses in mines, has not been realized due to overly simplistic modeling of the various materials being analyzed and the lack of precise models for boundary conditions between adjacent materials in a mine.

It is our object of the present invention to provide a more accurate method for determining stresses in an underground mine over the prior art.

It is yet a further object of the present invention to provide a method for designing a mine layout.

SUMMARY OF THE INVENTION

The present invention is a method of determining stresses in a mine site comprising the steps of: obtaining mechanical properties of said mine site including orthogonal properties of at least one of Young's modulus and Poisson's ratio; applying said mechanical properties to a layout of a mine in said mine site; and determining from said applying of said mechanical properties, stresses in said mine site.

The method also includes determining a position for an array of bolts in a roof of the mine; and determining for the combination mine layout and roof bolt array and from said analysis of said mechanical properties, stresses in said mine site. If insufficient roof support exists to support said roof to a desired extent, one or both of said mine layout and said roof bolt array are adjusted.

Another aspect of the present invention includes a method for determining stress in a given area of an underground mine comprising the steps of: accumulating mine specific data including orthogonal properties of at least one of Young's modulus and Poisson's ratio for one or more stratum in the mine; and converting said specific data to a stress analysis of said given area.

Yet another aspect of the present invention includes a method of determining bolt length and tension in a roof support system of an underground mine comprising the steps of: accumulating mine specific data including orthogonal properties of at least one of Young's modulus and Poisson's ratio for one or more stratum in said mine; applying roof bolt specific data to said mine, wherein material is removed from a stratum thereof; combining said mine specific data, said roof bolt specific data and said mine layout to a mesh to be utilized for stress analysis of said given area; performing a stress analysis for said combined data; and analyzing said stress analysis to determine a roof bolt length for said bolt specific data.

Still another aspect of the present invention includes a method for determining stress in a given area of an underground mine comprising the steps of: accumulating mine site specific data including in-situ stresses of one or more stratum in said mine and orthogonal properties of at least one more stratum, wherein said orthogonal properties include at least one of Young's modulus and Poisson's ratio; determining a layout in or of said stratum; converting said specific data to a stress analysis of said given area; and determining from said stress analysis stresses in the given area.

Still yet another aspect of the present invention includes a method of predicting surface subsidence over an underground mine comprising the steps of: accumulating mechanical data specific to strata between the mine and a surface thereabove, said data including orthogonal properties of at least one of Young's modulus and Poisson's ratio; applying said specific data to a layout for said mine to obtain a stress analysis of said given area; and determining from said stress analysis an amount of surface subsidence.

Another aspect of the present invention includes a method for determining roof support in a layered underground mine including a plurality of strata wherein one of said strata is to be mined, said method comprising the steps of: determining for at least one of said plurality of strata, orthogonal properties thereof including at least one of Young's modulus and Poisson's ratio; implementing a layout for at least one of pillars and an entry in said strata of material to be mined; and determining stresses in the at least one of said plurality of strata utilizing said orthogonal properties and said layout.

The method also includes arraying a plurality of roof bolts transverse to a stratum of material immediately above said stratum to be mined; determining a length and installed load for said roof bolts; and determining for the combination pillar layout and roof bolt array a distribution of stresses in the at least one of said plurality of strata utilizing said orthogonal properties. In an alternate embodiment of the method, an isotropic property of the roof bolts are determined and utilized to determine the distribution of stresses. In yet another alternate embodiment of the method, a boundary condition between the roof bolts and one or more of the plurality of strata are determined and utilized to determine the distribution of stresses. In another alternate embodiment of the method, a boundary element between two or more adjacent stratum are determined and utilized to determine the distribution of stresses. In yet another embodiment of the method, the stresses are determined through finite element analysis and a gap element between two or more adjacent stratum is utilized therewith.

The method further includes determining mechanical properties of a gob disposed relative to a face of material to be mined including one of Young's modulus and Poisson's ratio; and determining at least one of peak frontal abutment pressure produced adjacent a face of material being mined and a peak side abutment pressure produced on pillars adjacent said face of material being mined.

The present invention is also a method of stress analysis in an underground mine having a plurality of strata, said method comprising the steps of: determining in at least one of said plurality of strata one orthogonal material property thereof; establishing a pattern of pillars in one of said plurality of strata; and determining stresses in said plurality of strata utilizing said one orthogonal property.

The method includes determining a length, tension and arrangement of a plurality of bolts to be applied to a roof in said mine so that overlapping influence zones are created between adjacent strata to achieve an optimum beaming effect.

The present invention is still yet a method of determining roof support in an underground mine having a mineral seam and a strata of rock thereabove by ascertaining the distribution of stresses by applying finite stress analysis to the mineral seam and the strata of rock, wherein said finite stress analysis includes utilizing the stress/strain relationship of at least one of the mineral seam and the strata of rock, wherein the improvement comprises implementing the finite element analysis by taking into account an orthogonal properties of at least one of the mineral seam and the strata of rock.

DETAILED DESCRIPTION OF THE PREFERRED EMBODIMENTS

Figure 1:
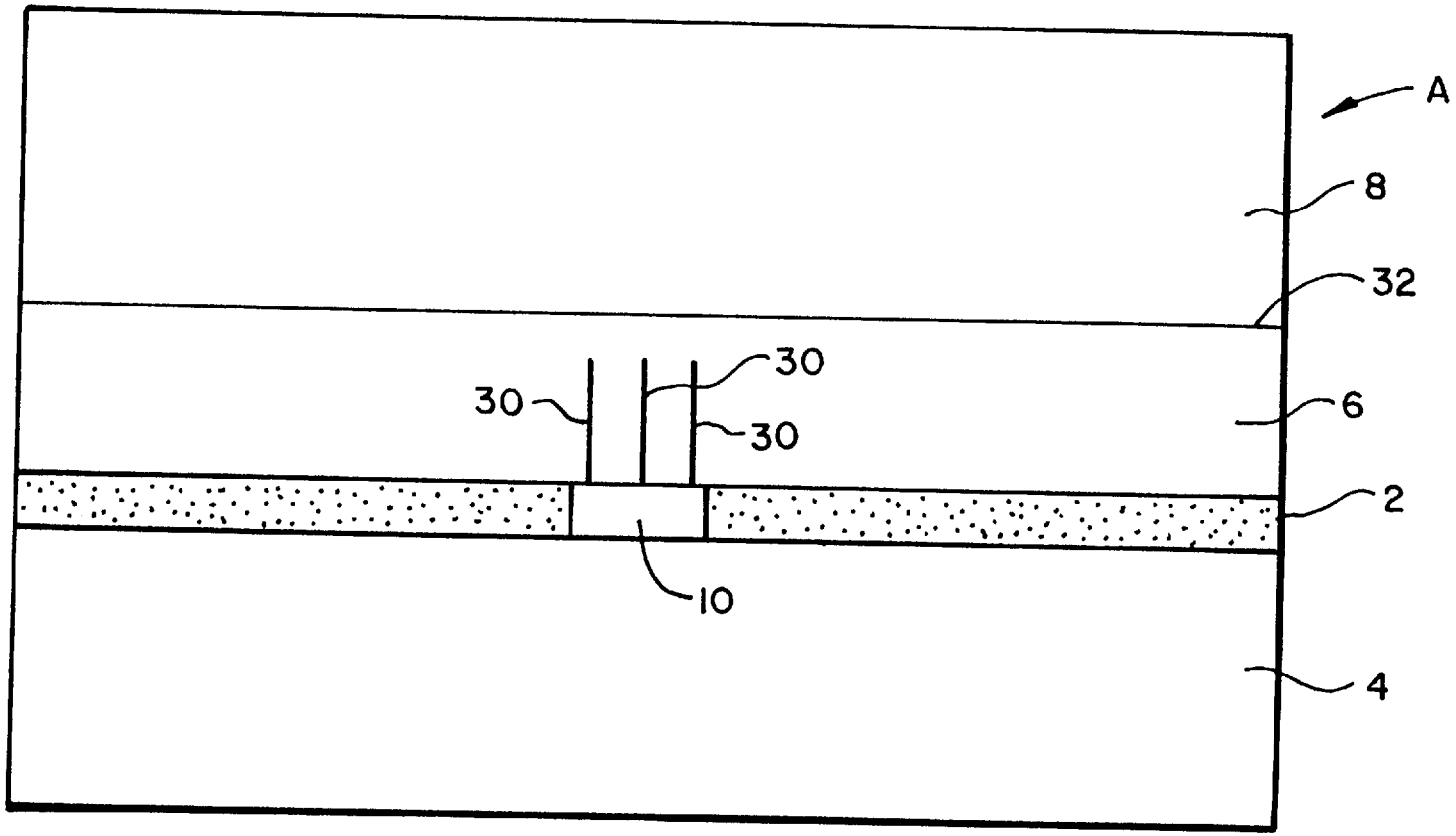
FIG. 1 illustrates a cross-sectional elevational view of a mine site having various strata including a mineral stratum with a single entry formed therein.

With reference to FIG. 1, mine site A has a single entry mine system including a stratum of mineral to be mined 2, a floor stratum 4, an immediate roof stratum 6 and a main roof stratum 8. The material stratum 2, the floor 4, the immediate roof 6 and the main roof 8 are typically comprised of different materials, such as coal, sandstone and shale. One or more entries 10 are formed in the mineral stratum by removing selected portions of the mineral. In development of a mine, the mineral is selectively removed from the mineral layer so as to form a mine layout typically having an array of pillars (see e.g., Ref. Nos. 82 and 84 in FIG. 6) therein along an edge of a field of minerals to be mined. The pillars so arrayed are utilized to maintain spacing between the roof and the floor in selected areas of the mining field during mining operations for providing entries into the mining field. The size of each pillar, i.e., length and width, is determined by reference to, without limitation, the physical conditions of the mine site, the layout of the mine including pillar arrangement and the like. Pillars of substantially similar sizes are most often utilized; however, pillars of different sizes are occasionally utilized. An example of different size pillars may include large abutment pillars utilized as main supports on the edge of a mining field and smaller yield pillars disposed between the abutment pillars and the mining operation to allow for gradual yielding as mining operations progress thereby. It is to be appreciated that, while a single entry mine is shown in FIG. 1, the present invention is applicable to multiple entry mine systems.

Figure 2:
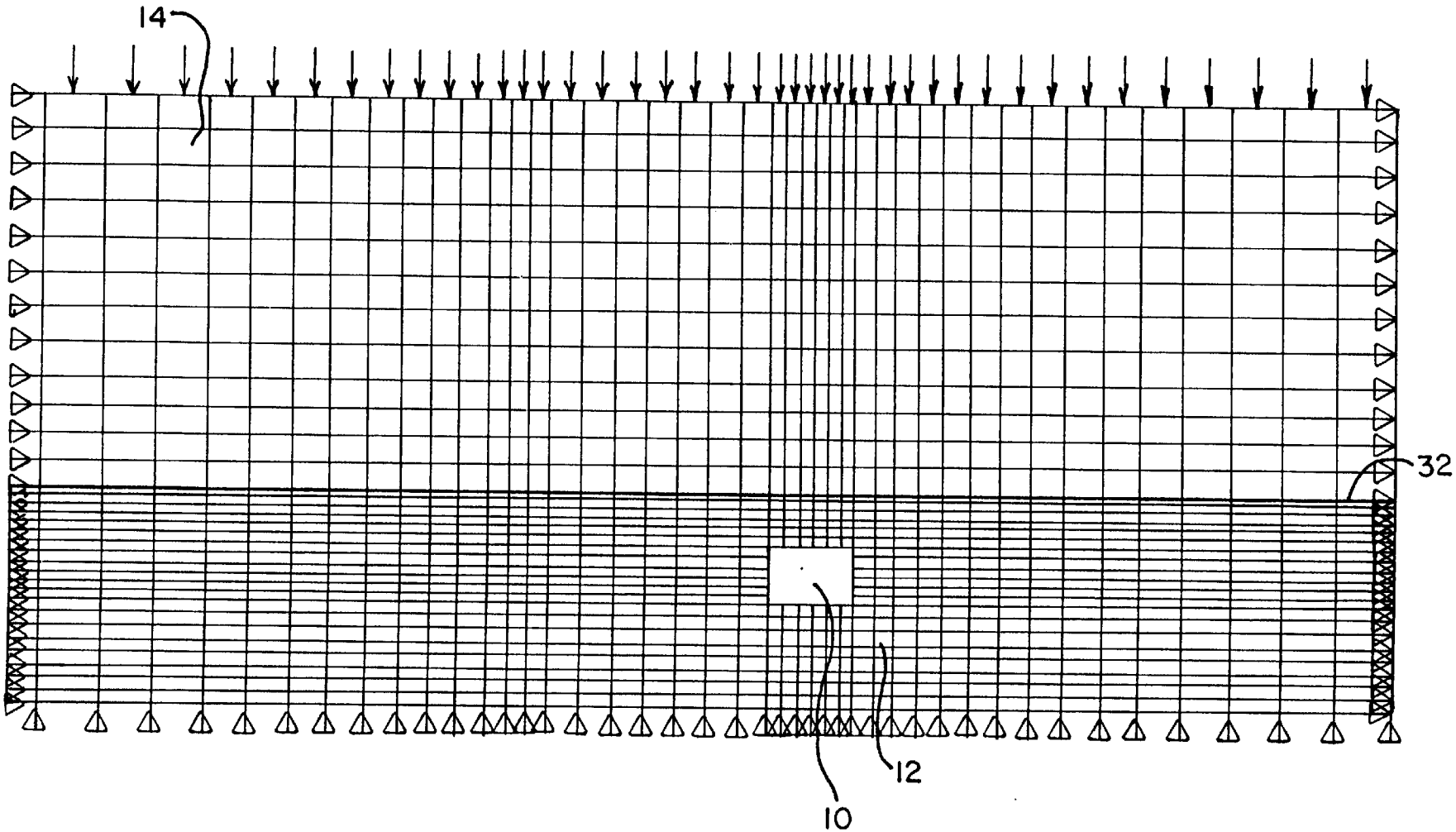
FIG. 2 is the mine site of FIG. 1 divided into discrete elements for the purpose of applying finite element analysis thereto.

FIG. 2 shows a graphical model of the single entry mine system shown in FIG. 1. The mine entry system is divided into discrete elements forming mesh elements for analysis by commercially available finite element analysis program. Such finite element analysis (FEA) programs have been found to be useful for analyzing stresses in mine sites. It is well known in FEA that the size of the elements corresponding to a particular area of the mine site being analyzed are selected so as to keep variations between adjacent mesh elements within acceptable limits. Thus, it is common to have a finer mesh size 12 for areas of the mine having greater stress concentrations, e.g., closer to entry 10, and coarser mesh size 14 for areas of the mine having more uniformly disposed stresses, e.g., more removed from entry 10. To properly analyze the mine site, mechanical properties of the mine material must be known as well as other information about the mine site, such as the mine dimensions or layout.

The mechanical properties of the mineral stratum 2, the floor stratum 4, the immediate roof stratum 6, the main roof stratum 8 and other stratum (not shown) are obtained either from tables or actually measured values taken from samples at the mine site. These mechanical properties include, without limitation, Young's modulus and Poisson's ratio and the density of the material for each stratum of the mine site to be analyzed. The other information necessary to the analysis may also include overburden depth, in-situ horizontal stress, entry width, pillar width and, where applicable, physical information and mechanical properties of the gob (including Young's modulus). The in-situ horizontal stress is measured at the mine site in an art-known manner. Heretofore, it has been assumed that the Young's modulus for the various stratum comprising a mine was uniform in all directions, that is $E_x=E_y=E_z$; where $E_2$ is Young's modulus obtained in a direction along a main force axis, typically vertically, and $_xE$ and $E_y$ are Young's modulus obtained in a direction substantially perpendicular to the main force axis, typically horizontally. In the mining industry, Young's modulus and Poisson's ratio are site specific. Therefore, actual core samples must be taken at the mine site and tests run on the core samples to determine the vertical Young's modulus and Poisson's ratio by applying compression to the sample and affixing strain gauges to the sample. The core sample to measure the vertical mechanical properties is typically taken along the vertical z direction. Preferably, a core sample is taken in the horizontal (either x or y) direction to determine the horizontal Young's modulus and Poisson's ratio. In cases where this is too difficult to obtain, the properties are measurable utilizing the vertical core sample.

It is believed that heretofore measurements of horizontal mechanical properties of mine sites were not taken due to their difficulty of obtaining and due to the assumption in the industry that the mechanical properties of the mined rock are uniform in all directions. The horizontal Young's modulus and horizontal Poisson's ratio should be obtained for one or more of the floor stratum 4, the immediate roof stratum 6, the main roof stratum 8 and the other stratum (not shown). The above mechanical properties and others are associated with the mesh elements corresponding to the respective stratum. Utilizing the foregoing mechanical properties and physical information about the mine, an FEA is performed for the mining site. It is to be appreciated that while considered in conjunction with a two dimensional FEA, the principals discussed herein are extendable to a three dimensional analysis of mine site.

Some of the foregoing data for each of the stratum being analyzed may be omitted from the FEA without substantially affecting the results thereof. For example, if stratum is sufficiently removed from an area of the mine being analyzed, the mechanical properties or physical information of such stratum or areas of such stratum may be excludable from the analysis without substantially affecting the same. Moreover, certain of the mechanical properties may be excludable from the analysis without substantially affecting the same. For example, it may be acceptable to utilize one value for Young's modulus in both the vertical and horizontal directions without substantially affecting the stress analysis. This is particularly true for stratum sufficiently removed from the area of the mine being analyzed. Importantly, however, as the analysis of the mine converges towards the area of the mine being analyzed, it has been found desirable to utilize orthogonal mechanical properties of the materials in the characterization thereof for the purpose of performing FEA.

The above stress analysis provides stress information for the modeled mine layout. Utilizing the provided information, it can be considered whether the selected mine layout, e.g., entry 10 location and pillar array, will provide a desired degree of support while avoiding over design. If not, the size and/or arrangement of the pillar array is adjusted and a subsequent FEA performed therefor. The process of adjusting the layout and analyzing the same continues until it is determined that a desired degree of support will be provided while avoiding over design of the support system. In this manner, the mining operation is optimized to allow for maximum removal of minerals while maintaining a sufficient degree of roof support, which typically includes a certain amount of over support for safety.

Figure 3A:
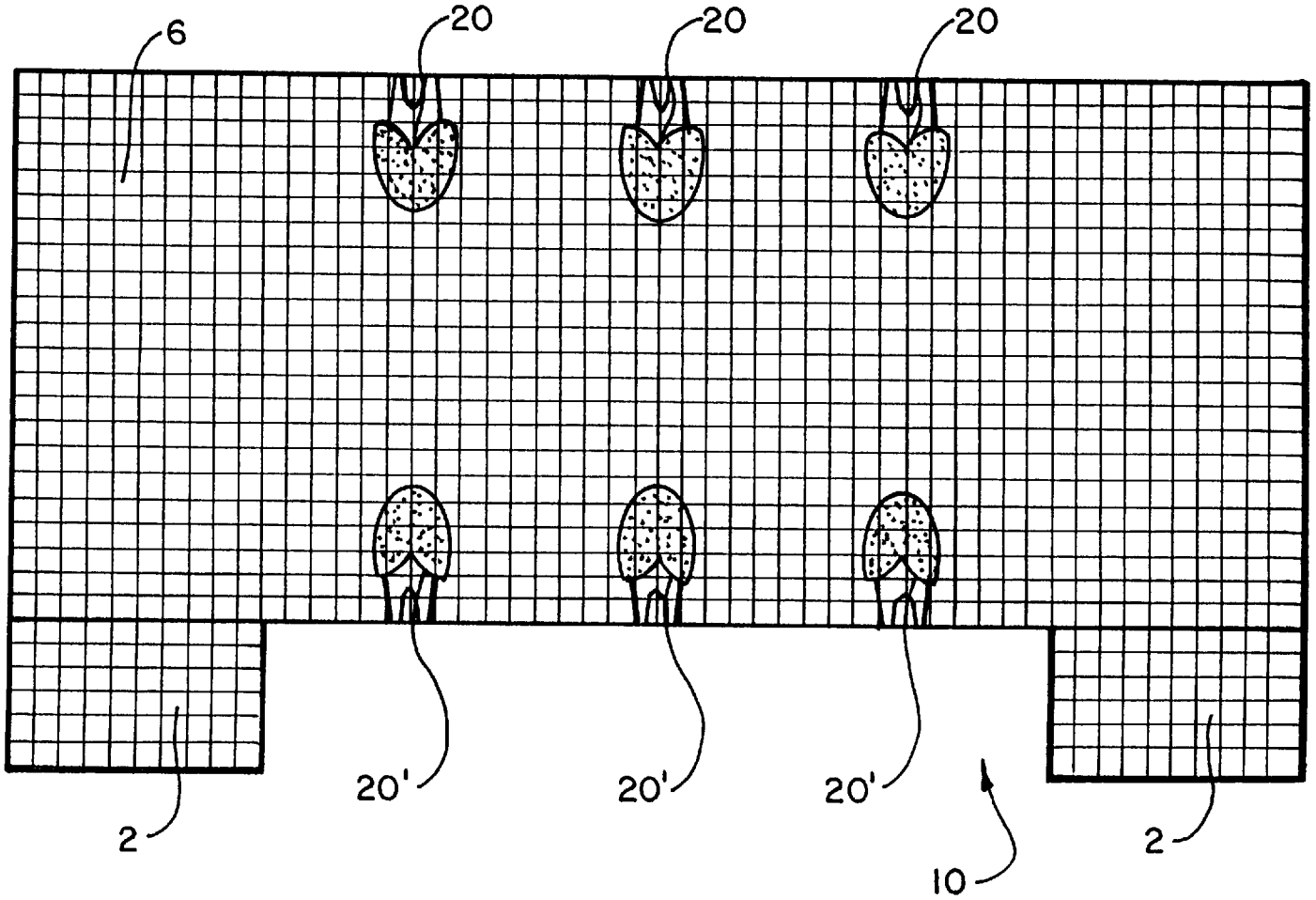
FIGS. 3A–3C illustrate a mine site divided into discrete elements for the purpose of illustrating zones of influence created by respective first, second and third bolts installed in a mine roof.
Figure 3B:
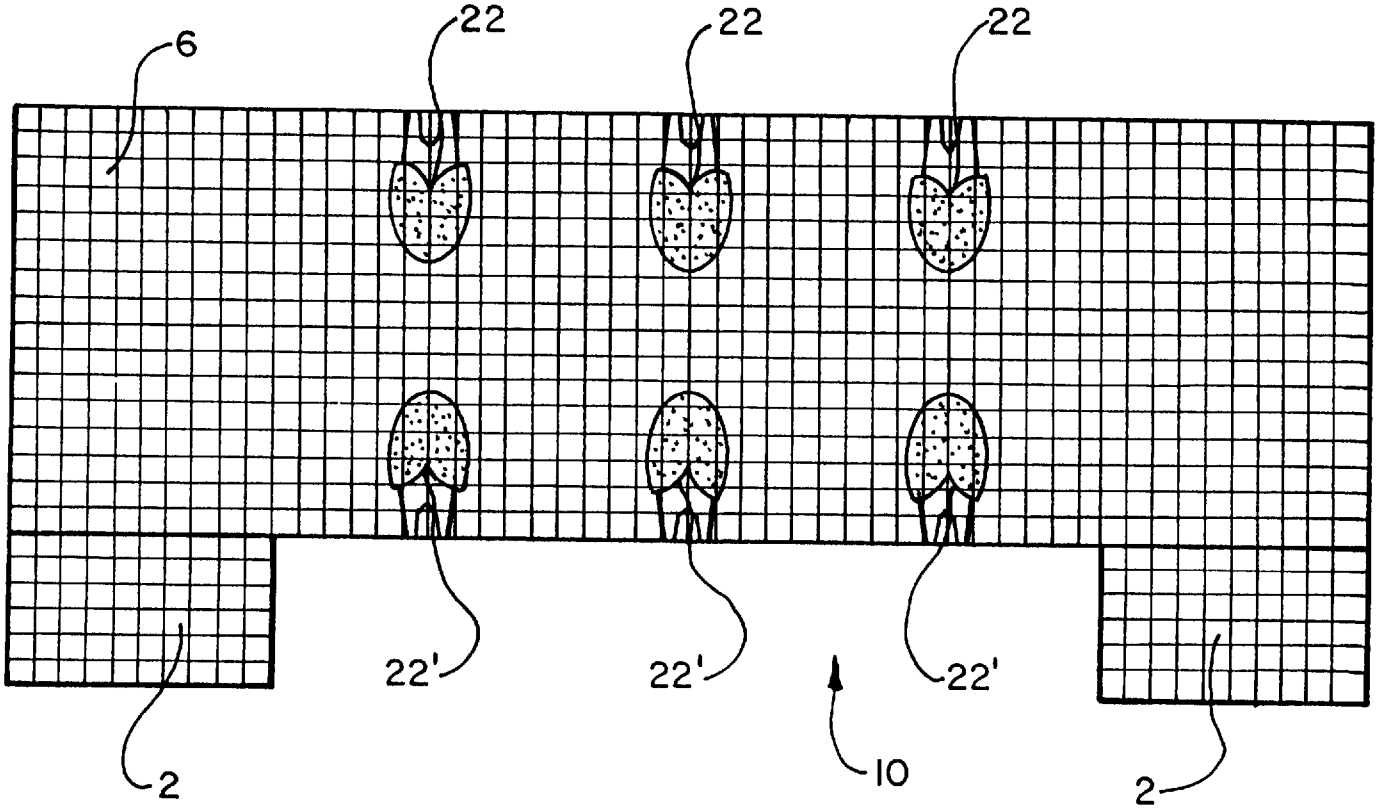
Figure 3C:
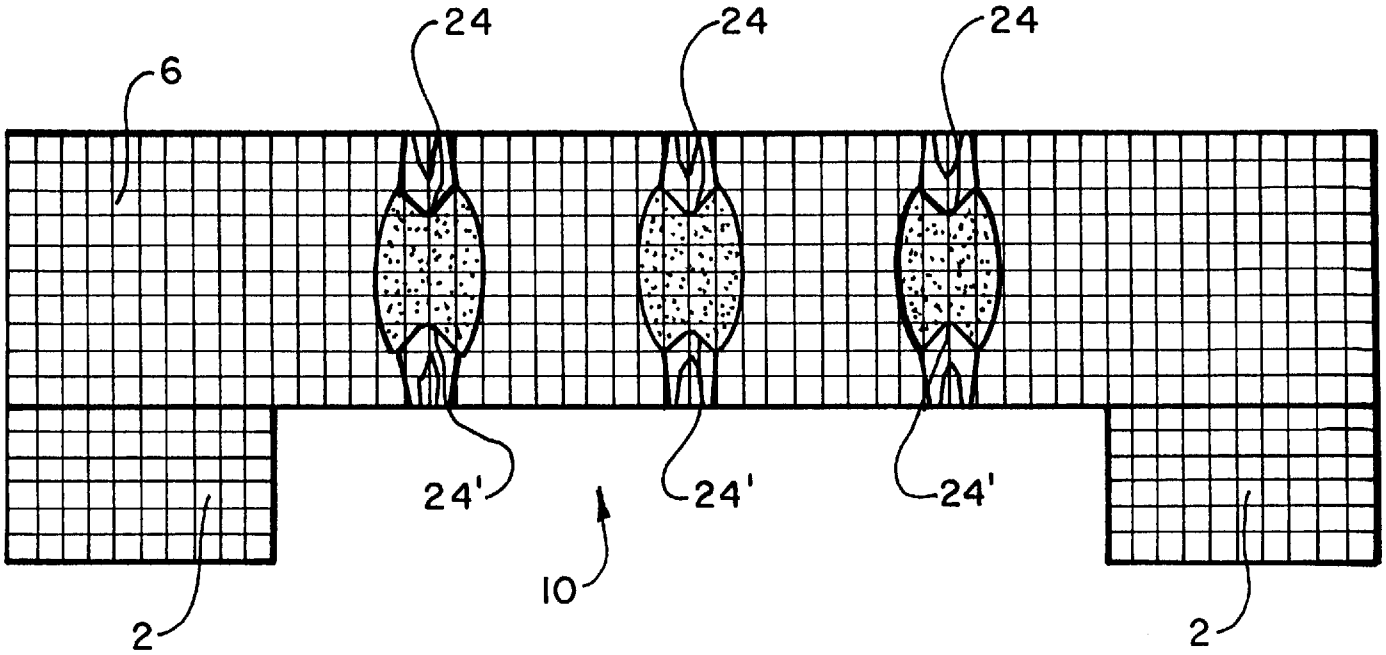

With reference to FIGS. 3A, 3B and 3C and continuing reference to FIG. 1, roof bolts 30 are utilized in mining operations to provide roof support in addition to the roof support provided by pillars. In this respect, roof bolts provide additional roof support by forming or building a composite beam in a layer of stratum, wherein such beam spans a mined out area in the mineral stratum. In application, roof bolts are disposed transverse the immediate roof stratum 6. In simplest form, a roof bolt is secured at its ends between the exposed face of the immediate roof and material above the exposed face of the immediate roof. A torque is applied to the roof bolt whereby the immediate roof and the stratum of material thereabove experiences a compressive force or load that acts to maintain contact between the boundaries of the adjacent stratum. Preferably, the bolt is torqued so that the mine roof bolt has a vertical tensile stress of approximately 80% of the yield strength thereof. Other types of roof bolts, installed in a resin with no installed load, may also be utilized. In accordance with the present invention, such passively installed bolts may also be modeled utilizing FEA. It is believed, preferably, that the area of the stratum adjacent the bolt be in compression above a certain compressive stress level. If the maximum stress level is below this level, it is believed that the mine roof is under-stabilized.

It has been determined that a roof bolt of reduced length installed at a high tension typically provides a stable roof. In this respect, FEA is utilized to analyze influence zones produced by bolts of different lengths having a common installed load. The influence zones are those zones of compressive stress created from the tension of the roof bolt acting on the stratum. These influence zones radiate from the ends of the bolt together along the length of the bolt. The influence zones are those areas in the respective stratum, wherein compressive stress above a desired level is applied. For example, in FIG. 3A, influence zones 20 and 20' for opposite ends of three eleven foot (11') bolts having an installed load of 25,000 pounds are illustrated. The influence zones 20 and 20' are separate because the applied tension radiates outward from the ends of each bolt. It is to be appreciated that in FIG. 3A, because the applied tension causes compressive stresses that radiate outward, the stress applied to the stratum near the middle of the bolt is less than the stress appearing at the ends.

In FIG. 3B, shortening the bolts to eight foot (8') lengths under the same installed load produces influence zones 22 and 22' that are still separated but closer together than the eleven foot (11') bolts. Lastly, in FIG. 3C, shortening the bolts to five foot (5') lengths under the same installed load produces overlap of influence zones 24 and 24' with acceptable compressive stresses on the stratum over the entire length of the bolt. It has been determined having influence zones overlap induces desired compression within the bolted range and in this respect contributes to an optimum beaming effect, wherein the beam created thereby has no separation above or within the bolted range with the shortest possible bolt.

It is to be appreciated that the mechanical properties of the material being bolted contribute to the determination of the bolt length and installed load that results in overlap of influence zones and consequently, optimum beaming effect. In this respect, for the purpose of FEA, the mechanical properties of the bolts are combined with the above mechanical properties for the stratum and mine site layout.

Utilizing the combination of these properties and mine site layout, FEA is performed for the mining field with an array of bolts positioned therein to produce a stress analysis of the modeled mine layout. From this stress analysis it can be considered whether the mine layout and roof bolt array will provide a desired degree of roof support. If not, the size and/or arrangement of the pillar array and/or the roof bolt arrangement, including length and installed load as required, are adjusted and a subsequent FEA performed therefor. The process of adjusting the pillar layout and/or the bolt arrangement and analyzing the same using FEA continues until it is determined that a desired degree of support will be provided thereby.

Figure 4:
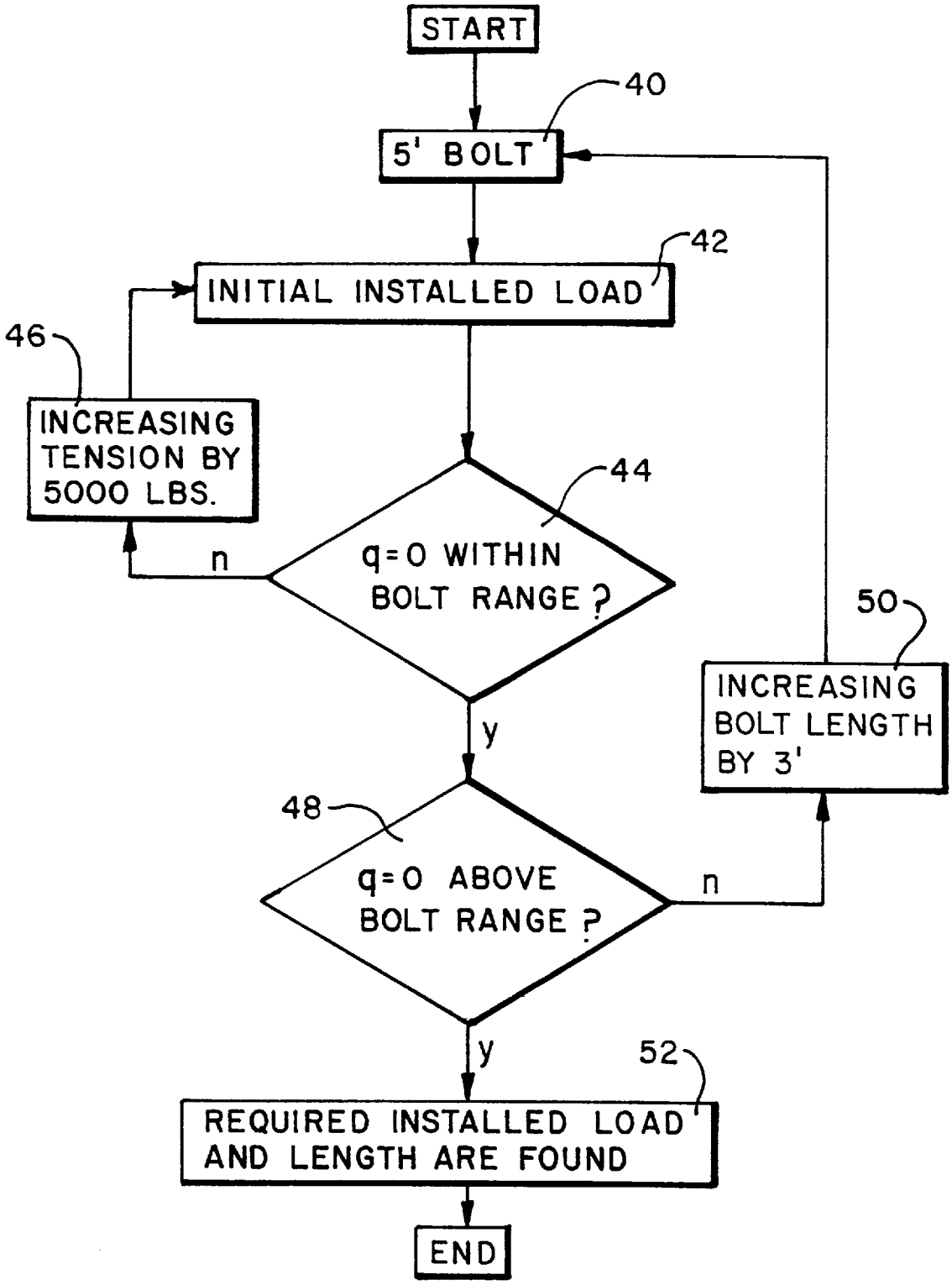
FIG. 4 illustrates a flow chart of the logic utilized to optimize the length and installed tension of a bolt to be installed in the face of a stratum having predetermined mechanical properties.
Figure 5A:
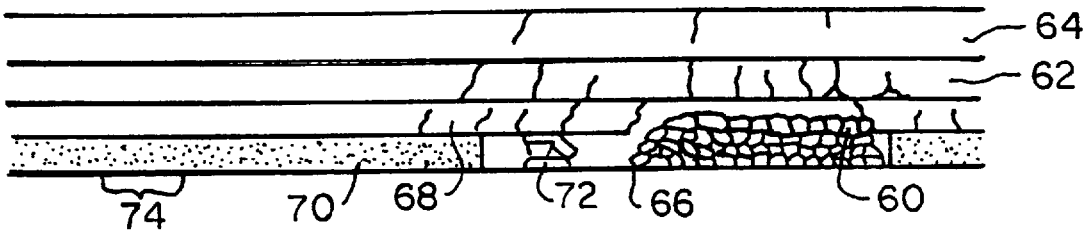
FIGS. 5A–5F are cross-sectional elevational views of a portion of a mine showing the effect of a progressive mining operation on overlying strata.
Figure 5B:
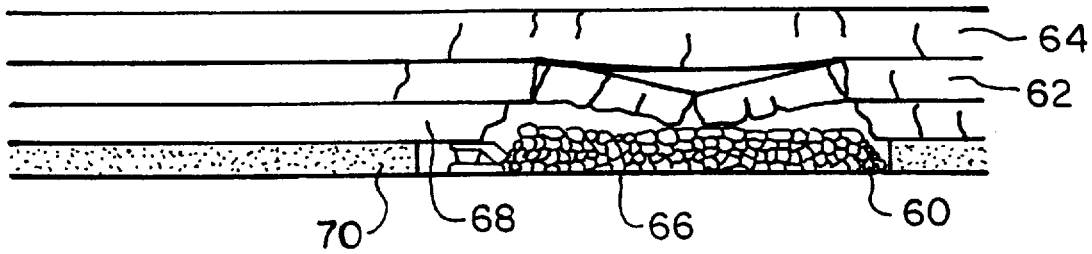
Figure 5C:
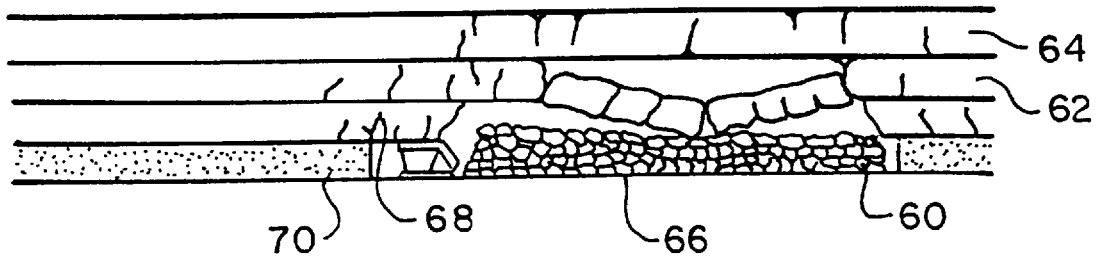
Figure 5D:
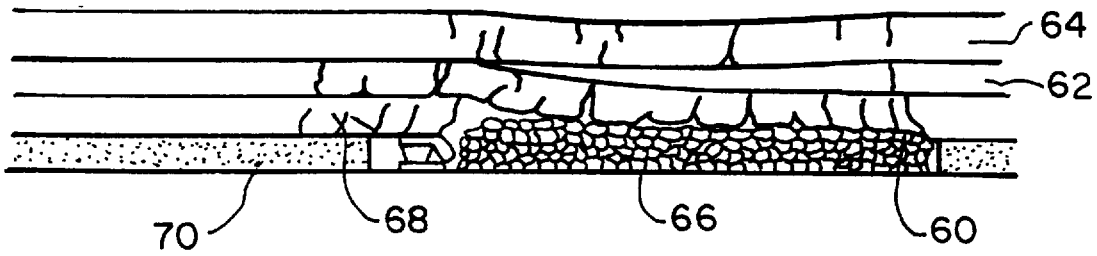
Figure 5E:
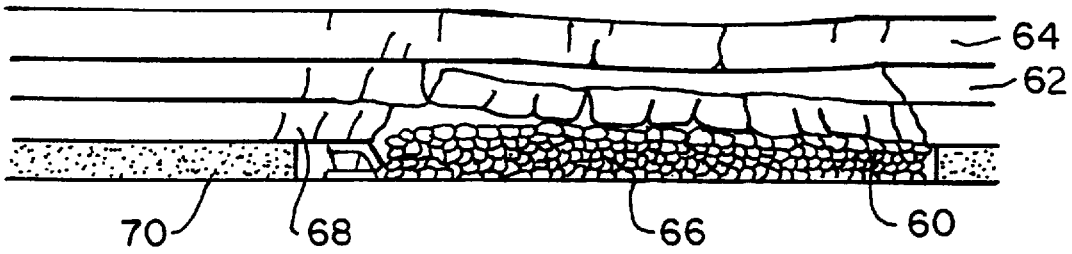
Figure 5F:
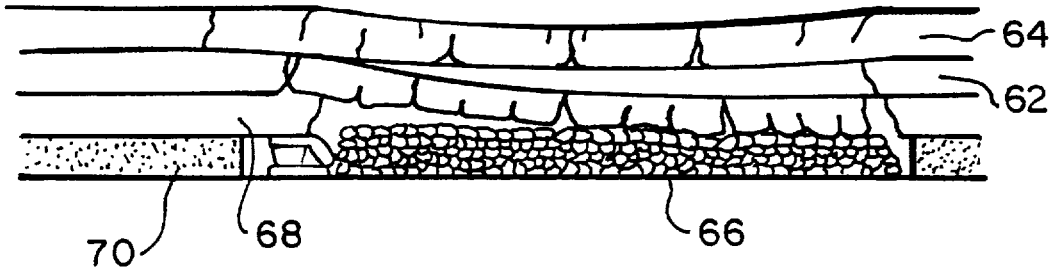

With reference to FIG. 4, a flow chart of logic utilized to optimize bolt length and installed tension is illustrated. Referring back to FIGS. 1 and 2, the mine model includes roof bolts 30 installed in an area above entry 10. At the boundary between adjacent stratum an experimentally determined friction, gap or slip region 32 is defined for indicating movement or separation of the strata if a stress level at the element is greater than a desired value. That is, if the stress at the respective slip region 32 is above the value of separation, then separation between two adjacent elements will occur. Further, an in-plane friction coefficient can be identified for the slip region 32, which is the in-plane coefficient of friction between two adjacent stratum. If the stress level at the slip element above the entry 10 is below the desired value, then it is assumed no separation occurs between adjacent strata. In the flow chart of FIG. 4, a variable "q" is utilized as an aid indicating when optimum beaming effect is achieved within a bolted range with the shortest possible bolt. In this respect, a value of q=0 is utilized to indicate that the roof layer does not separate while a value of q=1 is utilized to indicate roof layer separation above or equal to the value of separation. Values of q between 0 and 1 are believed to be useful for indicating minor roof separation. In this case, some of the slip elements indicate separation while others do not. In the present invention, the effect of an installed five foot (5') bolt is initially considered at step 40. An initial installed load, e.g., 5000 pounds, is applied at step 42 at the ends of the bolt and a determination is made at step 44 as to whether q=0 within the bolt range. If not, the tension is increased in step 46 by, for example, 5000 pounds, and a determination is made as to whether q=0 within the bolt range. If so, a determination is made as to whether q=0 outside the bolt range. If not, the bolt length is increased at step 50 by, for example, three feet (3') and the tension in the bolt is reset to the initial installed load at step 42. A determination of whether q=0 within the bolt range and the selective increasing of the tension in the bolt is made in the manner set forth above. When it is determined that q=0 within the bolt range, a determination is made as to whether q=0 outside the bolt range at step 48. If not, the bolt length is increased as set forth above and the foregoing analysis continues until q=0 outside the bolt range at step 52. In this manner, a determination is made of the optimum bolt length and tension that will result in optimum beaming effect wherein no separation occurs above or within the bolted range with the shortest possible bolt.

With reference to FIGS. 5A–5F, in longwall panel mining the overburden roof stratum are disturbed in order of severity from the immediate roof toward the surface in three discrete zones. Firstly, there is a caved zone or gob 60, which is the immediate roof stratum after it caves. In this first zone, stratum fallen on the mine floor causes the stratum to break into irregular shapes of various sizes thereby forming a gob, wherein the broken rock fragments are crowded in random manner. Secondly, above the caved zone 60 is a fractured zone 62, wherein the stratum is broken into blocks by vertical and/or subvertical fractures and horizontal cracks due to bed separation. The adjacent blocks in the fractured zone are partially or fully in contact so that a horizontal force is transmitted through and remains in this stratum. Lastly, a continuous deformation zone 64 is formed between the fractured zone and the surface, wherein the stratum deforms without causing any major cracks cutting through the thickness of the stratum as in the fractured zone.

Utilizing FEA, the changing stresses in the mining field produced by the action of these three zones during mining can be considered by performing a plurality of static stress analyses of the mining field. For example, in FIG. 5A, gob 60 rests on floor 66 and a portion of immediate roof 68 overhangs the mineral being mined 70. Because the immediate roof breaks to form the gob, the mechanical properties thereof are changed. Accordingly, it is necessary to determine the mechanical properties of the gob, i.e., at least one of Young's modulus and Poisson's ratio in an art known manner and to include the same into the FEA of the mine layout of FIG. 5A. Utilizing the mechanical properties of the gob in combination with the mechanical properties, as set forth above, for, without limitation, the mineral stratum, the stratum forming the fractured zone and the stratum forming the continuous deformation zone, an FEA is performed for the layout of the mining field, wherein such properties are converted into a stress analysis thereof. Advancing the mining operation to the left in FIGS. 5B through 5F causes additional gob 60 to be formed by the collapse of the immediate roof 68 and the stratum in the fractured zone 62 to relax onto the gob 60. Moreover, the stratum in the continuous deformation zone 64 undergoes relaxation in response to relaxation of the underlying strata. By performing a plurality of static FEA of a mining operation for the conditions illustrated in FIGS. 5A–5F, the changing stresses in the mining field, due to such mining operation, can be determined. Further, such FEA allows for determination of an amount of subsidence at the surface of the continuous deformation zone due to the underlying mining operation. It is to be appreciated that the influence of the powered support 72 of a continuous miner (not shown) on such FEA may also be considered by including a model of its mechanical properties in the mesh comprising the FEA model. Similarly, it should also be appreciated that, like above, the effect of pillars and roof bolts on the model of FIGS. 5A–5F (not shown) may also be considered by including a model of their mechanical properties at appropriate locations in the model of the mining field FEA model.

The progression of mining operation from right to left in FIGS. 5A–5F produces above-average stresses on the panel and pillars adjacent the mined out mineral by the redistribution of pressure previously applied to the mined out mineral. These above-average stresses, called abutment pressures, can be determined by applying the above material properties at appropriate locations in the model of the mining field for the FEA. The use of FEA is particularly useful for determining peak front abutment pressure and peak side abutment pressure as the mining operation approaches the area being analyzed. Utilizing the peak front abutment pressure and the peak side abutment pressure, the roof support plan can be analyzed and appropriate adjustments made in the pillar layout and/or the bolt arrangement as required to provide desired roof support. It is to be appreciated that determining peak abutment pressures may also be performed for a mining operation that is progressing towards a cut-through entry. For example, if a cut-through entry is formed by removing mineral disposed at the location 74 in FIG. 5A, a plurality of static FEA of the mining field can determine where the mining operation will produce peak abutment pressures.

In addition to the foregoing, boundary conditions between adjacent mesh elements may be included as part of the FEA to obtain an enhanced stress analysis of a given area of a mine. These boundary conditions include, without limitation, the coefficient of friction between adjacent strata, the coefficient of friction between a layer of strata and a roof bolt, including a roof bolt installed in resin, and the like.

Figure 6:
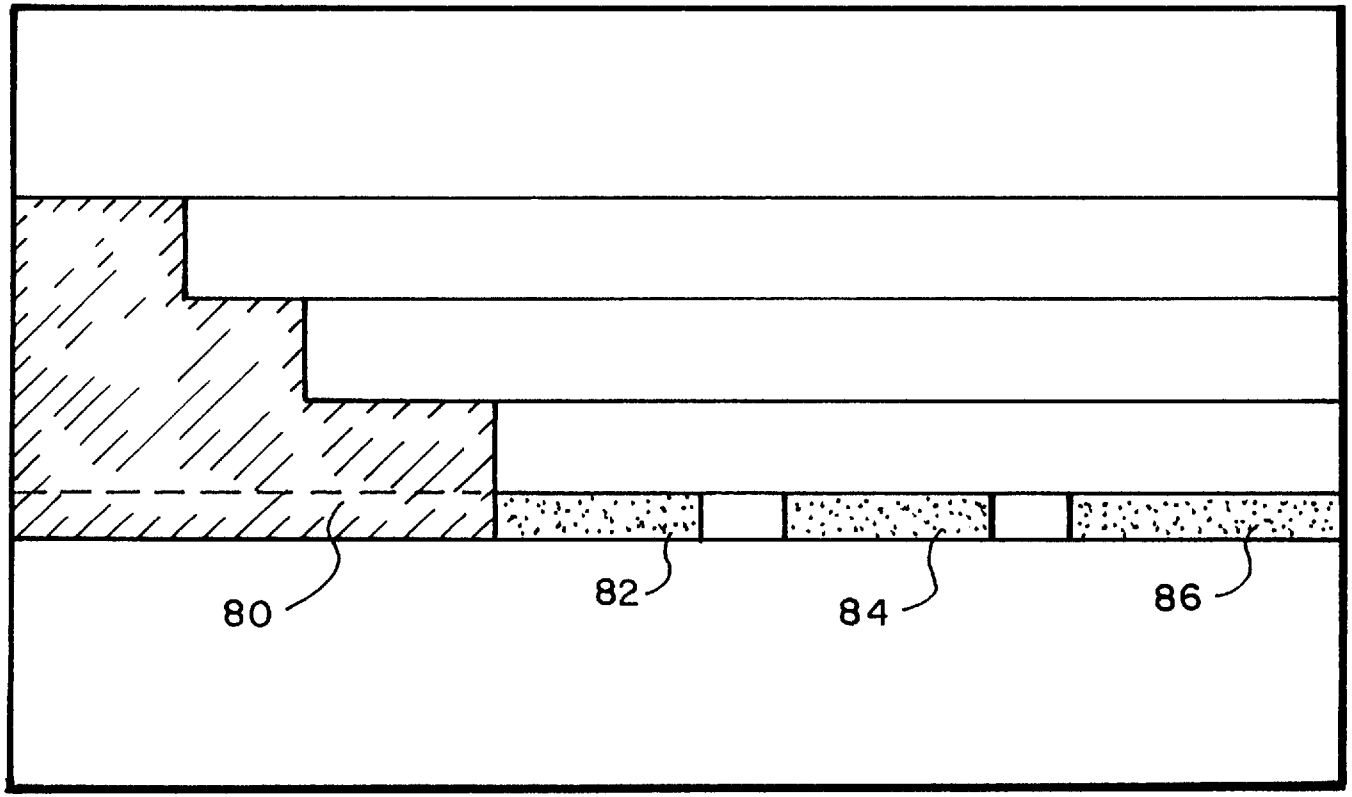
FIG. 6 is a cross-sectional elevational view of a three entry mine with gob on one side thereof.

In accordance with the present invention, FEA was conducted on various mine sites to obtain stress information of such sites. With reference to FIG. 6, in one analysis, the pillar configuration was analyzed for a mine site, wherein soft floor conditions in the mine were taken into consideration. The mechanical properties of the mine site included:

roof vertical Young's modulus=$5.5\times10^5$ psi roof horizontal Young's modulus=$1.5\times10^6$ psi coal Young's modulus=$3.1\times10^5$ psi floor vertical Young's modulus=$1\times10^5$ psi floor horizontal Young's modulus=$3\times10^5$ psi gob Young's modulus=$5.5\times10^3$ psi The analysis was performed for an overburden depth of 450' feet which was considered to be the largest value for the mine. In the first analysis, the vertical stress distribution for a current pillar configuration of 68'×93' was considered. From this analysis, it was determined that as the left side panel 80 is mined out, the average floor stress is 912 psi under first pillar 82 and 700 psi under second pillar 84. After the right side panel 86 is mined out, the average stress is 1,112 psi under both pillars. Another analysis, performed for an adjusted configuration wherein the pillar size is 50'×93', yielded an average floor stress of 1,010 psi under first pillar 82 and 765 psi under second pillar 84 as the left side panel 80 is mined out. After the right side panel 86 is mined out, the average floor stress is 1,375 psi under both pillars. From this analysis and an analysis of the floor bearing capacity, it was determined that the current pillar size could be reduced without having detrimental effect on pillar stability and roof control.

In a second analysis, the effectiveness of a four foot (4') bolt in a mine was analyzed. In the analysis, the following mechanical properties and physical parameters were considered:

roof Young's modulus=$1.5\times10^6$ psi coal Young's modulus=$2.0\times10^5$ psi floor Young's modulus=$1.0\times10^6$ psi gob Young's modulus=$1.0\times10^4$ psi entry width=19' entry height=6' overburden depth=650' in-situ stress=600 psi

Moreover, the following bolt parameters were considered in the model:

bolt length=4' installed load=25,000 lbs bolt Young's modulus=$3\times10^7$ psi bolt diameter=⅞"

friction coefficient between adjacent stratum=0.7

From the analysis it was determined a zone of compression intersecting or overlap condition, i.e., influence zone overlap, was induced which resulted in no separation being detected within or above the bolted range, i.e., optimum beaming effect.

In yet a third analysis, longwall cut-through entries in a mine were considered. In this analysis the following mechanical properties and physical parameters were considered:

gob Young's modulus=$1.0\times10^4$ psi cut-through entry width=18' overburden depth=1,200' in-situ horizontal stress=1,140 psi longwall shield capacity=920 st immediate roof overhang=30' main roof overhang=60' pillar width=82' gob width=100'

From the analysis, it was determined that a fully grouted rebar roof bolt was suitable for lateral shearing action in the roof. It has been determined that a normalized value of Poisson's ratio of 0.3 for the horizontal direction and vertical direction yields suitable FEA results. It is to be appreciated however, that horizontal and vertical values of Poisson's ratio could be determined for each mine site and utilized in the FEA thereof.

Attached herewith are 157 pages of computer program listing in the ANSYS program language for various mine models. For example, pages 20–24 are for a model of a two dimensional single entry system; pages 25–31 are for a model of a two dimensional two entry system; and so forth.

From the foregoing, it would be appreciated that the present invention provides a more accurate method for determining stresses in an underground mine. Moreover, the present invention provides a method for designing a mine layout.

The above invention has been described with reference to the preferred embodiments, obvious modifications, combinations and alterations will occur to others upon reading the preceding detailed description. It is intended that the invention be construed as including all such modifications, combination and alterations insofar as they come within the scope of the following claims or the equivalents thereof.

```
!Model for 2-dimensional single entry system
/prep7
/title
/nopr
antype,static


/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,burden,'overburden thickness',750
*ask,sigmah,'in-situ horizontal stress',1500

*ask,c1,'coal height',6*12
*ask,y1,'coal Youngs modulus',2e5
uimp,1,ex,ey,ez,y1,y1,y1

*ask,c2,'imm. roof thickness',30*12
*ask,y2,'imm. roof v Youngs modulus',5.6e5
*ask,z2,'imm. roof h Youngs modulus',2.82e6

uimp,2,ex,ey,ez,z2,y2,z2


*ask,c3,'main roof thickness',30*12
*ask,y3,'main roof v Youngs modulus',5.6e5
*ask,z3,'main roof h Youngs modulus',2.82e6
uimp,3,ex,ey,ez,z3,y3,z3

*ask,c0,'floor thickness',40*12
*ask,y0,'floor v Youngs modulus',5e5
*ask,z0,'floor h Youngs modulus',2e6
uimp,4,ex,ey,ez,z0,y0,z0

*ask,w1,'left solid coal width',100*12
*ask,p1,'entry width', 18*12
*ask,w2,'right solid width',100*12


rect,-w1,0,0,c1
rect,p1,p1+w2,0,c1
rect,-w1,p1+w2,c1,c1+c2
rect, -w1,p1+w2,c1+c2,c1+c2+c3
rect,-w1,p1+w2,-c0,0
```

```
aplot

/pnum,area,1
/replot

ET,1,PLANE42
KEYOPT,1,1,0
KEYOPT,1,2,0
KEYOPT,1,3,2
KEYOPT,1,5,0
KEYOPT,1,6,0
!*


*ask,nw1,'# elem. left solid widthwise',10
*ask,nw2,'# elem. right solid widthwise',10


*ask,np1,'# elem. entry widthwise(even)',6

*ask,nc1,'# elem. coal heightwise',4
*ask,nc2,'# elem. imm. roof heightwise',10
*ask,nc3,'# elem. main roof heightwise',6
*ask,nc0,'# elem. floor heightwise',6

n,1,-w1,-c0
n,nw1+1,0,-c0
fill,1,nw1+1,

ngen,nc0+1,nw1+1,1,nw1+1,,,c0/nc0

ngen,nc1+1,nw1+1,(nw1+1)*nc0+1, (nw1+1)*nc0+nw1+1,,,c1/nc1

ngen,nc2+1,nw1+1,(nw1+1)*nc0+(nw1+1)*nc1+1,(nw1+1)*nc0+(nw1+1)*nc
1+nw1+1,,,c2/nc2
ngen,nc3+1,nw1+1,(nw1+1)*nc0+(nw1+1)*nc1+(nw1+1)*nc2+1,(nw1+1)*nc
0+(nw1+1)*nc1+(nw1+1)*nc2+nw1+1,,,c3/nc3

na1=(nw1+1)*(nc0+nc1+nc2+nc3+1)

n,na1+1,0,-c0
n,na1+np1+1,p1,-c0
fill,na1+1,na1+np1+1

ngen,nc0+1,np1+1,na1+1,na1+np1+1,,,c0/nc0

na2=na1+(np1+1)*(nc0+1)

n,na2+1,0,c1
n,na2+np1+1,p1,c1
fill,na2+1,na2+np1+1,

ngen,nc2+1,np1+1,na2+1,na2+np1+1,,,c2/nc2
ngen,nc3+1,np1+1,na2+1+(np1+1)*nc2,na2+(np1+1)*nc2+np1+1,,,c3/nc3
```

```
na3=na2+(np1+1)*(nc2+nc3+1)

n,na3+1,p1,-c0
n,na3+nw2+1,p1+w2,-c0
fill,na3+1,na3+nw2+1

ngen,nc0+1,nw2+1,na3+1,na3+nw2+1,,,c0/nc0
ngen,nc1+1,nw2+1,na3+(nw2+1)*nc0+1,na3+(nw2+1)*nc0+nw2+1,,,c1/nc1
ngen,nc2+1,nw2+1,na3+(nw2+1)*nc0+(nw2+1)*nc1+1,na3+(nw2+1)*nc0+(n
w2+1)*nc1+nw2+1,,,c2/nc2
ngen,nc3+1,nw2+1,na3+(nw2+1)*nc0+(nw2+1)*nc1+(nw2+1)*nc2+1,na3+(n
w2+1)*nc0+(nw2+1)*nc1+(nw2+1)*nc2+nw2+1,,,c3/nc3

na4=na3+(nw2+1)*(nc0+nc1+nc2+nc3+1)


mat,4
e,1,2,(nw1+1)+2,(nw1+1)+1      ! generate element on the gob side
egen,nw1,1,-1
egen,(nc0+nc1+nc2+nc3),(nw1+1),-nw1

e,na1+1,na1+2, na1+(np1+1)+2,na1+ (np1+1)+1   ! generate element for
floor in the face
egen,np1,1,-1
egen,nc0,np1+1,-np1

e,na2+1,na2+2, na2+(np1+1)+2,na2+ (np1+1)+1   ! generate element for
roof in the face
egen,np1,1,-1
egen,nc2+nc3,np1+1,-np1

e,na3+1,na3+2,na3+(nw2+1)+2,na3+(nw2+1)+1     ! generate element for
the 1st pillar from bottom to up
egen,nw2,1,-1
egen,(nc0+nc1+nc2+nc3),(nw2+1),-nw2


esel,s, elem,,nc0*nw1+1,nc0*nw1+nc1*nw1
emodif,all,mat,1
esel,all

esel,s, elem,,(nc0*nw1)+(nc1*nw1)+1,(nc0*nw1)+(nc1*nw1)+(nc2*nw1)
emodif,all,mat,2
esel,all

e          s          e          l          ,          s          ,
elem,,(nc0*nw1)+(nc1*nw1)+(nc2*nw1)+1,(nc0*nw1)+(nc1*nw1)+(nc2*nw
1)+(nc3*nw1)
emodif,all,mat,3
esel,all

q1=nw1*(nc0+nc1+nc2+nc3)
```

```
esel,s,elem,,q1+(nc0*np1)+1,q1+(nc0*np1)+(nc2*np1)      ! for Imm.
roof in face
emodif,all,mat,2
esel,all

q2=np1*(nc0+nc2+nc3)

esel,s,elem,,q1+(nc0*np1)+(nc2*np1)+1,q1+q2
emodif,all,mat,3
esel,all

esel,s,elem,,q1+q2+nw2*nc0+1,q1+q2+nw2*(nc0+nc1)   !1st coal pillar
emodif,all,mat,1
esel,all

esel,s,elem,,q1+q2+nw2*(nc0+nc1)+1,q1+q2+nw2*(nc0+nc1+nc2)   !roof
above 1st pillar
emodif,all,mat,2
esel,all


esel,s,elem,,q1+q2+nw2*(nc0+nc1+nc2)+1,q1+q2+nw2*(nc0+nc1+nc2+nc3
)     !main roof above 1st pillar
emodif,all,mat,3
esel,all


NUMMRG,NODE, ,

eplot


nsel,s,loc,x,-w1
sf,all, pres,sigmah

nsel,s,loc,x,(p1+w2)
sf,all, pres,sigmah


nsel,s,loc,y,-c0
d,all,uy,0

nsel,s,loc,y,-c0
nsel,r,loc,x,p1/2

d,all,ux,0


nsel,s,loc,y,c1+c2+c3
sf,all,pres,1.1*burden

nsel,all
```

```
/PNUM,MAT,1

/PSF,PRES,NORM,2
/PBF,DEFA, ,1
/PSYMB,CS,0
/PSYMB,NDIR,0
/PSYMB,ESYS,0
/PSYMB,LDIR,0
/PSYMB,LAYR,0
!*
/PBC,ALL,,1
/PBC,NFOR,,0
/PBC,NMOM,,0
/PBC,RFOR,,0
/PBC,RMOM,,0
/REPLOT
!*

/SOLU
FINISH
/SOLU
/STAT,SOLU
SOLVE
/dscale,1,1
/PLOPTS,INFO,ON
/POST1
FINISH
/POST1
PLNSOL,S,X
PLNSOL,S,Y
PLNSOL,S,XY
/PNUM,KP,0
/PNUM,LINE,0
/PNUM,AREA,1
/PNUM,VOLU,0
/PNUM,NODE,0
/PNUM,SVAL,0
/NUM,0
!*
/PNUM,MAT,0
!
!*
PLVECT,S
/ZOOM,1,RECT,-0.198039,-0.212937,0.238959,0.110140
```

```
!Model for 2-D two entry system
/prep7
/title
/nopr
antype,static


/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,burden,'overburden thickness',750
*ask,sigmah,'in-situ horizontal stress',1500

*ask,c1,'coal height',6*12
*ask,y1,'coal Youngs modulus',2e5
uimp,1,ex,ey,ez,y1,y1,y1

*ask,c2,'imm. roof thickness',30*12
*ask,y2,'imm. roof v Youngs modulus',5.6e5
*ask,z2,'imm. roof h Youngs modulus',2.82e6

uimp,2,ex,ey,ez,z2,y2,z2


*ask,c3,'main roof thickness',30*12
*ask,y3,'main roof v Youngs modulus',5.6e5
*ask,z3,'main roof h Youngs modulus',2.82e6
uimp,3,ex,ey,ez,z3,y3,z3

*ask,c0,'floor thickness',40*12
*ask,y0,'floor v Youngs modulus',5e5
*ask,z0,'floor h Youngs modulus',2e6
uimp,4,ex,ey,ez,z0,y0,z0

*ask,w1,'left solid coal width',100*12
*ask,p1,'entry 1 width', 18*12
*ask,p2,'entry2 width', 18*12
*ask,w2,'pillar 1 width',60*12
*ask,w3,'solid coal width', 100*12

rect,-w1,0,0,c1

rect,p1,p1+w2,0,c1

rect,p1+w2+p2,p1+w2+p2+w3,0,c1
```

```
rect,-w1,p1+w2+p2+w3,c1,c1+c2

rect, -w1,p1+w2+p2+w3,c1+c2,c1+c2+c3

rect,-w1,p1+w2+p2+w3,-c0,0

aplot

/pnum,area,1
/replot

ET,1,PLANE42
KEYOPT,1,1,0
KEYOPT,1,2,0
KEYOPT,1,3,2
KEYOPT,1,5,0
KEYOPT,1,6,0
!*

*ask,nw1,'# elem. left solid widthwise',10
*ask,nw2,'# elem. pillar(even #) widthwise',6
*ask,nw3,'# elem. right solid widthwise',10


*ask,np1,'# elem. entry 1 widthwise',6
*ask,np2,'# elem. entry 2 widthwise',6

*ask,nc1,'# elem. coal heightwise',4
*ask,nc2,'# elem. imm. roof heightwise',10
*ask,nc3,'# elem. main roof heightwise',6
*ask,nc0,'# elem. floor heightwise',6

n,1,-w1,-c0
n,nw1+1,0,-c0
fill,1,nw1+1,

ngen,nc0+1,nw1+1,1,nw1+1,,,c0/nc0

ngen,nc1+1,nw1+1,(nw1+1)*nc0+1, (nw1+1)*nc0+nw1+1,,,c1/nc1

ngen,nc2+1,nw1+1,(nw1+1)*nc0+(nw1+1)*nc1+1,(nw1+1)*nc0+(nw1+1)*nc
1+nw1+1,,,c2/nc2
ngen,nc3+1,nw1+1,(nw1+1)*nc0+(nw1+1)*nc1+(nw1+1)*nc2+1,(nw1+1)*nc
0+(nw1+1)*nc1+(nw1+1)*nc2+nw1+1,,,c3/nc3

na1=(nw1+1)*(nc0+nc1+nc2+nc3+1)

n,na1+1,0,-c0
n,na1+np1+1,p1,-c0
fill,na1+1,na1+np1+1

ngen,nc0+1,np1+1,na1+1,na1+np1+1,,,c0/nc0

na2=na1+(np1+1)*(nc0+1)
```

```
n,na2+1,0,c1
n,na2+np1+1,p1,c1
fill,na2+1,na2+np1+1,

ngen,nc2+1,np1+1,na2+1,na2+np1+1,,,c2/nc2
ngen,nc3+1,np1+1,na2+1+(np1+1)*nc2,na2+(np1+1)*nc2+np1+1,,,c3/nc3


na3=na2+(np1+1)*(nc2+nc3+1)

n,na3+1,p1,-c0
n,na3+nw2+1,p1+w2,-c0
fill,na3+1,na3+nw2+1

ngen,nc0+1,nw2+1,na3+1,na3+nw2+1,,,c0/nc0
ngen,nc1+1,nw2+1,na3+(nw2+1)*nc0+1,na3+(nw2+1)*nc0+nw2+1,,,c1/nc1
ngen,nc2+1,nw2+1,na3+(nw2+1)*nc0+(nw2+1)*nc1+1,na3+(nw2+1)*nc0+(n
w2+1)*nc1+nw2+1,,,c2/nc2
ngen,nc3+1,nw2+1,na3+(nw2+1)*nc0+(nw2+1)*nc1+(nw2+1)*nc2+1,na3+(n
w2+1)*nc0+(nw2+1)*nc1+(nw2+1)*nc2+nw2+1,,,c3/nc3

na4=na3+(nw2+1)*(nc0+nc1+nc2+nc3+1)


n,na4+1,p1+w2,-c0
n,na4+np2+1,p1+w2+p2,-c0
fill,na4+1,na4+np2+1

ngen,nc0+1,np2+1,na4+1,na4+np2+1,,,c0/nc0

na5=na4+(np2+1)*(nc0+1)

n,na5+1,p1+w2,c1
n,na5+np2+1,p1+w2+p2,c1
fill,na5+1,na5+np2+1,

ngen,nc2+1,np2+1,na5+1,na5+np2+1,,,c2/nc2
ngen,nc3+1,np2+1,na5+1+(np2+1)*nc2,na5+(np2+1)*nc2+np2+1,,,c3/nc3


na6=na5+(np2+1)*(nc2+nc3+1)


n,na6+1,p1+w2+p2,-c0                    ! for 2nd pillar all way
from bottom to top
n,na6+nw3+1,p1+w2+p2+w3,-c0
fill,na6+1,na6+nw3+1

ngen,nc0+1,nw3+1,na6+1,na6+nw3+1,,,c0/nc0
ngen,nc1+1,nw3+1,na6+(nw3+1)*nc0+1,na6+(nw3+1)*nc0+nw3+1,,,c1/nc1
ngen,nc2+1,nw3+1,na6+(nw3+1)*nc0+(nw3+1)*nc1+1,na6+(nw3+1)*nc0+(n
w3+1)*nc1+nw3+1,,,c2/nc2
ngen,nc3+1,nw3+1,na6+(nw3+1)*nc0+(nw3+1)*nc1+(nw3+1)*nc2+1,na6+(n
w3+1)*nc0+(nw3+1)*nc1+(nw3+1)*nc2+nw3+1,,,c3/nc3
```

```
mat,4
e,1,2,(nw1+1)+2,(nw1+1)+1      ! generate element on the gob side
egen,nw1,1,-1
egen,(nc0+nc1+nc2+nc3),(nw1+1),-nw1

e,na1+1,na1+2, na1+(np1+1)+2,na1+ (np1+1)+1  ! generate element for
floor in the face
egen,np1,1,-1
egen,nc0,np1+1,-np1

e,na2+1,na2+2, na2+(np1+1)+2,na2+ (np1+1)+1  ! generate element for
roof in the face
egen,np1,1,-1
egen,nc2+nc3,np1+1,-np1

e,na3+1,na3+2,na3+(nw2+1)+2,na3+(nw2+1)+1     ! generate element for
the 1st pillar from bottom to up
egen,nw2,1,-1
egen,(nc0+nc1+nc2+nc3),(nw2+1),-nw2

e,na4+1,na4+2, na4+(np2+1)+2,na4+ (np2+1)+1  ! generate element for
floor of 1st entry on the face side
egen,np2,1,-1
egen,nc0,np2+1,-np2

e,na5+1,na5+2, na5+(np2+1)+2,na5+ (np2+1)+1  ! generate element for
roof in 1st entry
egen,np2,1,-1
egen,nc2+nc3,np2+1,-np2

e,na6+1,na6+2,na6+(nw3+1)+2,na6+(nw3+1)+1     ! generate element for
the 2st pillar from bottom to up
egen,nw3,1,-1
egen,(nc0+nc1+nc2+nc3),(nw3+1),-nw3


esel,s, elem,,nc0*nw1+1,nc0*nw1+nc1*nw1
emodif,all,mat,1
esel,all

esel,s, elem,,(nc0*nw1)+(nc1*nw1)+1,(nc0*nw1)+(nc1*nw1)+(nc2*nw1)
emodif,all,mat,2
esel,all

e          s          e          l          ,          s          ,
elem,,(nc0*nw1)+(nc1*nw1)+(nc2*nw1)+1,(nc0*nw1)+(nc1*nw1)+(nc2*nw
1)+(nc3*nw1)
emodif,all,mat,3
esel,all

q1=nw1*(nc0+nc1+nc2+nc3)
```

```
esel,s,elem,,q1+(nc0*np1)+1,q1+(nc0*np1)+(nc2*np1)     ! for Imm.
roof in face
emodif,all,mat,2
esel,all

q2=np1*(nc0+nc2+nc3)

esel,s,elem,,q1+(nc0*np1)+(nc2*np1)+1,q1+q2
emodif,all,mat,3
esel,all

esel,s,elem,,q1+q2+nw2*nc0+1,q1+q2+nw2*(nc0+nc1)   !1st coal pillar
emodif,all,mat,1
esel,all

esel,s,elem,,q1+q2+nw2*(nc0+nc1)+1,q1+q2+nw2*(nc0+nc1+nc2)   !roof
above 1st pillar
emodif,all,mat,2
esel,all


esel,s,elem,,q1+q2+nw2*(nc0+nc1+nc2)+1,q1+q2+nw2*(nc0+nc1+nc2+nc3
)     !main roof above 1st pillar
emodif,all,mat,3
esel,all


q3=nw2*(nc0+nc1+nc2+nc3)

esel,s,elem,,q1+q2+q3+np2*nc0+1,q1+q2+q3+np2*(nc0+nc2)       !imm.
roof above 1st entry
emodif,all,mat,2
esel,all

esel,s,elem,,q1+q2+q3+np2*(nc0+nc2)+1,q1+q2+q3+np2*(nc0+nc2+nc3)
     !main roof above 1st entry
emodif,all,mat,3
esel,all

q4=np2*(nc0+nc2+nc3)

esel,s,elem,,q1+q2+q3+q4+nw3*nc0+1,q1+q2+q3+q4+nw3*(nc0+nc1)
     !2nd coal pillar
emodif,all,mat,1
esel,all

esel,s,elem,,q1+q2+q3+q4+nw3*(nc0+nc1)+1,q1+q2+q3+q4+nw3*(nc0+nc1
+nc2)     !roof above 2nd pillar
emodif,all,mat,2
esel,all


esel,s,elem,,q1+q2+q3+q4+nw3*(nc0+nc1+nc2)+1,q1+q2+q3+q4+nw3*(nc0
+nc1+nc2+nc3)  !main roof above 2nd pillar
```

```
emodif,all,mat,3
esel,all


NUMMRG,NODE, ,

eplot


nsel,s,loc,x,-w1
sf,all, pres,sigmah

nsel,s,loc,x,(p1+w2+p2+w3)
sf,all, pres,sigmah


nsel,s,loc,y,-c0
d,all,uy,0

nsel,s,loc,y,-c0
nsel,r,loc,x,p1+w2/2

d,all,ux,0


nsel,s,loc,y,c1+c2+c3
sf,all,pres,1.1*burden

nsel,all


/PNUM,MAT,1

/PSF,PRES,NORM,2
/PBF,DEFA, ,1
/PSYMB,CS,0
/PSYMB,NDIR,0
/PSYMB,ESYS,0
/PSYMB,LDIR,0
/PSYMB,LAYR,0
!*
/PBC,ALL,,1
/PBC,NFOR,,0
/PBC,NMOM,,0
/PBC,RFOR,,0
/PBC,RMOM,,0
/REPLOT
!*

/SOLU
FINISH
/SOLU
/STAT,SOLU
```

```
SOLVE
/dscale,1,1
/PLOPTS,INFO,ON
/POST1
FINISH
/POST1
PLNSOL,S,X
PLNSOL,S,Y
PLNSOL,S,XY
/PNUM,KP,0
/PNUM,LINE,0
/PNUM,AREA,1
/PNUM,VOLU,0
/PNUM,NODE,0
/PNUM,SVAL,0
/NUM,0
!*
/PNUM,MAT,0
!
!*
PLVECT,S
```

```
! Model for 2-D three entry system
/prep7
/title
/nopr
antype,static


/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,burden,'overburden thickness',750
*ask,sigmah,'in-situ horizontal stress',1500

*ask,c1,'coal height',6*12
*ask,y1,'coal Youngs modulus',2e5
uimp,1,ex,ey,ez,y1,y1,y1

*ask,c2,'imm. roof thickness',30*12
*ask,y2,'imm. roof v Youngs modulus',5.6e5
*ask,z2,'imm. roof h Youngs modulus',2.82e6

uimp,2,ex,ey,ez,z2,y2,z2


*ask,c3,'main roof thickness',30*12
*ask,y3,'main roof v Youngs modulus',5.6e5
*ask,z3,'main roof h Youngs modulus',2.82e6
uimp,3,ex,ey,ez,z3,y3,z3

*ask,c0,'floor thickness',40*12
*ask,y0,'floor v Youngs modulus',5e5
*ask,z0,'floor h Youngs modulus',2e6
uimp,4,ex,ey,ez,z0,y0,z0

*ask,w1,'left solid width',100*12
*ask,p1,'entry 1 width', 18*12
*ask,p2,'entry2 width', 18*12
*ask,w2,'pillar 1 width',60*12
*ask,w3,'pillar 2 width', 60*12
*ask,p3,'entry 3 width',18*12
*ask,w4,'right solid width', 100*12

rect,-w1,0,0,c1

rect,p1,p1+w2,0,c1
```

```
rect,p1+w2+p2,p1+w2+p2+w3,0,c1

rect,p1+w2+p2+w3+p3,p1+w2+p2+w3+p3+w4,0,c1

rect,-w1,p1+w2+p2+w3+p3+w4,c1,c1+c2

rect, -w1,p1+w2+p2+w3+p3+w4,c1+c2,c1+c2+c3

rect,-w1,p1+w2+p2+w3+p3+w4,-c0,0

aplot

/pnum,area,1
/replot

ET,1,PLANE42
KEYOPT,1,1,0
KEYOPT,1,2,0
KEYOPT,1,3,2
KEYOPT,1,5,0
KEYOPT,1,6,0
!*


*ask,nw1,'# elem. left solid widthwise',10
*ask,nw2,'# elem. pillar 1 widthwise',6
*ask,nw3,'# elem. pillar 2 widthwise',6
*ask,nw4,'# elem. right solid widthwise',10

*ask,np1,'# elem. entry 1 widthwise',6
*ask,np2,'# elem. entry 2(even) widthwise',6


*ask,np3,'# elem. entry 3 widthwise',6

*ask,nc1,'# elem. coal heightwise',4
*ask,nc2,'# elem. imm. roof heightwise',10
*ask,nc3,'# elem. main roof heightwise',6
*ask,nc0,'# elem. floor heightwise',6

n,1,-w1,-c0
n,nw1+1,0,-c0
fill,1,nw1+1,

ngen,nc0+1,nw1+1,1,nw1+1,,,c0/nc0

ngen,nc1+1,nw1+1,(nw1+1)*nc0+1, (nw1+1)*nc0+nw1+1,,,c1/nc1

ngen,nc2+1,nw1+1,(nw1+1)*nc0+(nw1+1)*nc1+1,(nw1+1)*nc0+(nw1+1)*nc
1+nw1+1,,,c2/nc2
ngen,nc3+1,nw1+1,(nw1+1)*nc0+(nw1+1)*nc1+(nw1+1)*nc2+1,(nw1+1)*nc
0+(nw1+1)*nc1+(nw1+1)*nc2+nw1+1,,,c3/nc3
```

```
na1=(nw1+1)*(nc0+nc1+nc2+nc3+1)

n,na1+1,0,-c0
n,na1+np1+1,p1,-c0
fill,na1+1,na1+np1+1

ngen,nc0+1,np1+1,na1+1,na1+np1+1,,,c0/nc0

na2=na1+(np1+1)*(nc0+1)

n,na2+1,0,c1
n,na2+np1+1,p1,c1
fill,na2+1,na2+np1+1,

ngen,nc2+1,np1+1,na2+1,na2+np1+1,,,c2/nc2
ngen,nc3+1,np1+1,na2+1+(np1+1)*nc2,na2+(np1+1)*nc2+np1+1,,,c3/nc3


na3=na2+(np1+1)*(nc2+nc3+1)

n,na3+1,p1,-c0
n,na3+nw2+1,p1+w2,-c0
fill,na3+1,na3+nw2+1

ngen,nc0+1,nw2+1,na3+1,na3+nw2+1,,,c0/nc0
ngen,nc1+1,nw2+1,na3+(nw2+1)*nc0+1,na3+(nw2+1)*nc0+nw2+1,,,c1/nc1
ngen,nc2+1,nw2+1,na3+(nw2+1)*nc0+(nw2+1)*nc1+1,na3+(nw2+1)*nc0+(n
w2+1)*nc1+nw2+1,,,c2/nc2
ngen,nc3+1,nw2+1,na3+(nw2+1)*nc0+(nw2+1)*nc1+(nw2+1)*nc2+1,na3+(n
w2+1)*nc0+(nw2+1)*nc1+(nw2+1)*nc2+nw2+1,,,c3/nc3

na4=na3+(nw2+1)*(nc0+nc1+nc2+nc3+1)


n,na4+1,p1+w2,-c0
n,na4+np2+1,p1+w2+p2,-c0
fill,na4+1,na4+np2+1

ngen,nc0+1,np2+1,na4+1,na4+np2+1,,,c0/nc0

na5=na4+(np2+1)*(nc0+1)

n,na5+1,p1+w2,c1
n,na5+np2+1,p1+w2+p2,c1
fill,na5+1,na5+np2+1,

ngen,nc2+1,np2+1,na5+1,na5+np2+1,,,c2/nc2
ngen,nc3+1,np2+1,na5+1+(np2+1)*nc2,na5+(np2+1)*nc2+np2+1,,,c3/nc3


na6=na5+(np2+1)*(nc2+nc3+1)


n,na6+1,p1+w2+p2,-c0                    ! for 2nd pillar all way
```

```
from bottom to top
n,na6+nw3+1,p1+w2+p2+w3,-c0
fill,na6+1,na6+nw3+1

ngen,nc0+1,nw3+1,na6+1,na6+nw3+1,,,c0/nc0
ngen,nc1+1,nw3+1,na6+(nw3+1)*nc0+1,na6+(nw3+1)*nc0+nw3+1,,,c1/nc1
ngen,nc2+1,nw3+1,na6+(nw3+1)*nc0+(nw3+1)*nc1+1,na6+(nw3+1)*nc0+(n
w3+1)*nc1+nw3+1,,,c2/nc2
ngen,nc3+1,nw3+1,na6+(nw3+1)*nc0+(nw3+1)*nc1+(nw3+1)*nc2+1,na6+(n
w3+1)*nc0+(nw3+1)*nc1+(nw3+1)*nc2+nw3+1,,,c3/nc3


na7=na6+(nw3+1)*(nc0+nc1+nc2+nc3+1)


n,na7+1,p1+w2+p2+w3,-c0                          ! for middle entry of
the three entry system in cut-thru area
n,na7+np3+1,p1+w2+p2+w3+p3,-c0
fill,na7+1,na7+np3+1

ngen,nc0+1,np3+1,na7+1,na7+np3+1,,,c0/nc0

na8=na7+(np3+1)*(nc0+1)

n,na8+1,p1+w2+p2+w3,c1
n,na8+np3+1,p1+w2+p2+w3+p3,c1
fill,na8+1,na8+np3+1

ngen,nc2+1,np3+1,na8+1,na8+np3+1,,,c2/nc2
ngen,nc3+1,np3+1,na8+1+(np3+1)*nc2,na8+(np3+1)*nc2+np3+1,,,c3/nc3

na9=na8+(np3+1)*(nc2+nc3+1)


n,na9+1,p1+w2+p2+w3+p3,-c0                       ! for 3nd pillar all
way from bottom to top
n,na9+nw4+1,p1+w2+p2+w3+p3+w4,-c0
fill,na9+1,na9+nw4+1

ngen,nc0+1,nw4+1,na9+1,na9+nw4+1,,,c0/nc0
ngen,nc1+1,nw4+1,na9+(nw4+1)*nc0+1,na9+(nw4+1)*nc0+nw4+1,,,c1/nc1
ngen,nc2+1,nw4+1,na9+(nw4+1)*nc0+(nw4+1)*nc1+1,na9+(nw4+1)*nc0+(n
w4+1)*nc1+nw4+1,,,c2/nc2
ngen,nc3+1,nw4+1,na9+(nw4+1)*nc0+(nw4+1)*nc1+(nw4+1)*nc2+1,na9+(n
w4+1)*nc0+(nw4+1)*nc1+(nw4+1)*nc2+nw4+1,,,c3/nc3


mat,4
e,1,2,(nw1+1)+2,(nw1+1)+1        ! generate element on the gob side
egen,nw1,1,-1
egen,(nc0+nc1+nc2+nc3),(nw1+1),-nw1
```

```
e,na1+1,na1+2, na1+(np1+1)+2,na1+ (np1+1)+1  ! generate element for
floor in the face
egen,np1,1,-1
egen,nc0,np1+1,-np1

e,na2+1,na2+2, na2+(np1+1)+2,na2+ (np1+1)+1  ! generate element for
roof in the face
egen,np1,1,-1
egen,nc2+nc3,np1+1,-np1

e,na3+1,na3+2,na3+(nw2+1)+2,na3+(nw2+1)+1    ! generate element for
the 1st pillar from bottom to up
egen,nw2,1,-1
egen,(nc0+nc1+nc2+nc3),(nw2+1),-nw2

e,na4+1,na4+2, na4+(np2+1)+2,na4+ (np2+1)+1  ! generate element for
floor of 1st entry on the face side
egen,np2,1,-1
egen,nc0,np2+1,-np2

e,na5+1,na5+2, na5+(np2+1)+2,na5+ (np2+1)+1  ! generate element for
roof in 1st entry
egen,np2,1,-1
egen,nc2+nc3,np2+1,-np2

e,na6+1,na6+2,na6+(nw3+1)+2,na6+(nw3+1)+1    ! generate element for
the 2st pillar from bottom to up
egen,nw3,1,-1
egen,(nc0+nc1+nc2+nc3),(nw3+1),-nw3

e,na7+1,na7+2, na7+(np3+1)+2,na7+ (np3+1)+1  ! generate element for
floor of middle entry
egen,np3,1,-1
egen,nc0,np3+1,-np3

e,na8+1,na8+2, na8+(np3+1)+2,na8+ (np3+1)+1  ! generate element for
roof in middle entry
egen,np3,1,-1
egen,nc2+nc3,np3+1,-np3


e,na9+1,na9+2,na9+(nw4+1)+2,na9+(nw4+1)+1    ! generate element for
the 3rd pillar from bottom to up
egen,nw4,1,-1
egen,(nc0+nc1+nc2+nc3),(nw4+1),-nw4

esel,s, elem,,nc0*nw1+1,nc0*nw1+nc1*nw1
emodif,all,mat,1
esel,all

esel,s, elem,,(nc0*nw1)+(nc1*nw1)+1,(nc0*nw1)+(nc1*nw1)+(nc2*nw1)
emodif,all,mat,2
esel,all
```

```
e          s          e          l          ,          s          ,
elem,,(nc0*nw1)+(nc1*nw1)+(nc2*nw1)+1,(nc0*nw1)+(nc1*nw1)+(nc2*nw
1)+(nc3*nw1)
emodif,all,mat,3
esel,all

q1=nw1*(nc0+nc1+nc2+nc3)

esel,s,elem,,q1+(nc0*np1)+1,q1+(nc0*np1)+(nc2*np1)     ! for Imm.
roof in face
emodif,all,mat,2
esel,all

q2=np1*(nc0+nc2+nc3)

esel,s,elem,,q1+(nc0*np1)+(nc2*np1)+1,q1+q2
emodif,all,mat,3
esel,all

esel,s,elem,,q1+q2+nw2*nc0+1,q1+q2+nw2*(nc0+nc1)   !1st coal pillar
emodif,all,mat,1
esel,all

esel,s,elem,,q1+q2+nw2*(nc0+nc1)+1,q1+q2+nw2*(nc0+nc1+nc2)   !roof
above 1st pillar
emodif,all,mat,2
esel,all


esel,s,elem,,q1+q2+nw2*(nc0+nc1+nc2)+1,q1+q2+nw2*(nc0+nc1+nc2+nc3
)     !main roof above 1st pillar
emodif,all,mat,3
esel,all


q3=nw2*(nc0+nc1+nc2+nc3)

esel,s,elem,,q1+q2+q3+np2*nc0+1,q1+q2+q3+np2*(nc0+nc2)       !imm.
roof above 1st entry
emodif,all,mat,2
esel,all

esel,s,elem,,q1+q2+q3+np2*(nc0+nc2)+1,q1+q2+q3+np2*(nc0+nc2+nc3)
     !main roof above 1st entry
emodif,all,mat,3
esel,all

q4=np2*(nc0+nc2+nc3)

esel,s,elem,,q1+q2+q3+q4+nw3*nc0+1,q1+q2+q3+q4+nw3*(nc0+nc1)
     !2nd coal pillar
emodif,all,mat,1
esel,all
```

```
esel,s,elem,,q1+q2+q3+q4+nw3*(nc0+nc1)+1,q1+q2+q3+q4+nw3*(nc0+nc1
+nc2)     !roof above 2nd pillar
emodif,all,mat,2
esel,all


esel,s,elem,,q1+q2+q3+q4+nw3*(nc0+nc1+nc2)+1,q1+q2+q3+q4+nw3*(nc0
+nc1+nc2+nc3)  !main roof above 2nd pillar
emodif,all,mat,3
esel,all


q5=q1+q2+q3+q4+nw3*(nc0+nc1+nc2+nc3)

esel,s,elem,,q5+np3*nc0+1,q5+np3*(nc0+nc2)    ! imm. roof above 2nd
entry
emodif,all,mat,2
esel,all


esel,s,elem,,q5+np3*(nc0+nc2)+1,q5+np3*(nc0+nc2+nc3)    ! main roof
above 2nd entry
emodif,all,mat,3
esel,all


q6=q5+np3*(nc0+nc2+nc3)

esel,s,elem,,q6+nw4*nc0+1,q6+nw4*(nc0+nc1)    !3nd coal pillar
emodif,all,mat,1
esel,all

esel,s,elem,,q6+nw4*(nc0+nc1)+1,q6+nw4*(nc0+nc1+nc2)    ! imm. roof
above 3nd pillar
emodif,all,mat,2
esel,all

esel,s,elem,,q6+nw4*(nc0+nc1+nc2)+1,q6+nw4*(nc0+nc1+nc2+nc3)
!main roof above 3nd pillar
emodif,all,mat,3
esel,all



NUMMRG,NODE, ,

eplot


nsel,s,loc,x,-w1
sf,all, pres,sigmah

nsel,s,loc,x,(p1+w2+p2+w3+p3+w4)
```

```
sf,all, pres,sigmah

nsel,s,loc,y,-c0
d,all,uy,0

nsel,s,loc,y,-c0
nsel,r,loc,x,p1+w2+p2/2

d,all,ux,0

nsel,s,loc,y,c1+c2+c3
sf,all,pres,1.1*burden

nsel,all

/PNUM,MAT,1

/PSF,PRES,NORM,2
/PBF,DEFA, ,1
/PSYMB,CS,0
/PSYMB,NDIR,0
/PSYMB,ESYS,0
/PSYMB,LDIR,0
/PSYMB,LAYR,0
!*
/PBC,ALL,,1
/PBC,NFOR,,0
/PBC,NMOM,,0
/PBC,RFOR,,0
/PBC,RMOM,,0
/REPLOT
!*

/SOLU
FINISH
/SOLU
/STAT,SOLU
SOLVE
/dscale,1,1
/PLOPTS,INFO,ON
/POST1
FINISH
/POST1
PLNSOL,S,X
PLNSOL,S,Y
PLNSOL,S,XY
/PNUM,KP,0
/PNUM,LINE,0
/PNUM,AREA,1
/PNUM,VOLU,0
/PNUM,NODE,0
```

```
/PNUM,SVAL,0
/NUM,0
!*
/PNUM,MAT,0
!
!*
PLVECT,S
```

```
! Model for 2-Dimensional, four entry system
/prep7
/title
/nopr
antype,static


/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,burden,'overburden thickness',750
*ask,sigmah,'in-situ horizontal stress',1500

*ask,c1,'coal height',6*12
*ask,y1,'coal Youngs modulus',2e5
uimp,1,ex,ey,ez,y1,y1,y1

*ask,c2,'imm. roof thickness',30*12
*ask,y2,'imm. roof v Youngs modulus',5.6e5
*ask,z2,'imm. roof h Youngs modulus',2.82e6

uimp,2,ex,ey,ez,z2,y2,z2


*ask,c3,'main roof thickness',30*12
*ask,y3,'main roof v Youngs modulus',5.6e5
*ask,z3,'main roof h Youngs modulus',2.82e6
uimp,3,ex,ey,ez,z3,y3,z3

*ask,c0,'floor thickness',40*12
*ask,y0,'floor v Youngs modulus',5e5
*ask,z0,'floor h Youngs modulus',2e6
uimp,4,ex,ey,ez,z0,y0,z0

*ask,w1,'left solid width',100*12
*ask,p1,'entry 1 width', 18*12
*ask,p2,'entry2 width', 18*12
*ask,w2,'pillar 1 width',60*12
*ask,w3,'pillar 2 width', 60*12
*ask,p3,'entry 3 width',18*12
*ask,w4,'pillar 3 width', 60*12
*ask,p4,'entry 4 width',18*12
*ask,w5,'right solid width',100*12

rect,-w1,0,0,c1
```

```
rect,p1,p1+w2,0,c1

rect,p1+w2+p2,p1+w2+p2+w3,0,c1

rect,p1+w2+p2+w3+p3,p1+w2+p2+w3+p3+w4,0,c1

rect,p1+w2+p2+w3+p3+w4+p4,p1+w2+p2+w3+p3+w4+p4+w5,0,c1

rect,-w1,p1+w2+p2+w3+p3+w4+p4+w5,c1,c1+c2

rect, -w1,p1+w2+p2+w3+p3+w4+p4+w5,c1+c2,c1+c2+c3

rect,-w1,p1+w2+p2+w3+p3+w4+p4+w5,-c0,0

aplot

/pnum,area,1
/replot

ET,1,PLANE42
KEYOPT,1,1,0
KEYOPT,1,2,0
KEYOPT,1,3,2
KEYOPT,1,5,0
KEYOPT,1,6,0
!*


*ask,nw1,'# elem. left solid widthwise',10
*ask,nw2,'# elem. pillar 1 widthwise',6
*ask,nw3,'# elem. pillar 2 widthwise(even)',6
*ask,nw4,'# elem. pillar 3 widthwise',6
*ask,nw5,'# elem. right solid widthwise',10

*ask,np1,'# elem. entry 1 widthwise',6
*ask,np2,'# elem. entry 2 widthwise',6
*ask,np3,'# elem. entry 3 widthwise',6
*ask,np4,'# elem. entry 4 widthwise',6

*ask,nc1,'# elem. coal heightwise',4
*ask,nc2,'# elem. imm. roof heightwise',10
*ask,nc3,'# elem. main roof heightwise',6
*ask,nc0,'# elem. floor heightwise',6

n,1,-w1,-c0
n,nw1+1,0,-c0
fill,1,nw1+1,

ngen,nc0+1,nw1+1,1,nw1+1,,,c0/nc0

ngen,nc1+1,nw1+1,(nw1+1)*nc0+1, (nw1+1)*nc0+nw1+1,,,c1/nc1

ngen,nc2+1,nw1+1,(nw1+1)*nc0+(nw1+1)*nc1+1,(nw1+1)*nc0+(nw1+1)*nc
1+nw1+1,,,c2/nc2
```

```
ngen,nc3+1,nw1+1,(nw1+1)*nc0+(nw1+1)*nc1+(nw1+1)*nc2+1,(nw1+1)*nc
0+(nw1+1)*nc1+(nw1+1)*nc2+nw1+1,,,c3/nc3

na1=(nw1+1)*(nc0+nc1+nc2+nc3+1)

n,na1+1,0,-c0
n,na1+np1+1,p1,-c0
fill,na1+1,na1+np1+1

ngen,nc0+1,np1+1,na1+1,na1+np1+1,,,c0/nc0

na2=na1+(np1+1)*(nc0+1)

n,na2+1,0,c1
n,na2+np1+1,p1,c1
fill,na2+1,na2+np1+1,

ngen,nc2+1,np1+1,na2+1,na2+np1+1,,,c2/nc2
ngen,nc3+1,np1+1,na2+1+(np1+1)*nc2,na2+(np1+1)*nc2+np1+1,,,c3/nc3


na3=na2+(np1+1)*(nc2+nc3+1)

n,na3+1,p1,-c0
n,na3+nw2+1,p1+w2,-c0
fill,na3+1,na3+nw2+1

ngen,nc0+1,nw2+1,na3+1,na3+nw2+1,,,c0/nc0
ngen,nc1+1,nw2+1,na3+(nw2+1)*nc0+1,na3+(nw2+1)*nc0+nw2+1,,,c1/nc1
ngen,nc2+1,nw2+1,na3+(nw2+1)*nc0+(nw2+1)*nc1+1,na3+(nw2+1)*nc0+(n
w2+1)*nc1+nw2+1,,,c2/nc2
ngen,nc3+1,nw2+1,na3+(nw2+1)*nc0+(nw2+1)*nc1+(nw2+1)*nc2+1,na3+(n
w2+1)*nc0+(nw2+1)*nc1+(nw2+1)*nc2+nw2+1,,,c3/nc3

na4=na3+(nw2+1)*(nc0+nc1+nc2+nc3+1)


n,na4+1,p1+w2,-c0
n,na4+np2+1,p1+w2+p2,-c0
fill,na4+1,na4+np2+1

ngen,nc0+1,np2+1,na4+1,na4+np2+1,,,c0/nc0

na5=na4+(np2+1)*(nc0+1)

n,na5+1,p1+w2,c1
n,na5+np2+1,p1+w2+p2,c1
fill,na5+1,na5+np2+1,

ngen,nc2+1,np2+1,na5+1,na5+np2+1,,,c2/nc2
ngen,nc3+1,np2+1,na5+1+(np2+1)*nc2,na5+(np2+1)*nc2+np2+1,,,c3/nc3


na6=na5+(np2+1)*(nc2+nc3+1)
```

```
n,na6+1,p1+w2+p2,-c0                    ! for 2nd pillar all way
from bottom to top
n,na6+nw3+1,p1+w2+p2+w3,-c0
fill,na6+1,na6+nw3+1

ngen,nc0+1,nw3+1,na6+1,na6+nw3+1,,,c0/nc0
ngen,nc1+1,nw3+1,na6+(nw3+1)*nc0+1,na6+(nw3+1)*nc0+nw3+1,,,c1/nc1
ngen,nc2+1,nw3+1,na6+(nw3+1)*nc0+(nw3+1)*nc1+1,na6+(nw3+1)*nc0+(n
w3+1)*nc1+nw3+1,,,c2/nc2
ngen,nc3+1,nw3+1,na6+(nw3+1)*nc0+(nw3+1)*nc1+(nw3+1)*nc2+1,na6+(n
w3+1)*nc0+(nw3+1)*nc1+(nw3+1)*nc2+nw3+1,,,c3/nc3


na7=na6+(nw3+1)*(nc0+nc1+nc2+nc3+1)


n,na7+1,p1+w2+p2+w3,-c0                         ! for middle entry of
the three entry system in cut-thru area
n,na7+np3+1,p1+w2+p2+w3+p3,-c0
fill,na7+1,na7+np3+1

ngen,nc0+1,np3+1,na7+1,na7+np3+1,,,c0/nc0

na8=na7+(np3+1)*(nc0+1)

n,na8+1,p1+w2+p2+w3,c1
n,na8+np3+1,p1+w2+p2+w3+p3,c1
fill,na8+1,na8+np3+1

ngen,nc2+1,np3+1,na8+1,na8+np3+1,,,c2/nc2
ngen,nc3+1,np3+1,na8+1+(np3+1)*nc2,na8+(np3+1)*nc2+np3+1,,,c3/nc3

na9=na8+(np3+1)*(nc2+nc3+1)


n,na9+1,p1+w2+p2+w3+p3,-c0                      ! for 3nd pillar all
way from bottom to top
n,na9+nw4+1,p1+w2+p2+w3+p3+w4,-c0
fill,na9+1,na9+nw4+1

ngen,nc0+1,nw4+1,na9+1,na9+nw4+1,,,c0/nc0
ngen,nc1+1,nw4+1,na9+(nw4+1)*nc0+1,na9+(nw4+1)*nc0+nw4+1,,,c1/nc1
ngen,nc2+1,nw4+1,na9+(nw4+1)*nc0+(nw4+1)*nc1+1,na9+(nw4+1)*nc0+(n
w4+1)*nc1+nw4+1,,,c2/nc2
ngen,nc3+1,nw4+1,na9+(nw4+1)*nc0+(nw4+1)*nc1+(nw4+1)*nc2+1,na9+(n
w4+1)*nc0+(nw4+1)*nc1+(nw4+1)*nc2+nw4+1,,,c3/nc3


na10=na9+(nw4+1)*(nc0+nc1+nc2+nc3+1)

n,na10+1,p1+w2+p2+w3+p3+w4,-c0              ! for the entry next to the
solid caol in the three entry system in cut-thru area
```

```
n,na10+np4+1,p1+w2+p2+w3+p3+w4+p4,-c0
fill,na10+1,na10+np4+1

ngen,nc0+1,np4+1,na10+1,na10+np4+1,,,c0/nc0

na11=na10+(np4+1)*(nc0+1)

n,na11+1,p1+w2+p2+w3+p3+w4,c1
n,na11+np4+1,p1+w2+p2+w3+p3+w4+p4,c1
fill,na11+1,na11+np4+1,

ngen,nc2+1,np4+1,na11+1,na11+np4+1,,,c2/nc2
ngen,nc3+1,np4+1,na11+1+(np4+1)*nc2,na11+(np4+1)*nc2+np4+1,,,c3/nc3


na12=na11+(np4+1)*(nc2+nc3+1)

n,na12+1,p1+w2+p2+w3+p3+w4+p4,-c0                    ! for solid coal
all way from bottom to top
n,na12+nw5+1,p1+w2+p2+w3+p3+w4+p4+w5,-c0
fill,na12+1,na12+nw5+1

ngen,nc0+1,nw5+1,na12+1,na12+nw5+1,,,c0/nc0
n g e n , n c 1 + 1 , n w 5 + 1 , n a 1 2 + ( n w 5 + 1 ) * n c 0 + 1 ,
na12+(nw5+1)*nc0+nw5+1,,,c1/nc1
ngen,nc2+1,nw5+1,na12+(nw5+1)*nc0+(nw5+1)*nc1+1,na12+(nw5+1)*nc0+
(nw5+1)*nc1+nw5+1,,,c2/nc2
ngen,nc3+1,nw5+1,na12+(nw5+1)*nc0+(nw5+1)*nc1+(nw5+1)*nc2+1,na12+
(nw5+1)*nc0+(nw5+1)*nc1+(nw5+1)*nc2+nw5+1,,,c3/nc3



mat,4
e,1,2,(nw1+1)+2,(nw1+1)+1      ! generate element on the gob side
egen,nw1,1,-1
egen,(nc0+nc1+nc2+nc3),(nw1+1),-nw1



e,na1+1,na1+2, na1+(np1+1)+2,na1+ (np1+1)+1   ! generate element for
floor in the face
egen,np1,1,-1
egen,nc0,np1+1,-np1



e,na2+1,na2+2, na2+(np1+1)+2,na2+ (np1+1)+1   ! generate element for
roof in the face
egen,np1,1,-1
egen,nc2+nc3,np1+1,-np1


e,na3+1,na3+2,na3+(nw2+1)+2,na3+(nw2+1)+1     ! generate element for
the 1st pillar from bottom to up
```

```
egen,nw2,1,-1
egen,(nc0+nc1+nc2+nc3),(nw2+1),-nw2

e,na4+1,na4+2, na4+(np2+1)+2,na4+ (np2+1)+1  ! generate element for
floor of 1st entry on the face side
egen,np2,1,-1
egen,nc0,np2+1,-np2

e,na5+1,na5+2, na5+(np2+1)+2,na5+ (np2+1)+1  ! generate element for
roof in 1st entry
egen,np2,1,-1
egen,nc2+nc3,np2+1,-np2

e,na6+1,na6+2,na6+(nw3+1)+2,na6+(nw3+1)+1    ! generate element for
the 2st pillar from bottom to up
egen,nw3,1,-1
egen,(nc0+nc1+nc2+nc3),(nw3+1),-nw3

e,na7+1,na7+2, na7+(np3+1)+2,na7+ (np3+1)+1  ! generate element for
floor of middle entry
egen,np3,1,-1
egen,nc0,np3+1,-np3

e,na8+1,na8+2, na8+(np3+1)+2,na8+ (np3+1)+1  ! generate element for
roof in middle entry
egen,np3,1,-1
egen,nc2+nc3,np3+1,-np3

e,na9+1,na9+2,na9+(nw4+1)+2,na9+(nw4+1)+1    ! generate element for
the 3rd pillar from bottom to up
egen,nw4,1,-1
egen,(nc0+nc1+nc2+nc3),(nw4+1),-nw4

e,na10+1,na10+2, na10+(np4+1)+2,na10+ (np4+1)+1   !   generate
element for floor of last entry
egen,np4,1,-1
egen,nc0,np4+1,-np4

e,na11+1,na11+2, na11+(np4+1)+2,na11+ (np4+1)+1   !   generate
element for roof in last entry
egen,np4,1,-1
egen,nc2+nc3,np4+1,-np4

e,na12+1,na12+2,na12+(nw5+1)+2,na12+(nw5+1)+1     !   generate
```

```
element for the solid coal from bottom to up
egen,nw5,1,-1
egen,(nc0+nc1+nc2+nc3),(nw5+1),-nw5


esel,s, elem,,nc0*nw1+1,nc0*nw1+nc1*nw1
emodif,all,mat,1
esel,all


esel,s, elem,,(nc0*nw1)+(nc1*nw1)+1,(nc0*nw1)+(nc1*nw1)+(nc2*nw1)
emodif,all,mat,2
esel,all


e          s          e          l          ,          s          ,
elem,,(nc0*nw1)+(nc1*nw1)+(nc2*nw1)+1,(nc0*nw1)+(nc1*nw1)+(nc2*nw
1)+(nc3*nw1)
emodif,all,mat,3
esel,all

q1=nw1*(nc0+nc1+nc2+nc3)

esel,s,elem,,q1+(nc0*np1)+1,q1+(nc0*np1)+(nc2*np1)     ! for Imm.
roof in face
emodif,all,mat,2
esel,all


q2=np1*(nc0+nc2+nc3)

esel,s,elem,,q1+(nc0*np1)+(nc2*np1)+1,q1+q2
emodif,all,mat,3
esel,all

esel,s,elem,,q1+q2+nw2*nc0+1,q1+q2+nw2*(nc0+nc1)   !1st coal pillar
emodif,all,mat,1
esel,all


esel,s,elem,,q1+q2+nw2*(nc0+nc1)+1,q1+q2+nw2*(nc0+nc1+nc2)   !roof
above 1st pillar
emodif,all,mat,2
esel,all


esel,s,elem,,q1+q2+nw2*(nc0+nc1+nc2)+1,q1+q2+nw2*(nc0+nc1+nc2+nc3
)     !main roof above 1st pillar
emodif,all,mat,3
esel,all


q3=nw2*(nc0+nc1+nc2+nc3)
```

```
esel,s,elem,,q1+q2+q3+np2*nc0+1,q1+q2+q3+np2*(nc0+nc2)        !imm.
roof above 1st entry
emodif,all,mat,2
esel,all

esel,s,elem,,q1+q2+q3+np2*(nc0+nc2)+1,q1+q2+q3+np2*(nc0+nc2+nc3)
     !main roof above 1st entry
emodif,all,mat,3
esel,all


q4=np2*(nc0+nc2+nc3)

esel,s,elem,,q1+q2+q3+q4+nw3*nc0+1,q1+q2+q3+q4+nw3*(nc0+nc1)
     !2nd coal pillar
emodif,all,mat,1
esel,all

esel,s,elem,,q1+q2+q3+q4+nw3*(nc0+nc1)+1,q1+q2+q3+q4+nw3*(nc0+nc1
+nc2)      !roof above 2nd pillar
emodif,all,mat,2
esel,all


esel,s,elem,,q1+q2+q3+q4+nw3*(nc0+nc1+nc2)+1,q1+q2+q3+q4+nw3*(nc0
+nc1+nc2+nc3)  !main roof above 2nd pillar
emodif,all,mat,3
esel,all


q5=q1+q2+q3+q4+nw3*(nc0+nc1+nc2+nc3)

esel,s,elem,,q5+np3*nc0+1,q5+np3*(nc0+nc2)    ! imm. roof above 2nd
entry
emodif,all,mat,2
esel,all


esel,s,elem,,q5+np3*(nc0+nc2)+1,q5+np3*(nc0+nc2+nc3)    ! main roof
above 2nd entry
emodif,all,mat,3
esel,all


q6=q5+np3*(nc0+nc2+nc3)

esel,s,elem,,q6+nw4*nc0+1,q6+nw4*(nc0+nc1)    !3nd coal pillar
emodif,all,mat,1
esel,all

esel,s,elem,,q6+nw4*(nc0+nc1)+1,q6+nw4*(nc0+nc1+nc2)    ! imm. roof
above 3nd pillar
emodif,all,mat,2
esel,all
```

```
esel,s,elem,,q6+nw4*(nc0+nc1+nc2)+1,q6+nw4*(nc0+nc1+nc2+nc3)
!main roof above 3nd pillar
emodif,all,mat,3
esel,all


q7=q6+nw4*(nc0+nc1+nc2+nc3)

esel,s,elem,,q7+np4*nc0+1,q7+np4*(nc0+nc2)    ! imm. roof above 3rd
entry
emodif,all,mat,2
esel,all


esel,s,elem,,q7+np4*(nc0+nc2)+1,q7+np4*(nc0+nc2+nc3)    ! main roof
above 3rd entry
emodif,all,mat,3
esel,all


q8=q7+np4*(nc0+nc2+nc3)

esel,s,elem,,q8+nw5*nc0+1,q8+nw5*(nc0+nc1)    !solid coal
emodif,all,mat,1
esel,all

esel,s,elem,,q8+nw5*(nc0+nc1)+1,q8+nw5*(nc0+nc1+nc2)    ! imm. roof
above solid pillar
emodif,all,mat,2
esel,all

esel,s,elem,,q8+nw5*(nc0+nc1+nc2)+1,q8+nw5*(nc0+nc1+nc2+nc3)
!main roof above solid pillar
emodif,all,mat,3
esel,all


NUMMRG,NODE, ,

eplot


nsel,s,loc,x,-w1
sf,all, pres,sigmah

nsel,s,loc,x,(p1+w2+p2+w3+p3+w4+p4+w5)
sf,all, pres,sigmah


nsel,s,loc,y,-c0
d,all,uy,0

nsel,s,loc,y,-c0
```

```
nsel,r,loc,x,p1+w2+p2+w3/2
d,all,ux,0

nsel,s,loc,y,c1+c2+c3
sf,all,pres,1.1*burden

nsel,all

/PNUM,MAT,1

/PSF,PRES,NORM,2
/PBF,DEFA, ,1
/PSYMB,CS,0
/PSYMB,NDIR,0
/PSYMB,ESYS,0
/PSYMB,LDIR,0
/PSYMB,LAYR,0
!*
/PBC,ALL,,1
/PBC,NFOR,,0
/PBC,NMOM,,0
/PBC,RFOR,,0
/PBC,RMOM,,0
/REPLOT
!*

/SOLU
FINISH
/SOLU
/STAT,SOLU
SOLVE
/dscale,1,1
/PLOPTS,INFO,ON
/POST1
FINISH
/POST1
PLNSOL,S,X
PLNSOL,S,Y
PLNSOL,S,XY
/PNUM,KP,0
/PNUM,LINE,0
/PNUM,AREA,1
/PNUM,VOLU,0
/PNUM,NODE,0
/PNUM,SVAL,0
/NUM,0
!*
/PNUM,MAT,0
!
!*
PLVECT,S
```

SIX.TXT

```
!Model for 2-D, six entry system
/prep7
/title
/nopr
antype,static


/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,burden,'overburden thickness',750
*ask,sigmah,'in-situ horizontal stress',1500

*ask,c1,'coal height',6*12
*ask,y1,'coal Youngs modulus',2e5
uimp,1,ex,ey,ez,y1,y1,y1

*ask,c2,'imm. roof thickness',30*12
*ask,y2,'imm. roof v Youngs modulus',5.6e5
*ask,z2,'imm. roof h Youngs modulus',2.82e6

uimp,2,ex,ey,ez,z2,y2,z2


*ask,c3,'main roof thickness',30*12
*ask,y3,'main roof v Youngs modulus',5.6e5
*ask,z3,'main roof h Youngs modulus',2.82e6
uimp,3,ex,ey,ez,z3,y3,z3

*ask,c0,'floor thickness',40*12
*ask,y0,'floor v Youngs modulus',5e5
*ask,z0,'floor h Youngs modulus',2e6
uimp,4,ex,ey,ez,z0,y0,z0

*ask,w1,'left pillar half width',30*12
*ask,p1,'entry 1 width', 18*12
*ask,p2,'entry2 width', 18*12
*ask,w2,'pillar 1 width',60*12
*ask,w3,'pillar 2 width', 60*12
*ask,p3,'entry 3 width',18*12
*ask,w4,'solid coal width', 100*12

rect,-w1,0,0,c1

rect,p1,p1+w2,0,c1

rect,p1+w2+p2,p1+w2+p2+w3,0,c1

rect,p1+w2+p2+w3+p3,p1+w2+p2+w3+p3+w4,0,c1

rect,-w1,p1+w2+p2+w3+p3+w4,c1,c1+c2

rect, -w1,p1+w2+p2+w3+p3+w4,c1+c2,c1+c2+c3
```

SIX.TXT

```
rect,-w1,p1+w2+p2+w3+p3+w4,-c0,0

aplot

/pnum,area,1
/replot

ET,1,PLANE42
KEYOPT,1,1,0
KEYOPT,1,2,0
KEYOPT,1,3,2
KEYOPT,1,5,0
KEYOPT,1,6,0
!*


*ask,nw1,'# elem. left half pillar widthwise',3
*ask,nw2,'# elem. pillar 1 widthwise',6
*ask,nw3,'# elem. pillar 2 widthwise',6
*ask,nw4,'# elem. right solid widthwise',10

*ask,np1,'# elem. entry 1 widthwise',6
*ask,np2,'# elem. entry 2 widthwise',6


*ask,np3,'# elem. entry 3 widthwise',6

*ask,nc1,'# elem. coal heightwise',4
*ask,nc2,'# elem. imm. roof heightwise',10
*ask,nc3,'# elem. main roof heightwise',6
*ask,nc0,'# elem. floor heightwise',6

n,1,-w1,-c0
n,nw1+1,0,-c0
fill,1,nw1+1,

ngen,nc0+1,nw1+1,1,nw1+1,,,c0/nc0

ngen,nc1+1,nw1+1,(nw1+1)*nc0+1, (nw1+1)*nc0+nw1+1,,,c1/nc1

ngen,nc2+1,nw1+1,(nw1+1)*nc0+(nw1+1)*nc1+1,(nw1+1)*nc0+(nw1+1)*nc1+nw1+1,,,c2
/nc2
ngen,nc3+1,nw1+1,(nw1+1)*nc0+(nw1+1)*nc1+(nw1+1)*nc2+1,(nw1+1)*nc0+(nw1+1)*nc
1+(nw1+1)*nc2+nw1+1,,,c3/nc3

na1=(nw1+1)*(nc0+nc1+nc2+nc3+1)

n,na1+1,0,-c0
n,na1+np1+1,p1,-c0
fill,na1+1,na1+np1+1

ngen,nc0+1,np1+1,na1+1,na1+np1+1,,,c0/nc0

na2=na1+(np1+1)*(nc0+1)

n,na2+1,0,c1
n,na2+np1+1,p1,c1
fill,na2+1,na2+np1+1,

ngen,nc2+1,np1+1,na2+1,na2+np1+1,,,c2/nc2
```

SIX.TXT

```
ngen,nc3+1,np1+1,na2+1+(np1+1)*nc2,na2+(np1+1)*nc2+np1+1,,,c3/nc3


na3=na2+(np1+1)*(nc2+nc3+1)

n,na3+1,p1,-c0
n,na3+nw2+1,p1+w2,-c0
fill,na3+1,na3+nw2+1

ngen,nc0+1,nw2+1,na3+1,na3+nw2+1,,,c0/nc0
ngen,nc1+1,nw2+1,na3+(nw2+1)*nc0+1, na3+(nw2+1)*nc0+nw2+1,,,c1/nc1
ngen,nc2+1,nw2+1,na3+(nw2+1)*nc0+(nw2+1)*nc1+1,na3+(nw2+1)*nc0+(nw2+1)*nc1+nw
2+1,,,c2/nc2
ngen,nc3+1,nw2+1,na3+(nw2+1)*nc0+(nw2+1)*nc1+(nw2+1)*nc2+1,na3+(nw2+1)*nc0+(n
w2+1)*nc1+(nw2+1)*nc2+nw2+1,,,c3/nc3

na4=na3+(nw2+1)*(nc0+nc1+nc2+nc3+1)


n,na4+1,p1+w2,-c0
n,na4+np2+1,p1+w2+p2,-c0
fill,na4+1,na4+np2+1

ngen,nc0+1,np2+1,na4+1,na4+np2+1,,,c0/nc0

na5=na4+(np2+1)*(nc0+1)

n,na5+1,p1+w2,c1
n,na5+np2+1,p1+w2+p2,c1
fill,na5+1,na5+np2+1,

ngen,nc2+1,np2+1,na5+1,na5+np2+1,,,c2/nc2
ngen,nc3+1,np2+1,na5+1+(np2+1)*nc2,na5+(np2+1)*nc2+np2+1,,,c3/nc3


na6=na5+(np2+1)*(nc2+nc3+1)


n,na6+1,p1+w2+p2,-c0                          ! for 2nd pillar all way from
 bottom to top
n,na6+nw3+1,p1+w2+p2+w3,-c0
fill,na6+1,na6+nw3+1

ngen,nc0+1,nw3+1,na6+1,na6+nw3+1,,,c0/nc0
ngen,nc1+1,nw3+1,na6+(nw3+1)*nc0+1, na6+(nw3+1)*nc0+nw3+1,,,c1/nc1
ngen,nc2+1,nw3+1,na6+(nw3+1)*nc0+(nw3+1)*nc1+1,na6+(nw3+1)*nc0+(nw3+1)*nc1+nw
3+1,,,c2/nc2
ngen,nc3+1,nw3+1,na6+(nw3+1)*nc0+(nw3+1)*nc1+(nw3+1)*nc2+1,na6+(nw3+1)*nc0+(n
w3+1)*nc1+(nw3+1)*nc2+nw3+1,,,c3/nc3


na7=na6+(nw3+1)*(nc0+nc1+nc2+nc3+1)


n,na7+1,p1+w2+p2+w3,-c0                                ! for middle entry of
 the three entry system in cut-thru area
n,na7+np3+1,p1+w2+p2+w3+p3,-c0
fill,na7+1,na7+np3+1

ngen,nc0+1,np3+1,na7+1,na7+np3+1,,,c0/nc0

na8=na7+(np3+1)*(nc0+1)
```

SIX.TXT

```
n,na8+1,p1+w2+p2+w3,c1
n,na8+np3+1,p1+w2+p2+w3+p3,c1
fill,na8+1,na8+np3+1

ngen,nc2+1,np3+1,na8+1,na8+np3+1,,,c2/nc2
ngen,nc3+1,np3+1,na8+1+(np3+1)*nc2,na8+(np3+1)*nc2+np3+1,,,c3/nc3

na9=na8+(np3+1)*(nc2+nc3+1)


n,na9+1,p1+w2+p2+w3+p3,-c0                              ! for 3nd pillar all
way from bottom to top
n,na9+nw4+1,p1+w2+p2+w3+p3+w4,-c0
fill,na9+1,na9+nw4+1

ngen,nc0+1,nw4+1,na9+1,na9+nw4+1,,,c0/nc0
ngen,nc1+1,nw4+1,na9+(nw4+1)*nc0+1, na9+(nw4+1)*nc0+nw4+1,,,c1/nc1
ngen,nc2+1,nw4+1,na9+(nw4+1)*nc0+(nw4+1)*nc1+1,na9+(nw4+1)*nc0+(nw4+1)*nc1+nw
4+1,,,c2/nc2
ngen,nc3+1,nw4+1,na9+(nw4+1)*nc0+(nw4+1)*nc1+(nw4+1)*nc2+1,na9+(nw4+1)*nc0+(n
w4+1)*nc1+(nw4+1)*nc2+nw4+1,,,c3/nc3



mat,4
e,1,2,(nw1+1)+2,(nw1+1)+1        ! generate element on the gob side
egen,nw1,1,-1
egen,(nc0+nc1+nc2+nc3),(nw1+1),-nw1

e,na1+1,na1+2, na1+(np1+1)+2,na1+ (np1+1)+1      ! generate element for floor
in the face
egen,np1,1,-1
egen,nc0,np1+1,-np1

e,na2+1,na2+2, na2+(np1+1)+2,na2+ (np1+1)+1      ! generate element for roof i
n the face
egen,np1,1,-1
egen,nc2+nc3,np1+1,-np1

e,na3+1,na3+2,na3+(nw2+1)+2,na3+(nw2+1)+1        ! generate element for the 1s
t pillar from bottom to up
egen,nw2,1,-1
egen,(nc0+nc1+nc2+nc3),(nw2+1),-nw2

e,na4+1,na4+2, na4+(np2+1)+2,na4+ (np2+1)+1      ! generate element for floor
of 1st entry on the face side
egen,np2,1,-1
egen,nc0,np2+1,-np2

e,na5+1,na5+2, na5+(np2+1)+2,na5+ (np2+1)+1      ! generate element for roof i
n 1st entry
egen,np2,1,-1
egen,nc2+nc3,np2+1,-np2

e,na6+1,na6+2,na6+(nw3+1)+2,na6+(nw3+1)+1        ! generate element for the 2s
t pillar from bottom to up
egen,nw3,1,-1
egen,(nc0+nc1+nc2+nc3),(nw3+1),-nw3
```

SIX.TXT

```
e,na7+1,na7+2, na7+(np3+1)+2,na7+ (np3+1)+1      ! generate element for floor
of middle entry
egen,np3,1,-1
egen,nc0,np3+1,-np3

e,na8+1,na8+2, na8+(np3+1)+2,na8+ (np3+1)+1      ! generate element for roof i
n middle entry
egen,np3,1,-1
egen,nc2+nc3,np3+1,-np3


e,na9+1,na9+2,na9+(nw4+1)+2,na9+(nw4+1)+1        ! generate element for the 3r
d pillar from bottom to up
egen,nw4,1,-1
egen,(nc0+nc1+nc2+nc3),(nw4+1),-nw4

esel,s, elem,,nc0*nw1+1,nc0*nw1+nc1*nw1
emodif,all,mat,1
esel,all

esel,s, elem,,(nc0*nw1)+(nc1*nw1)+1,(nc0*nw1)+(nc1*nw1)+(nc2*nw1)
emodif,all,mat,2
esel,all

esel,s, elem,,(nc0*nw1)+(nc1*nw1)+(nc2*nw1)+1,(nc0*nw1)+(nc1*nw1)+(nc2*nw1)+(
nc3*nw1)
emodif,all,mat,3
esel,all

q1=nw1*(nc0+nc1+nc2+nc3)

esel,s,elem,,q1+(nc0*np1)+1,q1+(nc0*np1)+(nc2*np1)    ! for Imm. roof in face
emodif,all,mat,2
esel,all

q2=np1*(nc0+nc2+nc3)

esel,s,elem,,q1+(nc0*np1)+(nc2*np1)+1,q1+q2
emodif,all,mat,3
esel,all

esel,s,elem,,q1+q2+nw2*nc0+1,q1+q2+nw2*(nc0+nc1)         !1st coal pillar
emodif,all,mat,1
esel,all

esel,s,elem,,q1+q2+nw2*(nc0+nc1)+1,q1+q2+nw2*(nc0+nc1+nc2)       !roof above 1
st pillar
emodif,all,mat,2
esel,all


esel,s,elem,,q1+q2+nw2*(nc0+nc1+nc2)+1,q1+q2+nw2*(nc0+nc1+nc2+nc3)       !main
 roof above 1st pillar
emodif,all,mat,3
esel,all


q3=nw2*(nc0+nc1+nc2+nc3)

esel,s,elem,,q1+q2+q3+np2*nc0+1,q1+q2+q3+np2*(nc0+nc2)           !imm. roof ab
ove 1st entry
emodif,all,mat,2
```

SIX.TXT

```
esel,all

esel,s,elem,,q1+q2+q3+np2*(nc0+nc2)+1,q1+q2+q3+np2*(nc0+nc2+nc3)
!main roof above 1st entry
emodif,all,mat,3
esel,all

q4=np2*(nc0+nc2+nc3)

esel,s,elem,,q1+q2+q3+q4+nw3*nc0+1,q1+q2+q3+q4+nw3*(nc0+nc1)            !2nd
coal pillar
emodif,all,mat,1
esel,all

esel,s,elem,,q1+q2+q3+q4+nw3*(nc0+nc1)+1,q1+q2+q3+q4+nw3*(nc0+nc1+nc2)  !roof
 above 2nd pillar
emodif,all,mat,2
esel,all


esel,s,elem,,q1+q2+q3+q4+nw3*(nc0+nc1+nc2)+1,q1+q2+q3+q4+nw3*(nc0+nc1+nc2+nc3
)       !main roof above 2nd pillar
emodif,all,mat,3
esel,all


q5=q1+q2+q3+q4+nw3*(nc0+nc1+nc2+nc3)

esel,s,elem,,q5+np3*nc0+1,q5+np3*(nc0+nc2)      ! imm. roof above 2nd entry
emodif,all,mat,2
esel,all


esel,s,elem,,q5+np3*(nc0+nc2)+1,q5+np3*(nc0+nc2+nc3)    ! main roof above 2nd
 entry
emodif,all,mat,3
esel,all


q6=q5+np3*(nc0+nc2+nc3)

esel,s,elem,,q6+nw4*nc0+1,q6+nw4*(nc0+nc1)      !3nd coal pillar
emodif,all,mat,1
esel,all

esel,s,elem,,q6+nw4*(nc0+nc1)+1,q6+nw4*(nc0+nc1+nc2)    ! imm. roof above 3nd
 pillar
emodif,all,mat,2
esel,all

esel,s,elem,,q6+nw4*(nc0+nc1+nc2)+1,q6+nw4*(nc0+nc1+nc2+nc3)    !main roof ab
ove 3nd pillar
emodif,all,mat,3
esel,all



NUMMRG,NODE, ,

eplot
```

SIX.TXT

```
nsel,s,loc,x,-w1
d,all,ux,0

nsel,s,loc,x,(p1+w2+p2+w3+p3+w4)
sf,all, pres,sigmah


nsel,s,loc,y,-c0
d,all,uy,0


nsel,s,loc,y,c1+c2+c3
sf,all,pres,1.1*burden

nsel,all


/PNUM,MAT,1

/PSF,PRES,NORM,2
/PBF,DEFA, ,1
/PSYMB,CS,0
/PSYMB,NDIR,0
/PSYMB,ESYS,0
/PSYMB,LDIR,0
/PSYMB,LAYR,0
!*
/PBC,ALL,,1
/PBC,NFOR,,0
/PBC,NMOM,,0
/PBC,RFOR,,0
/PBC,RMOM,,0
/REPLOT
!*


/SOLU
FINISH
/SOLU
/STAT,SOLU
SOLVE
/dscale,1,1
/PLOPTS,INFO,ON
/POST1
FINISH
/POST1
PLNSOL,S,X
PLNSOL,S,Y
PLNSOL,S,XY
/PNUM,KP,0
/PNUM,LINE,0
/PNUM,AREA,1
/PNUM,VOLU,0
/PNUM,NODE,0
/PNUM,SVAL,0
/NUM,0
!*
/PNUM,MAT,0
!
!*
PLVECT,S
```

```
! Model for 2-dimensioal, eight entry system
/prep7
/title
/nopr
antype,static


/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,burden,'overburden thickness',750
*ask,sigmah,'in-situ horizontal stress',1500

*ask,c1,'coal height',6*12
*ask,y1,'coal Youngs modulus',2e5
uimp,1,ex,ey,ez,y1,y1,y1

*ask,c2,'imm. roof thickness',30*12
*ask,y2,'imm. roof v Youngs modulus',5.6e5
*ask,z2,'imm. roof h Youngs modulus',2.82e6

uimp,2,ex,ey,ez,z2,y2,z2


*ask,c3,'main roof thickness',30*12
*ask,y3,'main roof v Youngs modulus',5.6e5
*ask,z3,'main roof h Youngs modulus',2.82e6
uimp,3,ex,ey,ez,z3,y3,z3

*ask,c0,'floor thickness',40*12
*ask,y0,'floor v Youngs modulus',5e5
*ask,z0,'floor h Youngs modulus',2e6
uimp,4,ex,ey,ez,z0,y0,z0

*ask,w1,'left coal pillar half width',30*12
*ask,p1,'entry 1 width', 18*12
*ask,p2,'entry2 width', 18*12
*ask,w2,'pillar 1 width',60*12
*ask,w3,'pillar 2 width', 60*12
*ask,p3,'entry 3 width',18*12
*ask,w4,'pillar 3 width', 60*12
*ask,p4,'entry 4 width',18*12
*ask,w5,'right solid coal width',100*12

rect,-w1,0,0,c1
```

```
rect,p1,p1+w2,0,c1

rect,p1+w2+p2,p1+w2+p2+w3,0,c1

rect,p1+w2+p2+w3+p3,p1+w2+p2+w3+p3+w4,0,c1

rect,p1+w2+p2+w3+p3+w4+p4,p1+w2+p2+w3+p3+w4+p4+w5,0,c1

rect,-w1,p1+w2+p2+w3+p3+w4+p4+w5,c1,c1+c2

rect, -w1,p1+w2+p2+w3+p3+w4+p4+w5,c1+c2,c1+c2+c3

rect,-w1,p1+w2+p2+w3+p3+w4+p4+w5,-c0,0

aplot

/pnum,area,1
/replot

ET,1,PLANE42
KEYOPT,1,1,0
KEYOPT,1,2,0
KEYOPT,1,3,2
KEYOPT,1,5,0
KEYOPT,1,6,0
!*


*ask,nw1,'# elem. left pillar half widthwise',3
*ask,nw2,'# elem. pillar 1 widthwise',6
*ask,nw3,'# elem. pillar 2 widthwise',6
*ask,nw4,'# elem. pillar 3 widthwise',6
*ask,nw5,'# elem. right solid widthwise',10

*ask,np1,'# elem. entry 1 widthwise',6
*ask,np2,'# elem. entry 2 widthwise',6
*ask,np3,'# elem. entry 3 widthwise',6
*ask,np4,'# elem. entry 4 widthwise',6

*ask,nc1,'# elem. coal heightwise',4
*ask,nc2,'# elem. imm. roof heightwise',10
*ask,nc3,'# elem. main roof heightwise',6
*ask,nc0,'# elem. floor heightwise',6

n,1,-w1,-c0
n,nw1+1,0,-c0
fill,1,nw1+1,

ngen,nc0+1,nw1+1,1,nw1+1,,,c0/nc0

ngen,nc1+1,nw1+1,(nw1+1)*nc0+1, (nw1+1)*nc0+nw1+1,,,c1/nc1

ngen,nc2+1,nw1+1,(nw1+1)*nc0+(nw1+1)*nc1+1,(nw1+1)*nc0+(nw1+1)*nc
1+nw1+1,,,c2/nc2
```

```
ngen,nc3+1,nw1+1,(nw1+1)*nc0+(nw1+1)*nc1+(nw1+1)*nc2+1,(nw1+1)*nc
0+(nw1+1)*nc1+(nw1+1)*nc2+nw1+1,,,c3/nc3

na1=(nw1+1)*(nc0+nc1+nc2+nc3+1)

n,na1+1,0,-c0
n,na1+np1+1,p1,-c0
fill,na1+1,na1+np1+1

ngen,nc0+1,np1+1,na1+1,na1+np1+1,,,c0/nc0

na2=na1+(np1+1)*(nc0+1)

n,na2+1,0,c1
n,na2+np1+1,p1,c1
fill,na2+1,na2+np1+1,

ngen,nc2+1,np1+1,na2+1,na2+np1+1,,,c2/nc2
ngen,nc3+1,np1+1,na2+1+(np1+1)*nc2,na2+(np1+1)*nc2+np1+1,,,c3/nc3


na3=na2+(np1+1)*(nc2+nc3+1)

n,na3+1,p1,-c0
n,na3+nw2+1,p1+w2,-c0
fill,na3+1,na3+nw2+1

ngen,nc0+1,nw2+1,na3+1,na3+nw2+1,,,c0/nc0
ngen,nc1+1,nw2+1,na3+(nw2+1)*nc0+1,na3+(nw2+1)*nc0+nw2+1,,,c1/nc1
ngen,nc2+1,nw2+1,na3+(nw2+1)*nc0+(nw2+1)*nc1+1,na3+(nw2+1)*nc0+(n
w2+1)*nc1+nw2+1,,,c2/nc2
ngen,nc3+1,nw2+1,na3+(nw2+1)*nc0+(nw2+1)*nc1+(nw2+1)*nc2+1,na3+(n
w2+1)*nc0+(nw2+1)*nc1+(nw2+1)*nc2+nw2+1,,,c3/nc3

na4=na3+(nw2+1)*(nc0+nc1+nc2+nc3+1)


n,na4+1,p1+w2,-c0
n,na4+np2+1,p1+w2+p2,-c0
fill,na4+1,na4+np2+1

ngen,nc0+1,np2+1,na4+1,na4+np2+1,,,c0/nc0

na5=na4+(np2+1)*(nc0+1)

n,na5+1,p1+w2,c1
n,na5+np2+1,p1+w2+p2,c1
fill,na5+1,na5+np2+1,

ngen,nc2+1,np2+1,na5+1,na5+np2+1,,,c2/nc2
ngen,nc3+1,np2+1,na5+1+(np2+1)*nc2,na5+(np2+1)*nc2+np2+1,,,c3/nc3


na6=na5+(np2+1)*(nc2+nc3+1)
```

```
n,na6+1,p1+w2+p2,-c0                    ! for 2nd pillar all way
from bottom to top
n,na6+nw3+1,p1+w2+p2+w3,-c0
fill,na6+1,na6+nw3+1

ngen,nc0+1,nw3+1,na6+1,na6+nw3+1,,,c0/nc0
ngen,nc1+1,nw3+1,na6+(nw3+1)*nc0+1,na6+(nw3+1)*nc0+nw3+1,,,c1/nc1
ngen,nc2+1,nw3+1,na6+(nw3+1)*nc0+(nw3+1)*nc1+1,na6+(nw3+1)*nc0+(n
w3+1)*nc1+nw3+1,,,c2/nc2
ngen,nc3+1,nw3+1,na6+(nw3+1)*nc0+(nw3+1)*nc1+(nw3+1)*nc2+1,na6+(n
w3+1)*nc0+(nw3+1)*nc1+(nw3+1)*nc2+nw3+1,,,c3/nc3


na7=na6+(nw3+1)*(nc0+nc1+nc2+nc3+1)


n,na7+1,p1+w2+p2+w3,-c0                         ! for middle entry of
the three entry system in cut-thru area
n,na7+np3+1,p1+w2+p2+w3+p3,-c0
fill,na7+1,na7+np3+1

ngen,nc0+1,np3+1,na7+1,na7+np3+1,,,c0/nc0

na8=na7+(np3+1)*(nc0+1)

n,na8+1,p1+w2+p2+w3,c1
n,na8+np3+1,p1+w2+p2+w3+p3,c1
fill,na8+1,na8+np3+1

ngen,nc2+1,np3+1,na8+1,na8+np3+1,,,c2/nc2
ngen,nc3+1,np3+1,na8+1+(np3+1)*nc2,na8+(np3+1)*nc2+np3+1,,,c3/nc3

na9=na8+(np3+1)*(nc2+nc3+1)


n,na9+1,p1+w2+p2+w3+p3,-c0                      ! for 3nd pillar all
way from bottom to top
n,na9+nw4+1,p1+w2+p2+w3+p3+w4,-c0
fill,na9+1,na9+nw4+1

ngen,nc0+1,nw4+1,na9+1,na9+nw4+1,,,c0/nc0
ngen,nc1+1,nw4+1,na9+(nw4+1)*nc0+1,na9+(nw4+1)*nc0+nw4+1,,,c1/nc1
ngen,nc2+1,nw4+1,na9+(nw4+1)*nc0+(nw4+1)*nc1+1,na9+(nw4+1)*nc0+(n
w4+1)*nc1+nw4+1,,,c2/nc2
ngen,nc3+1,nw4+1,na9+(nw4+1)*nc0+(nw4+1)*nc1+(nw4+1)*nc2+1,na9+(n
w4+1)*nc0+(nw4+1)*nc1+(nw4+1)*nc2+nw4+1,,,c3/nc3


na10=na9+(nw4+1)*(nc0+nc1+nc2+nc3+1)

n,na10+1,p1+w2+p2+w3+p3+w4,-c0            ! for the entry next to the
solid caol in the three entry system in cut-thru area
```

```
n,na10+np4+1,p1+w2+p2+w3+p3+w4+p4,-c0
fill,na10+1,na10+np4+1

ngen,nc0+1,np4+1,na10+1,na10+np4+1,,,c0/nc0

na11=na10+(np4+1)*(nc0+1)

n,na11+1,p1+w2+p2+w3+p3+w4,c1
n,na11+np4+1,p1+w2+p2+w3+p3+w4+p4,c1
fill,na11+1,na11+np4+1,

ngen,nc2+1,np4+1,na11+1,na11+np4+1,,,c2/nc2
ngen,nc3+1,np4+1,na11+1+(np4+1)*nc2,na11+(np4+1)*nc2+np4+1,,,c3/nc3


na12=na11+(np4+1)*(nc2+nc3+1)

n,na12+1,p1+w2+p2+w3+p3+w4+p4,-c0                    ! for solid coal
all way from bottom to top
n,na12+nw5+1,p1+w2+p2+w3+p3+w4+p4+w5,-c0
fill,na12+1,na12+nw5+1

ngen,nc0+1,nw5+1,na12+1,na12+nw5+1,,,c0/nc0
ngen,nc1+1,nw5+1,na12+(nw5+1)*nc0+1,
na12+(nw5+1)*nc0+nw5+1,,,c1/nc1
ngen,nc2+1,nw5+1,na12+(nw5+1)*nc0+(nw5+1)*nc1+1,na12+(nw5+1)*nc0+
(nw5+1)*nc1+nw5+1,,,c2/nc2
ngen,nc3+1,nw5+1,na12+(nw5+1)*nc0+(nw5+1)*nc1+(nw5+1)*nc2+1,na12+
(nw5+1)*nc0+(nw5+1)*nc1+(nw5+1)*nc2+nw5+1,,,c3/nc3


mat,4
e,1,2,(nw1+1)+2,(nw1+1)+1      ! generate element on the gob side
egen,nw1,1,-1
egen,(nc0+nc1+nc2+nc3),(nw1+1),-nw1


e,na1+1,na1+2, na1+(np1+1)+2,na1+ (np1+1)+1   ! generate element for
floor in the face
egen,np1,1,-1
egen,nc0,np1+1,-np1


e,na2+1,na2+2, na2+(np1+1)+2,na2+ (np1+1)+1   ! generate element for
roof in the face
egen,np1,1,-1
egen,nc2+nc3,np1+1,-np1


e,na3+1,na3+2,na3+(nw2+1)+2,na3+(nw2+1)+1     ! generate element for
the 1st pillar from bottom to up
```

```
egen,nw2,1,-1
egen,(nc0+nc1+nc2+nc3),(nw2+1),-nw2

e,na4+1,na4+2, na4+(np2+1)+2,na4+ (np2+1)+1  ! generate element for
floor of 1st entry on the face side
egen,np2,1,-1
egen,nc0,np2+1,-np2

e,na5+1,na5+2, na5+(np2+1)+2,na5+ (np2+1)+1  ! generate element for
roof in 1st entry
egen,np2,1,-1
egen,nc2+nc3,np2+1,-np2

e,na6+1,na6+2,na6+(nw3+1)+2,na6+(nw3+1)+1    ! generate element for
the 2st pillar from bottom to up
egen,nw3,1,-1
egen,(nc0+nc1+nc2+nc3),(nw3+1),-nw3

e,na7+1,na7+2, na7+(np3+1)+2,na7+ (np3+1)+1  ! generate element for
floor of middle entry
egen,np3,1,-1
egen,nc0,np3+1,-np3

e,na8+1,na8+2, na8+(np3+1)+2,na8+ (np3+1)+1  ! generate element for
roof in middle entry
egen,np3,1,-1
egen,nc2+nc3,np3+1,-np3

e,na9+1,na9+2,na9+(nw4+1)+2,na9+(nw4+1)+1    ! generate element for
the 3rd pillar from bottom to up
egen,nw4,1,-1
egen,(nc0+nc1+nc2+nc3),(nw4+1),-nw4

e,na10+1,na10+2, na10+(np4+1)+2,na10+ (np4+1)+1   !   generate
element for floor of last entry
egen,np4,1,-1
egen,nc0,np4+1,-np4

e,na11+1,na11+2, na11+(np4+1)+2,na11+ (np4+1)+1   !   generate
element for roof in last entry
egen,np4,1,-1
egen,nc2+nc3,np4+1,-np4

e,na12+1,na12+2,na12+(nw5+1)+2,na12+(nw5+1)+1     !   generate
```

```
element for the solid coal from bottom to up
egen,nw5,1,-1
egen,(nc0+nc1+nc2+nc3),(nw5+1),-nw5


esel,s, elem,,nc0*nw1+1,nc0*nw1+nc1*nw1
emodif,all,mat,1
esel,all


esel,s, elem,,(nc0*nw1)+(nc1*nw1)+1,(nc0*nw1)+(nc1*nw1)+(nc2*nw1)
emodif,all,mat,2
esel,all


e          s          e          l                ,              s              ,
elem,,(nc0*nw1)+(nc1*nw1)+(nc2*nw1)+1,(nc0*nw1)+(nc1*nw1)+(nc2*nw
1)+(nc3*nw1)
emodif,all,mat,3
esel,all

q1=nw1*(nc0+nc1+nc2+nc3)

esel,s,elem,,q1+(nc0*np1)+1,q1+(nc0*np1)+(nc2*np1)     ! for Imm.
roof in face
emodif,all,mat,2
esel,all


q2=np1*(nc0+nc2+nc3)

esel,s,elem,,q1+(nc0*np1)+(nc2*np1)+1,q1+q2
emodif,all,mat,3
esel,all

esel,s,elem,,q1+q2+nw2*nc0+1,q1+q2+nw2*(nc0+nc1)   !1st coal pillar
emodif,all,mat,1
esel,all


esel,s,elem,,q1+q2+nw2*(nc0+nc1)+1,q1+q2+nw2*(nc0+nc1+nc2)   !roof
above 1st pillar
emodif,all,mat,2
esel,all


esel,s,elem,,q1+q2+nw2*(nc0+nc1+nc2)+1,q1+q2+nw2*(nc0+nc1+nc2+nc3
)     !main roof above 1st pillar
emodif,all,mat,3
esel,all


q3=nw2*(nc0+nc1+nc2+nc3)
```

```
esel,s,elem,,q1+q2+q3+np2*nc0+1,q1+q2+q3+np2*(nc0+nc2)        !imm.
roof above 1st entry
emodif,all,mat,2
esel,all

esel,s,elem,,q1+q2+q3+np2*(nc0+nc2)+1,q1+q2+q3+np2*(nc0+nc2+nc3)
     !main roof above 1st entry
emodif,all,mat,3
esel,all


q4=np2*(nc0+nc2+nc3)

esel,s,elem,,q1+q2+q3+q4+nw3*nc0+1,q1+q2+q3+q4+nw3*(nc0+nc1)
     !2nd coal pillar
emodif,all,mat,1
esel,all

esel,s,elem,,q1+q2+q3+q4+nw3*(nc0+nc1)+1,q1+q2+q3+q4+nw3*(nc0+nc1
+nc2)     !roof above 2nd pillar
emodif,all,mat,2
esel,all


esel,s,elem,,q1+q2+q3+q4+nw3*(nc0+nc1+nc2)+1,q1+q2+q3+q4+nw3*(nc0
+nc1+nc2+nc3)  !main roof above 2nd pillar
emodif,all,mat,3
esel,all


q5=q1+q2+q3+q4+nw3*(nc0+nc1+nc2+nc3)

esel,s,elem,,q5+np3*nc0+1,q5+np3*(nc0+nc2)    ! imm. roof above 2nd
entry
emodif,all,mat,2
esel,all


esel,s,elem,,q5+np3*(nc0+nc2)+1,q5+np3*(nc0+nc2+nc3)    ! main roof
above 2nd entry
emodif,all,mat,3
esel,all


q6=q5+np3*(nc0+nc2+nc3)

esel,s,elem,,q6+nw4*nc0+1,q6+nw4*(nc0+nc1)    !3nd coal pillar
emodif,all,mat,1
esel,all

esel,s,elem,,q6+nw4*(nc0+nc1)+1,q6+nw4*(nc0+nc1+nc2)    ! imm. roof
above 3nd pillar
emodif,all,mat,2
esel,all
```

```
esel,s,elem,,q6+nw4*(nc0+nc1+nc2)+1,q6+nw4*(nc0+nc1+nc2+nc3)
!main roof above 3nd pillar
emodif,all,mat,3
esel,all


q7=q6+nw4*(nc0+nc1+nc2+nc3)

esel,s,elem,,q7+np4*nc0+1,q7+np4*(nc0+nc2)    ! imm. roof above 3rd
entry
emodif,all,mat,2
esel,all


esel,s,elem,,q7+np4*(nc0+nc2)+1,q7+np4*(nc0+nc2+nc3)    ! main roof
above 3rd entry
emodif,all,mat,3
esel,all


q8=q7+np4*(nc0+nc2+nc3)

esel,s,elem,,q8+nw5*nc0+1,q8+nw5*(nc0+nc1)    !solid coal
emodif,all,mat,1
esel,all

esel,s,elem,,q8+nw5*(nc0+nc1)+1,q8+nw5*(nc0+nc1+nc2)    ! imm. roof
above solid pillar
emodif,all,mat,2
esel,all

esel,s,elem,,q8+nw5*(nc0+nc1+nc2)+1,q8+nw5*(nc0+nc1+nc2+nc3)
!main roof above solid pillar
emodif,all,mat,3
esel,all


NUMMRG,NODE, ,

eplot


nsel,s,loc,x,-w1
d,all,ux,0

nsel,s,loc,x,(p1+w2+p2+w3+p3+w4+p4+w5)
sf,all, pres,sigmah


nsel,s,loc,y,-c0
d,all,uy,0
```

```
nsel,s,loc,y,c1+c2+c3
sf,all,pres,1.1*burden

nsel,all


/PNUM,MAT,1

/PSF,PRES,NORM,2
/PBF,DEFA, ,1
/PSYMB,CS,0
/PSYMB,NDIR,0
/PSYMB,ESYS,0
/PSYMB,LDIR,0
/PSYMB,LAYR,0
!*
/PBC,ALL,,1
/PBC,NFOR,,0
/PBC,NMOM,,0
/PBC,RFOR,,0
/PBC,RMOM,,0
/REPLOT
!*


/SOLU
FINISH
/SOLU
/STAT,SOLU
SOLVE
/dscale,1,1
/PLOPTS,INFO,ON
/POST1
FINISH
/POST1
PLNSOL,S,X
PLNSOL,S,Y
PLNSOL,S,XY
/PNUM,KP,0
/PNUM,LINE,0
/PNUM,AREA,1
/PNUM,VOLU,0
/PNUM,NODE,0
/PNUM,SVAL,0
/NUM,0
!*
/PNUM,MAT,0
!
!*
PLVECT,S
```

GOB2.TXT

```
! Model for 2-D, two entry system with a mined out gob
/prep7
/title
/nopr
antype,static


/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,burden,'overburden thickness',400
*ask,hstress,'in-situ horizontal stress',600

*ask,ymfh,'floor hori. Youngs modul(#1)',2.0e5
*a   ,ymfv,'floor vertical Youngs modulus',1.0e5
u    1,ex,ey,ez,ymfh,ymfv,ymfh,

*a   ,ymgob,'gob youngs modul(#2)',1e4
uimp,2,ex,ey,ez,ymgob,ymgob,ymgob,

*ask,ymr1h,'hori.Youngs modul(#3) above gob',1.5e6
*ask,ymr1v,'vertical youngs modulus',5.35e5
uimp,3,ex,ey,ez,ymr1h,ymr1v,ymr1h,

*ask,ymr2h,'hori.Youngs modul(#4) above gob',1.5e6
*ask,ymr2v,'vertical youngs modulus',5.35e5
uimp,4,ex,ey,ez,ymr1h,ymr2v,ymr2h,

*ask,ymr3h,'hori.Youngs modul(#5) above gob',1.5e6
*ask,ymr3v,'vertical youngs modulus',5.35e5
uimp,5,ex,ey,ez,ymr1h,ymr3v,ymr3h,

*ask,ymr4h,'hori.Youngs modul(#6) above gob',1.5e6
*ask,ymr4v,'vertical youngs modulus',5.35e5
uimp,6,ex,ey,ez,ymr1h,ymr4v,ymr4h,

*ask,ymc,'coal Youngs modul(#7)',3.1e5
uimp,7,ex,ey,ez,ymc,ymc,ymc,

*ask,g1,'gob area 1 width',50*12
*ask,g2,'gob area 2 width',50*12
*ask,g3,'gob area 3 width',50*12

*ask,p1,'entry 1 width', 17*12

*ask,w1,'pillar 1 width',68*12

*ask,w2,'solid coal width', 150*12


*ask,c0,'floor thickness',80*12
*ask,c1,'coal thickness',6*12
*ask,c2,'roof thickness',25*12
```

GOB2.TXT

```
*ask,c3,'roof thickness',25*12
*ask,c4,'roof thickness',25*12
*ask,c5,'roof thickness',80*12


rect,0,g1,0,c1+c2+c3+c4
rect,g1,g1+g2,0,c1+c2+c3
rect,g1+g2,g1+g2+g3,0,c1+c2
rect,g1+g2+g3,g1+g2+g3+w1,0,c1
rect,g1+g2+g3+w1+p1,g1+g2+g3+w1+p1+w2,0,c1

rect,g1+g2+g3,g1+g2+g3+w1+p1+w2,c1,c1+c2
rect,g1+g2,g1+g2+g3+w1+p1+w2,c1+c2,c1+c2+c3
rect,g1,g1+g2+g3+w1+p1+w2,c1+c2+c3,c1+c2+c3+c4
rect,0,g1+g2+g3+w1+p1+w2,c1+c2+c3+c4,c1+c2+c3+c4+c5
rect,0,g1+g2+g3+w1+p1+w2,-c0,0

aplot

/pnum,area,1
/replot

ET,1,PLANE42
KEYOPT,1,1,0
KEYOPT,1,2,0
KEYOPT,1,3,2
KEYOPT,1,5,0
KEYOPT,1,6,0
!*

*ask,ng1,'# elem. gob area 1 widthwise',4
*ask,ng2,'# elem. gob area 2 widthwise',4
*ask,ng3,'# elem. gob area 3 widthwise',4
*ask,nw1,'# elem. pillar 1 widthwise',3
*ask,nw2,'# elem. solid widthwise',10
*ask,np1,'# elem. entry widthwise',6
*ask,nc1,'# elem. coal c1 heightwise',4
*ask,nc2,'# elem. roof c2 heightwise',6
*ask,nc3,'# elem. roof c3 heightwise',6
*ask,nc4,'# elem. roof c4 heightwise',6
*ask,nc5,'# elem. roof c5 heightwise',6
*ask,nc0,'# elem. floor heightwise',6

n,1,0,-c0
n,ng1+1,g1,-c0
fill

ngen,nc0+1,ng1+1,1,ng1+1,,,c0/nc0
ngen,nc1+1,ng1+1,(ng1+1)*(nc0)+1,(ng1+1)*(nc0)+ng1+1,,,0
ngen,nc1+1,ng1+1,(ng1+1)*(nc0+1)+1,(ng1+1)*(nc0+1)+ng1+1,,,c1/nc1
ngen,nc2+1,ng1+1,(ng1+1)*(nc0+nc1+1)+1,(ng1+1)*(nc0+nc1+1)+ng1+1,,,0
ngen,nc2+1,ng1+1,(ng1+1)*(nc0+nc1+2)+1,(ng1+1)*(nc0+nc1+2)+ng1+1,,,c2/nc2
ngen,nc3+1,ng1+1,(ng1+1)*(nc0+nc1+nc2+2)+1,(ng1+1)*(nc0+nc1+nc2+2)+ng1+1,,,0
ngen,nc3+1,ng1+1,(ng1+1)*(nc0+nc1+nc2+3)+1,(ng1+1)*(nc0+nc1+nc2+3)+ng1+1,,,c3
/nc3
ngen,nc4+1,ng1+1,(ng1+1)*(nc0+nc1+nc2+nc3+3)+1,(ng1+1)*(nc0+nc1+nc2+nc3+3)+ng
1+1,,,0
ngen,nc4+1,ng1+1,(ng1+1)*(nc0+nc1+nc2+nc3+4)+1,(ng1+1)*(nc0+nc1+nc2+nc3+4)+ng
1+1,,,c4/nc4
ngen,nc5+1,ng1+1,(ng1+1)*(nc0+nc1+nc2+nc3+nc4+4)+1,(ng1+1)*(nc0+nc1+nc2+nc3+n
c4+4)+ng1+1,,,0
ngen,nc5+1,ng1+1,(ng1+1)*(nc0+nc1+nc2+nc3+nc4+5)+1,(ng1+1)*(nc0+nc1+nc2+nc3+n
```

GOB2.TXT

```
c4+5)+ng1+1,,,c5/nc5

nt1=(ng1+1)*(nc0+nc1+nc2+nc3+nc4+nc5+6)

n,nt1+1,g1,-c0
n,nt1+ng2+1,g1+g2,-c0
fill

ngen,nc0+1,ng2+1,nt1+1,nt1+ng2+1,,,c0/nc0
ngen,nc1+1,ng2+1,nt1+(ng2+1)*(nc0)+1,nt1+(ng2+1)*(nc0)+ng2+1,,,0
ngen,nc1+1,ng2+1,nt1+(ng2+1)*(nc0+1)+1,nt1+(ng2+1)*(nc0+1)+ng2+1,,,c1/nc1
ngen,nc2+1,ng2+1,nt1+(ng2+1)*(nc0+nc1+1)+1,nt1+(ng2+1)*(nc0+nc1+1)+ng2+1,,,0
ngen,nc2+1,ng2+1,nt1+(ng2+1)*(nc0+nc1+2)+1,nt1+(ng2+1)*(nc0+nc1+2)+ng2+1,,,c2
/nc2
ngen,nc3+1,ng2+1,nt1+(ng2+1)*(nc0+nc1+nc2+2)+1,nt1+(ng2+1)*(nc0+nc1+nc2+2)+ng
2+1,,,0
ngen,nc3+1,ng2+1,nt1+(ng2+1)*(nc0+nc1+nc2+3)+1,nt1+(ng2+1)*(nc0+nc1+nc2+3)+ng
2+1,,,c3/nc3
ngen,nc4+1,ng2+1,nt1+(ng2+1)*(nc0+nc1+nc2+nc3+3)+1,nt1+(ng2+1)*(nc0+nc1+nc2+n
c3+3)+ng2+1,,,0
ngen,nc4+1,ng2+1,nt1+(ng2+1)*(nc0+nc1+nc2+nc3+4)+1,nt1+(ng2+1)*(nc0+nc1+nc2+n
c3+4)+ng2+1,,,c4/nc4
ngen,nc5+1,ng2+1,nt1+(ng2+1)*(nc0+nc1+nc2+nc3+nc4+4)+1,nt1+(ng2+1)*(nc0+nc1+n
c2+nc3+nc4+4)+ng2+1,,,c5/nc5

n  =nt1+(ng2+1)*(nc0+nc1+nc2+nc3+nc4+nc5+5)

n,nt2+1,g1+g2,-c0
n,nt2+ng3+1,g1+g2+g3,-c0
fill

ngen,nc0+1,ng3+1,nt2+1,nt2+ng3+1,,,c0/nc0
ngen,nc1+1,ng3+1,nt2+(ng3+1)*(nc0)+1,nt2+(ng3+1)*(nc0)+ng3+1,,,0
ngen,nc1+1,ng3+1,nt2+(ng3+1)*(nc0+1)+1,nt2+(ng3+1)*(nc0+1)+ng3+1,,,c1/nc1
ngen,nc2+1,ng3+1,nt2+(ng3+1)*(nc0+nc1+1)+1,nt2+(ng3+1)*(nc0+nc1+1)+ng3+1,,,0
ngen,nc2+1,ng3+1,nt2+(ng3+1)*(nc0+nc1+2)+1,nt2+(ng3+1)*(nc0+nc1+2)+ng3+1,,,c2
/nc2
ngen,nc3+1,ng3+1,nt2+(ng3+1)*(nc0+nc1+nc2+2)+1,nt2+(ng3+1)*(nc0+nc1+nc2+2)+ng
3+1,,,0
ngen,nc3+1,ng3+1,nt2+(ng3+1)*(nc0+nc1+nc2+3)+1,nt2+(ng3+1)*(nc0+nc1+nc2+3)+ng
3+1,,,c3/nc3
ngen,nc4+1,ng3+1,nt2+(ng3+1)*(nc0+nc1+nc2+nc3+3)+1,nt2+(ng3+1)*(nc0+nc1+nc2+n
c3+3)+ng3+1,,,c4/nc4
ngen,nc5+1,ng3+1,nt2+(ng3+1)*(nc0+nc1+nc2+nc3+nc4+3)+1,nt2+(ng3+1)*(nc0+nc1+n
c2+nc3+nc4+3)+ng3+1,,,c5/nc5


nt3=nt2+(ng3+1)*(nc0+nc1+nc2+nc3+nc4+nc5+4)

n,nt3+1,g1+g2+g3,-c0
n,nt3+nw1+1,g1+g2+g3+w1,-c0
fill

ngen,nc0+1,nw1+1,nt3+1,nt3+nw1+1,,,c0/nc0
ngen,nc1+1,nw1+1,nt3+(nw1+1)*nc0+1,nt3+(nw1+1)*nc0+nw1+1,,,c1/nc1
ngen,nc2+1,nw1+1,nt3+(nw1+1)*(nc0+nc1)+1,nt3+(nw1+1)*(nc0+nc1)+nw1+1,,,c2/nc2
ngen,nc3+1,nw1+1,nt3+(nw1+1)*(nc0+nc1+nc2)+1,nt3+(nw1+1)*(nc0+nc1+nc2)+nw1+1,
,,c3/nc3
ngen,nc4+1,nw1+1,nt3+(nw1+1)*(nc0+nc1+nc2+nc3)+1,nt3+(nw1+1)*(nc0+nc1+nc2+nc3
)+nw1+1,,,c4/nc4
ngen,nc5+1,nw1+1,nt3+(nw1+1)*(nc0+nc1+nc2+nc3+nc4)+1,nt3+(nw1+1)*(nc0+nc1+nc2
+nc3+nc4)+nw1+1,,,c5/nc5
```

GOB2.TXT

```
nt4=nt3+(nw1+1)*(nc0+nc1+nc2+nc3+nc4+nc5+1)

n,nt4+1,g1+g2+g3+w1,-c0
n,nt4+np1+1,g1+g2+g3+w1+p1,-c0
fill

ngen,nc0+1,np1+1,nt4+1,nt4+np1+1,,,c0/nc0

nt5=nt4+(np1+1)*(nc0+1)

n,nt5+1,g1+g2+g3+w1,c1
n,nt5+np1+1,g1+g2+g3+w1+p1,c1
fill

ngen,nc2+1,np1+1,nt5+1,nt5+np1+1,,,c2/nc2
ngen,nc3+1,np1+1,nt5+(np1+1)*(nc2)+1,nt5+(np1+1)*(nc2)+np1+1,,,c3/nc3
ngen,nc4+1,np1+1,nt5+(np1+1)*(nc2+nc3)+1,nt5+(np1+1)*(nc2+nc3)+np1+1,,,c4/nc4
ngen,nc5+1,np1+1,nt5+(np1+1)*(nc2+nc3+nc4)+1,nt5+(np1+1)*(nc2+nc3+nc4)+np1+1,
,,c5/nc5


nt =nt5+(np1+1)*(nc2+nc3+nc4+nc5+1)

n,nt6+1,g1+g2+g3+w1+p1,-c0                    ! tailgate pillar column (flo
or, pillar, roof)
n,nt6+nw2+1,g1+g2+g3+w1+p1+w2,-c0
fill

ngen,nc0+1,nw2+1,nt6+1,nt6+nw2+1,,,c0/nc0
ngen,nc1+1,nw2+1,nt6+(nw2+1)*nc0+1,nt6+(nw2+1)*nc0+nw2+1,,,c1/nc1
ngen,nc2+1,nw2+1,nt6+(nw2+1)*(nc0+nc1)+1,nt6+(nw2+1)*(nc0+nc1)+nw2+1,,,c2/nc2
ngen,nc3+1,nw2+1,nt6+(nw2+1)*(nc0+nc1+nc2)+1,nt6+(nw2+1)*(nc0+nc1+nc2)+nw2+1,
,,c3/nc3
ngen,nc4+1,nw2+1,nt6+(nw2+1)*(nc0+nc1+nc2+nc3)+1,nt6+(nw2+1)*(nc0+nc1+nc2+nc3
)+nw2+1,,,c4/nc4
ngen,nc5+1,nw2+1,nt6+(nw2+1)*(nc0+nc1+nc2+nc3+nc4)+1,nt6+(nw2+1)*(nc0+nc1+nc2
+nc3+nc4)+nw2+1,,,c5/nc5



mat,1
e,1,2,(ng1+1)+2,(ng1+1)+1        ! generate element on the gob side
egen,ng1,1,-1
egen,nc0,(ng1+1),-ng1


e,(ng1+1)*(nc0+1)+1,(ng1+1)*(nc0+1)+2,(ng1+1)*(nc0+1)+(ng1+1)+2,(ng1+1)*(nc0+
1)+(ng1+1)+1
egen,ng1,1,-1
egen,nc1,ng1+1,-ng1


e,(ng1+1)*(nc0+nc1+2)+1,(ng1+1)*(nc0+nc1+2)+2,(ng1+1)*(nc0+nc1+2)+(ng1+1)+2,(
ng1+1)*(nc0+nc1+2)+(ng1+1)+1
egen,ng1,1,-1
egen,nc2,ng1+1,-ng1
```

GOB2.TXT

```
e,(ng1+1)*(nc0+nc1+nc2+3)+1,(ng1+1)*(nc0+nc1+nc2+3)+2,(ng1+1)*(nc0+nc1+nc2+3)
+(ng1+1)+2,(ng1+1)*(nc0+nc1+nc2+3)+(ng1+1)+1
egen,ng1,1,-1
egen,nc3,ng1+1,-ng1

a1=nc0+nc1+nc2+nc3+4

e,(ng1+1)*a1+1,(ng1+1)*a1 +2,(ng1+1)*a1+(ng1+1)+2,(ng1+1)*a1+(ng1+1)+1
egen,ng1,1,-1
egen,nc4,ng1+1,-ng1

a2=nc0+nc1+nc2+nc3+nc4+5
e,(ng1+1)*a2+1,(ng1+1)*a2+2,(ng1+1)*a2+(ng1+1)+2,(ng1+1)*a2+(ng1+1)+1
egen,ng1,1,-1
egen,nc5,ng1+1,-ng1


e,nt1+1,nt1+2,nt1+ng2+3,nt1+ng2+2
egen,ng2,1,-1
egen,nc0,ng2+1,-ng2

e,nt1+(ng2+1)*(nc0+1)+1,nt1+(ng2+1)*(nc0+1)+2,nt1+(ng2+1)*(nc0+1)+(ng2+1)+2,n
t1+(ng2+1)*(nc0+1)+(ng2+1)+1
egen,ng2,1,-1
egen,nc1,ng2+1,-ng2

e,nt1+(ng2+1)*(nc0+nc1+2)+1,nt1+(ng2+1)*(nc0+nc1+2)+2,nt1+(ng2+1)*(nc0+nc1+2)
+(ng2+1)+2,nt1+(ng2+1)*(nc0+nc1+2)+(ng2+1)+1
egen,ng2,1,-1
egen,nc2,ng2+1,-ng2

a4=nc0+nc1+nc2+3

e,nt1+(ng2+1)*a4+1,nt1+(ng2+1)*a4+2,nt1+(ng2+1)*a4+(ng2+1)+2,nt1+(ng2+1)*a4+(
ng2+1)+1
egen,ng2,1,-1
egen,nc3,ng2+1,-ng2

a3=nc0+nc1+nc2+nc3+4

e,nt1+(ng2+1)*a3+1,nt1+(ng2+1)*a3 +2,nt1+(ng2+1)*a3+(ng2+1)+2,nt1+(ng2+1)*a3+
(ng2+1)+1
egen,ng2,1,-1
egen,nc4,ng2+1,-ng2

a5=nc0+nc1+nc2+nc3+nc4+4
e,nt1+(ng2+1)*a5+1,nt1+(ng2+1)*a5+2,nt1+(ng2+1)*a5+(ng2+1)+2,nt1+(ng2+1)*a5+(
ng2+1)+1
egen,ng2,1,-1
egen,nc5,ng2+1,-ng2


e,nt2+1,nt2+2,nt2+ng3+3,nt2+ng3+2                !g3 area column
egen,ng3,1,-1
egen,nc0,ng3+1,-ng3

e,nt2+(ng3+1)*(nc0+1)+1,nt2+(ng3+1)*(nc0+1)+2,nt2+(ng3+1)*(nc0+1)+(ng3+1)+2,n
t2+(ng3+1)*(nc0+1)+(ng3+1)+1
egen,ng3,1,-1
egen,nc1,ng3+1,-ng3
```

GOB2.TXT

```
e,nt2+(ng3+1)*(nc0+nc1+2)+1,nt2+(ng3+1)*(nc0+nc1+2)+2,nt2+(ng3+1)*(nc0+nc1+2)
+(ng3+1)+2,nt2+(ng3+1)*(nc0+nc1+2)+(ng3+1)+1
egen,ng3,1,-1
egen,nc2,ng3+1,-ng3

a6=nc0+nc1+nc2+3

e,nt2+(ng3+1)*a6+1,nt2+(ng3+1)*a6+2,nt2+(ng3+1)*a6+(ng3+1)+2,nt2+(ng3+1)*a6+(
ng3+1)+1
egen,ng3,1,-1
egen,nc3,ng3+1,-ng3

a7=nc0+nc1+nc2+nc3+3

e,nt2+(ng3+1)*a7+1,nt2+(ng3+1)*a7 +2,nt2+(ng3+1)*a7+(ng3+1)+2,nt2+(ng3+1)*a7+
(ng3+1)+1
egen,ng3,1,-1
egen,nc4,ng3+1,-ng3

a8=nc0+nc1+nc2+nc3+nc4+3
e,nt2+(ng3+1)*a8+1,nt2+(ng3+1)*a8+2,nt2+(ng3+1)*a8+(ng3+1)+2,nt2+(ng3+1)*a8+(
ng3+1)+1
egen,ng3,1,-1
egen,nc5,ng3+1,-ng3


e,  3+1,nt3+2,nt3+nw1+3,nt3+nw1+2                !w1 pillar column
egen,nw1,1,-1
egen,(nc0+nc1+nc2+nc3+nc4+nc5),nw1+1,-nw1

e,nt4+1,nt4+2,nt4+np1+3,nt4+np1+2                !entry p1 floor column
egen,np1,1,-1
egen,(nc0),np1+1,-np1

e,nt5+1,nt5+2,nt5+np1+3,nt5+np1+2                !entry p1 roof column
egen,np1,1,-1
egen,(nc2+nc3+nc4+nc5),np1+1,-np1


e,nt6+1,nt6+2,nt6+nw2+3,nt6+nw2+2                !w2 pillar column
egen,nw2,1,-1
egen,(nc0+nc1+nc2+nc3+nc4+nc5),nw2+1,-nw2


esel,s, elem,,ng1*nc0+1,ng1*(nc0+nc1+nc2+nc3+nc4)
emodif,all,mat,2
esel,all

esel,s,elem,,ng1*(nc0+nc1+nc2+nc3+nc4)+1,ng1*(nc0+nc1+nc2+nc3+nc4+nc5)
emodif,all,mat,3
esel,all


s1=ng1*(nc0+nc1+nc2+nc3+nc4+nc5)
esel,s,elem,,s1+ng2*nc0+1,s1+ng2*(nc0+nc1+nc2+nc3)
emodif,all,mat,2
esel,all


esel,s,elem,,s1+ng2*(nc0+nc1+nc2+nc3)+1,s1+ng2*(nc0+nc1+nc2+nc3+nc4)
emodif,all,mat,4
```

GOB2.TXT

```
esel,all

esel,s,elem,,s1+ng2*(nc0+nc1+nc2+nc3+nc4)+1,s1+ng2*(nc0+nc1+nc2+nc3+nc4+nc5)
emodif,all,mat,3
esel,all


s2=s1+ng2*(nc0+nc1+nc2+nc3+nc4+nc5)
esel,s,elem,,s2+ng3*nc0+1,s2+ng2*(nc0+nc1+nc2)
emodif,all,mat,2
esel,all

esel,s,elem,,s2+ng3*(nc0+nc1+nc2)+1,s2+ng3*(nc0+nc1+nc2+nc3)
emodif,all,mat,5
esel,all


esel,s,elem,,s2+ng3*(nc0+nc1+nc2+nc3)+1,s2+ng3*(nc0+nc1+nc2+nc3+nc4)
emodif,all,mat,4
esel,all

esel,s,elem,,s2+ng3*(nc0+nc1+nc2+nc3+nc4)+1,s2+ng3*(nc0+nc1+nc2+nc3+nc4+nc5)
emodif,all,mat,3
esel,all


s3=s2+ng3*(nc0+nc1+nc2+nc3+nc4+nc5)
esel,s,elem,,s3+nw1*nc0+1,s3+nw1*(nc0+nc1)
emodif,all,mat,7
esel,all

esel,s,elem,,s3+nw1*(nc0+nc1)+1,s3+nw1*(nc0+nc1+nc2)
emodif,all,mat,6
esel,all

esel,s,elem,,s3+nw1*(nc0+nc1+nc2)+1,s3+nw1*(nc0+nc1+nc2+nc3)
emodif,all,mat,5
esel,all

esel,s,elem,,s3+nw1*(nc0+nc1+nc2+nc3)+1,s3+nw1*(nc0+nc1+nc2+nc3+nc4)
emodif,all,mat,4
esel,all

esel,s,elem,,s3+nw1*(nc0+nc1+nc2+nc3+nc4)+1,s3+nw1*(nc0+nc1+nc2+nc3+nc4+nc5)
emodif,all,mat,3
esel,all

s4=s3+nw1*(nc0+nc1+nc2+nc3+nc4+nc5)
esel,s,elem,,s4+np1*nc0+1,s4+np1*(nc0+nc2)
emodif,all,mat,6
esel,all

esel,s,elem,,s4+np1*(nc0+nc2)+1,s4+np1*(nc0+nc2+nc3)
emodif,all,mat,5
esel,all

esel,s,elem,,s4+np1*(nc0+nc2+nc3)+1,s4+np1*(nc0+nc2+nc3+nc4)
emodif,all,mat,4
esel,all

esel,s,elem,,s4+np1*(nc0+nc2+nc3+nc4)+1,s4+np1*(nc0+nc2+nc3+nc4+nc5)
emodif,all,mat,3
```

GOB2.TXT

```
esel,all

s5=s4+np1*(nc0+nc2+nc3+nc4+nc5)
esel,s,elem,,s5+nw2*nc0+1,s5+nw2*(nc0+nc1)
emodif,all,mat,7
esel,all

esel,s,elem,,s5+nw2*(nc0+nc1)+1,s5+nw2*(nc0+nc1+nc2)
emodif,all,mat,6
esel,all

esel,s,elem,,s5+nw2*(nc0+nc1+nc2)+1,s5+nw2*(nc0+nc1+nc2+nc3)
emodif,all,mat,5
esel,all

esel,s,elem,,s5+nw2*(nc0+nc1+nc2+nc3)+1,s5+nw2*(nc0+nc1+nc2+nc3+nc4)
emodif,all,mat,4
esel,all

esel,s,elem,,s5+nw2*(nc0+nc1+nc2+nc3+nc4)+1,s5+nw2*(nc0+nc1+nc2+nc3+nc4+nc5)
emodif,all,mat,3
esel,all



nsel,s,loc,x,g1+g2+g3+w1
NUMMRG,NODE, ,
nsel,all

nsel,s,loc,x,g1+g2+g3+w1+p1
NUMMRG,NODE, ,
nsel,all

nsel,s,loc,x,g1+g2+g3+w1+p1+w2
NUMMRG,NODE, ,
nsel,all

nsel,s,loc,x,g1+g2+g3+w1+p1+w2+p2
NUMMRG,NODE, ,
nsel,all

nsel,s,loc,x,g1
nsel,r,loc,y,c1+c2+c3+c4+c5/nc5,c1+c2+c3+c4+c5
NUMMRG,NODE, ,
nsel,all


nsel,s,loc,x,g1
nsel,r,loc,y,c1/nc1,c1+c2+c3-c3/nc3
NUMMRG,NODE, ,
nsel,all

nsel,s,loc,x,g1+g2
nsel,r,loc,y,c1/nc1,c1+c2-c2/nc2
NUMMRG,NODE, ,
nsel,all


nsel,s,loc,x,g1+g2
nsel,r,loc,y,c1+c2+c3+c4/nc4,c1+c2+c3+c4+c5
NUMMRG,NODE, ,
```

GOB2.TXT

```
nsel,all

nsel,s,loc,x,g1+g2+g3
nsel,r,loc,y,c1+c2+c3/nc3,c1+c2+c3+c4+c5
NUMMRG,NODE, ,
nsel,all

nsel,s,loc,y,c1
nsel,r,loc,x,0,g1+g2+g3-g3/ng3
NUMMRG,NODE, ,
nsel,all

nsel,s,loc,y,c1+c2
nsel,r,loc,x,0,g1+g2-g2/ng2
NUMMRG,NODE, ,
nsel,all

nsel,s,loc,y,c1+c2+c3
nsel,r,loc,x,0,g1-g1/ng1
NUMMRG,NODE, ,
nsel,all

nsel,s,loc,x,g1
nsel,r,loc,y,-c0,-c0/nc0
NUMMRG,NODE, ,
nsel,all

nsel,s,loc,x,g1+g2
nsel,r,loc,y,-c0,-c0/nc0
NUMMRG,NODE, ,
nsel,all

nsel,s,loc,x,g1+g2+g3
nsel,r,loc,y,-c0,-c0/nc0
NUMMRG,NODE, ,
nsel,all

nsel,s,loc,x,0
NUMMRG,NODE, ,
nsel,all

/PNUM,MAT,1

NUMMRG,NODE, ,

EPLOT


nsel,s,loc,x,0
d,all,ux,0

nsel,s,loc,y,-c0
d,all,uy,0

nsel,s,loc,y,c1+c2+c3+c4+c5
sf,all,pres,1.1*burden

nsel,s,loc,x,g1+g2+g3+w1+p1+w2+p2+w3
sf,all,pres,hstress
```

GOB2.TXT

```
nsel,all


/PNUM,MAT,1

/PSF,PRES,NORM,2
/PBF,DEFA, ,1
/PSYMB,CS,0
/PSYMB,NDIR,0
/PSYMB,ESYS,0
/PSYMB,LDIR,0
/PSYMB,LAYR,0
!*
/PBC,ALL,,1
/PBC,NFOR,,0
/PBC,NMOM,,0
/PBC,RFOR,,0
/PBC,RMOM,,0
/REPLOT
!*


/SOLU
FINISH
/SOLU
/STAT,SOLU
SOLVE
/dscale,1,1
/PLOPTS,INFO,ON
/POST1
FINISH
/POST1
PLNSOL,S,X
PLNSOL,S,Y
PLNSOL,S,XY
/PNUM,KP,0
/PNUM,LINE,0
/PNUM,AREA,1
/PNUM,VOLU,0
/PNUM,NODE,0
/PNUM,SVAL,0
/NUM,0
!*
/PNUM,MAT,0
!
!*
PLVECT,S
```

GOB3.TXT

```
!Model for 2-D, three entry system with a mined out gob
/prep7
/title
/nopr
antype,static


/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,burden,'overburden thickness',400
*ask,hstress,'in-situ horizontal stress',600

*ask,ymfh,'floor hori. Youngs modul(#1)',2.0e5
*ask,ymfv,'floor vertical Youngs modulus',1.0e5
uimp,1,ex,ey,ez,ymfh,ymfv,ymfh,

*ask,ymgob,'gob youngs modul(#2)',1e4
uimp,2,ex,ey,ez,ymgob,ymgob,ymgob,

*ask,ymr1h,'hori.Youngs modul(#3) above gob',1.5e6
*ask,ymr1v,'vertical youngs modulus',5.35e5
uimp,3,ex,ey,ez,ymr1h,ymr1v,ymr1h,

*ask,ymr2h,'hori.Youngs modul(#4) above gob',1.5e6
*ask,ymr2v,'vertical youngs modulus',5.35e5
uimp,4,ex,ey,ez,ymr1h,ymr2v,ymr2h,

*ask,ymr3h,'hori.Youngs modul(#5) above gob',1.5e6
*ask,ymr3v,'vertical youngs modulus',5.35e5
uimp,5,ex,ey,ez,ymr1h,ymr3v,ymr3h,

*ask,ymr4h,'hori.Youngs modul(#6) above gob',1.5e6
*ask,ymr4v,'vertical youngs modulus',5.35e5
uimp,6,ex,ey,ez,ymr1h,ymr4v,ymr4h,

*ask,ymc,'coal Youngs modul(#7)',3.1e5
uimp,7,ex,ey,ez,ymc,ymc,ymc,

*ask,g1,'gob area 1 width',50*12
*ask,g2,'gob area 2 width',50*12
*ask,g3,'gob area 3 width',50*12

*ask,p1,'entry 1 width', 17*12
*ask,p2,'entry 2 width', 17*12

*ask,w1,'pillar 1 width',68*12
*ask,w2,'pillar 2 width', 68*12
*ask,w3,'solid coal width', 150*12


*ask,c0,'floor thickness',80*12
*ask,c1,'coal thickness',6*12
```

GOB3.TXT

```
*ask,c2,'roof thickness',25*12
*ask,c3,'roof thickness',25*12
*ask,c4,'roof thickness',25*12
*ask,c5,'roof thickness',80*12


rect,0,g1,0,c1+c2+c3+c4
rect,g1,g1+g2,0,c1+c2+c3
rect,g1+g2,g1+g2+g3,0,c1+c2
rect,g1+g2+g3,g1+g2+g3+w1,0,c1
rect,g1+g2+g3+w1+p1,g1+g2+g3+w1+p1+w2,0,c1
rect,g1+g2+g3+w1+p1+w2+p2,g1+g2+g3+w1+p1+w2+p2+w3,0,c1
rect,g1+g2+g3,g1+g2+g3+w1+p1+w2+p2+w3,c1,c1+c2
rect,g1+g2,g1+g2+g3+w1+p1+w2+p2+w3,c1+c2,c1+c2+c3
rect,g1,g1+g2+g3+w1+p1+w2+p2+w3,c1+c2+c3,c1+c2+c3+c4
rect,0,g1+g2+g3+w1+p1+w2+p2+w3,c1+c2+c3+c4,c1+c2+c3+c4+c5
rect,0,g1+g2+g3+w1+p1+w2+p2+w3,-c0,0

aplot

/pnum,area,1
/replot

ET,1,PLANE42
KEYOPT,1,1,0
KEYOPT,1,2,0
KEYOPT,1,3,2
KEYOPT,1,5,0
KEYOPT,1,6,0
!*

*ask,ng1,'# elem. gob area 1 widthwise',4
*ask,ng2,'# elem. gob area 2 widthwise',4
*ask,ng3,'# elem. gob area 3 widthwise',4
*ask,nw1,'# elem. pillar 1 widthwise',6
*ask,nw2,'# elem. pillar 2 widthwise',6
*ask,nw3,'# elem. solid coal widthwise',10
*ask,np1,'# elem. entry widthwise',6
*ask,np2,'# elem. entry widthwise',6
*ask,nc1,'# elem. coal c1 heightwise',4
*ask,nc2,'# elem. roof c2 heightwise',6
*ask,nc3,'# elem. roof c3 heightwise',6
*ask,nc4,'# elem. roof c4 heightwise',6
*ask,nc5,'# elem. roof c5 heightwise',6
*ask,nc0,'# elem. floor heightwise',6

n,1,0,-c0
n,ng1+1,g1,-c0
fill

ngen,nc0+1,ng1+1,1,ng1+1,,,c0/nc0
ngen,nc1+1,ng1+1,(ng1+1)*(nc0)+1,(ng1+1)*(nc0)+ng1+1,,,0
ngen,nc1+1,ng1+1,(ng1+1)*(nc0+1)+1,(ng1+1)*(nc0+1)+ng1+1,,,c1/nc1
ngen,nc2+1,ng1+1,(ng1+1)*(nc0+nc1+1)+1,(ng1+1)*(nc0+nc1+1)+ng1+1,,,0
ngen,nc2+1,ng1+1,(ng1+1)*(nc0+nc1+2)+1,(ng1+1)*(nc0+nc1+2)+ng1+1,,,c2/nc2
ngen,nc3+1,ng1+1,(ng1+1)*(nc0+nc1+nc2+2)+1,(ng1+1)*(nc0+nc1+nc2+2)+ng1+1,,,0
ngen,nc3+1,ng1+1,(ng1+1)*(nc0+nc1+nc2+3)+1,(ng1+1)*(nc0+nc1+nc2+3)+ng1+1,,,c3
/nc3
ngen,nc4+1,ng1+1,(ng1+1)*(nc0+nc1+nc2+nc3+3)+1,(ng1+1)*(nc0+nc1+nc2+nc3+3)+ng
1+1,,,0
ngen,nc4+1,ng1+1,(ng1+1)*(nc0+nc1+nc2+nc3+4)+1,(ng1+1)*(nc0+nc1+nc2+nc3+4)+ng
1+1,,,c4/nc4
```

GOB3.TXT

```
ngen,nc5+1,ng1+1,(ng1+1)*(nc0+nc1+nc2+nc3+nc4+4)+1,(ng1+1)*(nc0+nc1+nc2+nc3+n
c4+4)+ng1+1,,,0
ngen,nc5+1,ng1+1,(ng1+1)*(nc0+nc1+nc2+nc3+nc4+5)+1,(ng1+1)*(nc0+nc1+nc2+nc3+n
c4+5)+ng1+1,,,c5/nc5

nt1=(ng1+1)*(nc0+nc1+nc2+nc3+nc4+nc5+6)

n,nt1+1,g1,-c0
n,nt1+ng2+1,g1+g2,-c0
fill

ngen,nc0+1,ng2+1,nt1+1,nt1+ng2+1,,,c0/nc0
ngen,nc1+1,ng2+1,nt1+(ng2+1)*(nc0)+1,nt1+(ng2+1)*(nc0)+ng2+1,,,0
ngen,nc1+1,ng2+1,nt1+(ng2+1)*(nc0+1)+1,nt1+(ng2+1)*(nc0+1)+ng2+1,,,c1/nc1
ngen,nc2+1,ng2+1,nt1+(ng2+1)*(nc0+nc1+1)+1,nt1+(ng2+1)*(nc0+nc1+1)+ng2+1,,,0
ngen,nc2+1,ng2+1,nt1+(ng2+1)*(nc0+nc1+2)+1,nt1+(ng2+1)*(nc0+nc1+2)+ng2+1,,,c2
/nc2
ngen,nc3+1,ng2+1,nt1+(ng2+1)*(nc0+nc1+nc2+2)+1,nt1+(ng2+1)*(nc0+nc1+nc2+2)+ng
2+1,,,0
ngen,nc3+1,ng2+1,nt1+(ng2+1)*(nc0+nc1+nc2+3)+1,nt1+(ng2+1)*(nc0+nc1+nc2+3)+ng
2+1,,,c3/nc3
ngen,nc4+1,ng2+1,nt1+(ng2+1)*(nc0+nc1+nc2+nc3+3)+1,nt1+(ng2+1)*(nc0+nc1+nc2+n
c3+3)+ng2+1,,,0
ngen,nc4+1,ng2+1,nt1+(ng2+1)*(nc0+nc1+nc2+nc3+4)+1,nt1+(ng2+1)*(nc0+nc1+nc2+n
c3+4)+ng2+1,,,c4/nc4
ngen,nc5+1,ng2+1,nt1+(ng2+1)*(nc0+nc1+nc2+nc3+nc4+4)+1,nt1+(ng2+1)*(nc0+nc1+n
c2+nc3+nc4+4)+ng2+1,,,c5/nc5

nt2=nt1+(ng2+1)*(nc0+nc1+nc2+nc3+nc4+nc5+5)

n,nt2+1,g1+g2,-c0
n,nt2+ng3+1,g1+g2+g3,-c0
fill

ngen,nc0+1,ng3+1,nt2+1,nt2+ng3+1,,,c0/nc0
ngen,nc1+1,ng3+1,nt2+(ng3+1)*(nc0)+1,nt2+(ng3+1)*(nc0)+ng3+1,,,0
ngen,nc1+1,ng3+1,nt2+(ng3+1)*(nc0+1)+1,nt2+(ng3+1)*(nc0+1)+ng3+1,,,c1/nc1
ngen,nc2+1,ng3+1,nt2+(ng3+1)*(nc0+nc1+1)+1,nt2+(ng3+1)*(nc0+nc1+1)+ng3+1,,,0
ngen,nc2+1,ng3+1,nt2+(ng3+1)*(nc0+nc1+2)+1,nt2+(ng3+1)*(nc0+nc1+2)+ng3+1,,,c2
/nc2
ngen,nc3+1,ng3+1,nt2+(ng3+1)*(nc0+nc1+nc2+2)+1,nt2+(ng3+1)*(nc0+nc1+nc2+2)+ng
3+1,,,0
ngen,nc3+1,ng3+1,nt2+(ng3+1)*(nc0+nc1+nc2+3)+1,nt2+(ng3+1)*(nc0+nc1+nc2+3)+ng
3+1,,,c3/nc3
ngen,nc4+1,ng3+1,nt2+(ng3+1)*(nc0+nc1+nc2+nc3+3)+1,nt2+(ng3+1)*(nc0+nc1+nc2+n
c3+3)+ng3+1,,,c4/nc4
ngen,nc5+1,ng3+1,nt2+(ng3+1)*(nc0+nc1+nc2+nc3+nc4+3)+1,nt2+(ng3+1)*(nc0+nc1+n
c2+nc3+nc4+3)+ng3+1,,,c5/nc5


nt3=nt2+(ng3+1)*(nc0+nc1+nc2+nc3+nc4+nc5+4)

n,nt3+1,g1+g2+g3,-c0
n,nt3+nw1+1,g1+g2+g3+w1,-c0
fill

ngen,nc0+1,nw1+1,nt3+1,nt3+nw1+1,,,c0/nc0
ngen,nc1+1,nw1+1,nt3+(nw1+1)*nc0+1,nt3+(nw1+1)*nc0+nw1+1,,,c1/nc1
ngen,nc2+1,nw1+1,nt3+(nw1+1)*(nc0+nc1)+1,nt3+(nw1+1)*(nc0+nc1)+nw1+1,,,c2/nc2
ngen,nc3+1,nw1+1,nt3+(nw1+1)*(nc0+nc1+nc2)+1,nt3+(nw1+1)*(nc0+nc1+nc2)+nw1+1,
,,c3/nc3
ngen,nc4+1,nw1+1,nt3+(nw1+1)*(nc0+nc1+nc2+nc3)+1,nt3+(nw1+1)*(nc0+nc1+nc2+nc3
```

GOB3.TXT

```
)+nw1+1,,,c4/nc4
ngen,nc5+1,nw1+1,nt3+(nw1+1)*(nc0+nc1+nc2+nc3+nc4)+1,nt3+(nw1+1)*(nc0+nc1+nc2
+nc3+nc4)+nw1+1,,,c5/nc5


nt4=nt3+(nw1+1)*(nc0+nc1+nc2+nc3+nc4+nc5+1)

n,nt4+1,g1+g2+g3+w1,-c0
n,nt4+np1+1,g1+g2+g3+w1+p1,-c0
fill

ngen,nc0+1,np1+1,nt4+1,nt4+np1+1,,,c0/nc0

nt5=nt4+(np1+1)*(nc0+1)

n,nt5+1,g1+g2+g3+w1,c1
n,nt5+np1+1,g1+g2+g3+w1+p1,c1
fill

ngen,nc2+1,np1+1,nt5+1,nt5+np1+1,,,c2/nc2
ngen,nc3+1,np1+1,nt5+(np1+1)*(nc2)+1,nt5+(np1+1)*(nc2)+np1+1,,,c3/nc3
ngen,nc4+1,np1+1,nt5+(np1+1)*(nc2+nc3)+1,nt5+(np1+1)*(nc2+nc3)+np1+1,,,c4/nc4
ngen,nc5+1,np1+1,nt5+(np1+1)*(nc2+nc3+nc4)+1,nt5+(np1+1)*(nc2+nc3+nc4)+np1+1,
,,c5/nc5


nt6=nt5+(np1+1)*(nc2+nc3+nc4+nc5+1)

n,nt6+1,g1+g2+g3+w1+p1,-c0                          ! tailgate pillar column (flo
or, pillar, roof)
n,nt6+nw2+1,g1+g2+g3+w1+p1+w2,-c0
fill

ngen,nc0+1,nw2+1,nt6+1,nt6+nw2+1,,,c0/nc0
ngen,nc1+1,nw2+1,nt6+(nw2+1)*nc0+1,nt6+(nw2+1)*nc0+nw2+1,,,c1/nc1
ngen,nc2+1,nw2+1,nt6+(nw2+1)*(nc0+nc1)+1,nt6+(nw2+1)*(nc0+nc1)+nw2+1,,,c2/nc2
ngen,nc3+1,nw2+1,nt6+(nw2+1)*(nc0+nc1+nc2)+1,nt6+(nw2+1)*(nc0+nc1+nc2)+nw2+1,
,,c3/nc3
ngen,nc4+1,nw2+1,nt6+(nw2+1)*(nc0+nc1+nc2+nc3)+1,nt6+(nw2+1)*(nc0+nc1+nc2+nc3
)+nw2+1,,,c4/nc4
ngen,nc5+1,nw2+1,nt6+(nw2+1)*(nc0+nc1+nc2+nc3+nc4)+1,nt6+(nw2+1)*(nc0+nc1+nc2
+nc3+nc4)+nw2+1,,,c5/nc5

nt7=nt6+(nw2+1)*(nc0+nc1+nc2+nc3+nc4+nc5+1)

n,nt7+1,g1+g2+g3+w1+p1+w2,-c0
n,nt7+np2+1,g1+g2+g3+w1+p1+w2+p2,-c0
fill

ngen,nc0+1,np2+1,nt7+1,nt7+np2+1,,,c0/nc0

nt8=nt7+(np2+1)*(nc0+1)


n,nt8+1,g1+g2+g3+w1+p1+w2,c1              !tailgate entry roof
n,nt8+np2+1,g1+g2+g3+w1+p1+w2+p2,c1
fill

ngen,nc2+1,np2+1,nt8+1,nt8+np2+1,,,c2/nc2
ngen,nc3+1,np2+1,nt8+(np2+1)*(nc2)+1,nt8+(np2+1)*(nc2)+np2+1,,,c3/nc3
ngen,nc4+1,np2+1,nt8+(np2+1)*(nc2+nc3)+1,nt8+(np2+1)*(nc2+nc3)+np2+1,,,c4/nc4
```

GOB3.TXT

```
ngen,nc5+1,np2+1,nt8+(np2+1)*(nc2+nc3+nc4)+1,nt8+(np2+1)*(nc2+nc3+nc4)+np2+1,
,,c5/nc5


nt9=nt8+(np2+1)*(nc2+nc3+nc4+nc5+1)

n,nt9+1,g1+g2+g3+w1+p1+w2+p2,-c0
n,nt9+nw3+1,g1+g2+g3+w1+p1+w2+p2+w3,-c0
fill,nt9+1,nt9+nw3+1,,,,,,3

ngen,nc0+1,nw3+1,nt9+1,nt9+nw3+1,,,c0/nc0
ngen,nc1+1,nw3+1,nt9+(nw3+1)*nc0+1,nt9+(nw3+1)*nc0+nw3+1,,,c1/nc1
ngen,nc2+1,nw3+1,nt9+(nw3+1)*(nc0+nc1)+1,nt9+(nw3+1)*(nc0+nc1)+nw3+1,,,c2/nc2
ngen,nc3+1,nw3+1,nt9+(nw3+1)*(nc0+nc1+nc2)+1,nt9+(nw3+1)*(nc0+nc1+nc2)+nw3+1,
,,c3/nc3
ngen,nc4+1,nw3+1,nt9+(nw3+1)*(nc0+nc1+nc2+nc3)+1,nt9+(nw3+1)*(nc0+nc1+nc2+nc3
)+nw3+1,,,c4/nc4
ngen,nc5+1,nw3+1,nt9+(nw3+1)*(nc0+nc1+nc2+nc3+nc4)+1,nt9+(nw3+1)*(nc0+nc1+nc2
+nc3+nc4)+nw3+1,,,c5/nc5



mat,1
e,1,2,(ng1+1)+2,(ng1+1)+1        ! generate element on the gob side
egen,ng1,1,-1
egen,nc0,(ng1+1),-ng1


e,(ng1+1)*(nc0+1)+1,(ng1+1)*(nc0+1)+2,(ng1+1)*(nc0+1)+(ng1+1)+2,(ng1+1)*(nc0+
1)+(ng1+1)+1
egen,ng1,1,-1
egen,nc1,ng1+1,-ng1


e,(ng1+1)*(nc0+nc1+2)+1,(ng1+1)*(nc0+nc1+2)+2,(ng1+1)*(nc0+nc1+2)+(ng1+1)+2,(
ng1+1)*(nc0+nc1+2)+(ng1+1)+1
egen,ng1,1,-1
egen,nc2,ng1+1,-ng1


e,(ng1+1)*(nc0+nc1+nc2+3)+1,(ng1+1)*(nc0+nc1+nc2+3)+2,(ng1+1)*(nc0+nc1+nc2+3)
+(ng1+1)+2,(ng1+1)*(nc0+nc1+nc2+3)+(ng1+1)+1
egen,ng1,1,-1
egen,nc3,ng1+1,-ng1

a1=nc0+nc1+nc2+nc3+4

e,(ng1+1)*a1+1,(ng1+1)*a1 +2,(ng1+1)*a1+(ng1+1)+2,(ng1+1)*a1+(ng1+1)+1
egen,ng1,1,-1
egen,nc4,ng1+1,-ng1

a2=nc0+nc1+nc2+nc3+nc4+5
e,(ng1+1)*a2+1,(ng1+1)*a2+2,(ng1+1)*a2+(ng1+1)+2,(ng1+1)*a2+(ng1+1)+1
egen,ng1,1,-1
egen,nc5,ng1+1,-ng1


e,nt1+1,nt1+2,nt1+ng2+3,nt1+ng2+2
egen,ng2,1,-1
egen,nc0,ng2+1,-ng2

e,nt1+(ng2+1)*(nc0+1)+1,nt1+(ng2+1)*(nc0+1)+2,nt1+(ng2+1)*(nc0+1)+(ng2+1)+2,n
```

GOB3.TXT

```
t1+(ng2+1)*(nc0+1)+(ng2+1)+1
egen,ng2,1,-1
egen,nc1,ng2+1,-ng2

e,nt1+(ng2+1)*(nc0+nc1+2)+1,nt1+(ng2+1)*(nc0+nc1+2)+2,nt1+(ng2+1)*(nc0+nc1+2)
+(ng2+1)+2,nt1+(ng2+1)*(nc0+nc1+2)+(ng2+1)+1
egen,ng2,1,-1
egen,nc2,ng2+1,-ng2

a4=nc0+nc1+nc2+3

e,nt1+(ng2+1)*a4+1,nt1+(ng2+1)*a4+2,nt1+(ng2+1)*a4+(ng2+1)+2,nt1+(ng2+1)*a4+(
ng2+1)+1
egen,ng2,1,-1
egen,nc3,ng2+1,-ng2

a3=nc0+nc1+nc2+nc3+4

e,nt1+(ng2+1)*a3+1,nt1+(ng2+1)*a3 +2,nt1+(ng2+1)*a3+(ng2+1)+2,nt1+(ng2+1)*a3+
(ng2+1)+1
egen,ng2,1,-1
egen,nc4,ng2+1,-ng2

a5=nc0+nc1+nc2+nc3+nc4+4
e,nt1+(ng2+1)*a5+1,nt1+(ng2+1)*a5+2,nt1+(ng2+1)*a5+(ng2+1)+2,nt1+(ng2+1)*a5+(
ng2+1)+1
egen,ng2,1,-1
egen,nc5,ng2+1,-ng2


e,nt2+1,nt2+2,nt2+ng3+3,nt2+ng3+2                !g3 area column
egen,ng3,1,-1
egen,nc0,ng3+1,-ng3

e,nt2+(ng3+1)*(nc0+1)+1,nt2+(ng3+1)*(nc0+1)+2,nt2+(ng3+1)*(nc0+1)+(ng3+1)+2,n
t2+(ng3+1)*(nc0+1)+(ng3+1)+1
egen,ng3,1,-1
egen,nc1,ng3+1,-ng3

e,nt2+(ng3+1)*(nc0+nc1+2)+1,nt2+(ng3+1)*(nc0+nc1+2)+2,nt2+(ng3+1)*(nc0+nc1+2)
+(ng3+1)+2,nt2+(ng3+1)*(nc0+nc1+2)+(ng3+1)+1
egen,ng3,1,-1
egen,nc2,ng3+1,-ng3

a6=nc0+nc1+nc2+3

e,nt2+(ng3+1)*a6+1,nt2+(ng3+1)*a6+2,nt2+(ng3+1)*a6+(ng3+1)+2,nt2+(ng3+1)*a6+(
ng3+1)+1
egen,ng3,1,-1
egen,nc3,ng3+1,-ng3

a7=nc0+nc1+nc2+nc3+3

e,nt2+(ng3+1)*a7+1,nt2+(ng3+1)*a7 +2,nt2+(ng3+1)*a7+(ng3+1)+2,nt2+(ng3+1)*a7+
(ng3+1)+1
egen,ng3,1,-1
egen,nc4,ng3+1,-ng3

a8=nc0+nc1+nc2+nc3+nc4+3
e,nt2+(ng3+1)*a8+1,nt2+(ng3+1)*a8+2,nt2+(ng3+1)*a8+(ng3+1)+2,nt2+(ng3+1)*a8+(
ng3+1)+1
egen,ng3,1,-1
```

GOB3.TXT

```
egen,nc5,ng3+1,-ng3

e,nt3+1,nt3+2,nt3+nw1+3,nt3+nw1+2                !w1 pillar column
egen,nw1,1,-1
egen,(nc0+nc1+nc2+nc3+nc4+nc5),nw1+1,-nw1

e,nt4+1,nt4+2,nt4+np1+3,nt4+np1+2                !entry p1 floor column
egen,np1,1,-1
egen,(nc0),np1+1,-np1

e,nt5+1,nt5+2,nt5+np1+3,nt5+np1+2                !entry p1 roof column
egen,np1,1,-1
egen,(nc2+nc3+nc4+nc5),np1+1,-np1

e,nt6+1,nt6+2,nt6+nw2+3,nt6+nw2+2                !w2 pillar column
egen,nw2,1,-1
egen,(nc0+nc1+nc2+nc3+nc4+nc5),nw2+1,-nw2

e,nt7+1,nt7+2,nt7+np2+3,nt7+np2+2                !entry p2 floor column
egen,np2,1,-1
egen,(nc0),np2+1,-np2

e,nt8+1,nt8+2,nt8+np2+3,nt8+np2+2                !entry p2 roof column
egen,np2,1,-1
egen,(nc2+nc3+nc4+nc5),np2+1,-np2

e,nt9+1,nt9+2,nt9+nw3+3,nt9+nw3+2                !w3 pillar column
egen,nw3,1,-1
egen,(nc0+nc1+nc2+nc3+nc4+nc5),nw3+1,-nw3


esel,s, elem,,ng1*nc0+1,ng1*(nc0+nc1+nc2+nc3+nc4)
emodif,all,mat,2
esel,all

esel,s,elem,,ng1*(nc0+nc1+nc2+nc3+nc4)+1,ng1*(nc0+nc1+nc2+nc3+nc4+nc5)
emodif,all,mat,3
esel,all


s1=ng1*(nc0+nc1+nc2+nc3+nc4+nc5)
esel,s,elem,,s1+ng2*nc0+1,s1+ng2*(nc0+nc1+nc2+nc3)
emodif,all,mat,2
esel,all


esel,s,elem,,s1+ng2*(nc0+nc1+nc2+nc3)+1,s1+ng2*(nc0+nc1+nc2+nc3+nc4)
emodif,all,mat,4
esel,all

esel,s,elem,,s1+ng2*(nc0+nc1+nc2+nc3+nc4)+1,s1+ng2*(nc0+nc1+nc2+nc3+nc4+nc5)
emodif,all,mat,3
esel,all


s2=s1+ng2*(nc0+nc1+nc2+nc3+nc4+nc5)
esel,s,elem,,s2+ng3*nc0+1,s2+ng2*(nc0+nc1+nc2)
```

GOB3.TXT

```
emodif,all,mat,2
esel,all

esel,s,elem,,s2+ng3*(nc0+nc1+nc2)+1,s2+ng3*(nc0+nc1+nc2+nc3)
emodif,all,mat,5
esel,all


esel,s,elem,,s2+ng3*(nc0+nc1+nc2+nc3)+1,s2+ng3*(nc0+nc1+nc2+nc3+nc4)
emodif,all,mat,4
esel,all

esel,s,elem,,s2+ng3*(nc0+nc1+nc2+nc3+nc4)+1,s2+ng3*(nc0+nc1+nc2+nc3+nc4+nc5)
emodif,all,mat,3
esel,all


s3=s2+ng3*(nc0+nc1+nc2+nc3+nc4+nc5)
esel,s,elem,,s3+nw1*nc0+1,s3+nw1*(nc0+nc1)
emodif,all,mat,7
esel,all

esel,s,elem,,s3+nw1*(nc0+nc1)+1,s3+nw1*(nc0+nc1+nc2)
emodif,all,mat,6
esel,all

esel,s,elem,,s3+nw1*(nc0+nc1+nc2)+1,s3+nw1*(nc0+nc1+nc2+nc3)
emodif,all,mat,5
esel,all

esel,s,elem,,s3+nw1*(nc0+nc1+nc2+nc3)+1,s3+nw1*(nc0+nc1+nc2+nc3+nc4)
emodif,all,mat,4
esel,all

esel,s,elem,,s3+nw1*(nc0+nc1+nc2+nc3+nc4)+1,s3+nw1*(nc0+nc1+nc2+nc3+nc4+nc5)
emodif,all,mat,3
esel,all

s4=s3+nw1*(nc0+nc1+nc2+nc3+nc4+nc5)
esel,s,elem,,s4+np1*nc0+1,s4+np1*(nc0+nc2)
emodif,all,mat,6
esel,all

esel,s,elem,,s4+np1*(nc0+nc2)+1,s4+np1*(nc0+nc2+nc3)
emodif,all,mat,5
esel,all

esel,s,elem,,s4+np1*(nc0+nc2+nc3)+1,s4+np1*(nc0+nc2+nc3+nc4)
emodif,all,mat,4
esel,all

esel,s,elem,,s4+np1*(nc0+nc2+nc3+nc4)+1,s4+np1*(nc0+nc2+nc3+nc4+nc5)
emodif,all,mat,3
esel,all

s5=s4+np1*(nc0+nc2+nc3+nc4+nc5)
esel,s,elem,,s5+nw2*nc0+1,s5+nw2*(nc0+nc1)
emodif,all,mat,7
esel,all

esel,s,elem,,s5+nw2*(nc0+nc1)+1,s5+nw2*(nc0+nc1+nc2)
emodif,all,mat,6
```

GOB3.TXT

```
esel,all

esel,s,elem,,s5+nw2*(nc0+nc1+nc2)+1,s5+nw2*(nc0+nc1+nc2+nc3)
emodif,all,mat,5
esel,all

esel,s,elem,,s5+nw2*(nc0+nc1+nc2+nc3)+1,s5+nw2*(nc0+nc1+nc2+nc3+nc4)
emodif,all,mat,4
esel,all

esel,s,elem,,s5+nw2*(nc0+nc1+nc2+nc3+nc4)+1,s5+nw2*(nc0+nc1+nc2+nc3+nc4+nc5)
emodif,all,mat,3
esel,all


s6=s5+nw2*(nc0+nc1+nc2+nc3+nc4+nc5)
esel,s,elem,,s6+np2*nc0+1,s6+np2*(nc0+nc2)
emodif,all,mat,6
esel,all

esel,s,elem,,s6+np2*(nc0+nc2)+1,s6+np2*(nc0+nc2+nc3)
emodif,all,mat,5
esel,all

esel,s,elem,,s6+np2*(nc0+nc2+nc3)+1,s6+np2*(nc0+nc2+nc3+nc4)
emodif,all,mat,4
esel,all

esel,s,elem,,s6+np2*(nc0+nc2+nc3+nc4)+1,s6+np2*(nc0+nc2+nc3+nc4+nc5)
emodif,all,mat,3
esel,all


s7=s6+np2*(nc0+nc2+nc3+nc4+nc5)

esel,s,elem,,s7+nw3*nc0+1,s7+nw3*(nc0+nc1)
emodif,all,mat,7
esel,all

esel,s,elem,,s7+nw3*(nc0+nc1)+1,s7+nw3*(nc0+nc1+nc2)
emodif,all,mat,6
esel,all

esel,s,elem,,s7+nw3*(nc0+nc1+nc2)+1,s7+nw3*(nc0+nc1+nc2+nc3)
emodif,all,mat,5
esel,all

esel,s,elem,,s7+nw3*(nc0+nc1+nc2+nc3)+1,s7+nw3*(nc0+nc1+nc2+nc3+nc4)
emodif,all,mat,4
esel,all

esel,s,elem,,s7+nw3*(nc0+nc1+nc2+nc3+nc4)+1,s7+nw3*(nc0+nc1+nc2+nc3+nc4+nc5)
emodif,all,mat,3
esel,all

nsel,s,loc,x,g1+g2+g3+w1
NUMMRG,NODE, ,
nsel,all

nsel,s,loc,x,g1+g2+g3+w1+p1
NUMMRG,NODE, ,
```

GOB3.TXT

```
nsel,all

nsel,s,loc,x,g1+g2+g3+w1+p1+w2
NUMMRG,NODE, ,
nsel,all

nsel,s,loc,x,g1+g2+g3+w1+p1+w2+p2
NUMMRG,NODE, ,
nsel,all

nsel,s,loc,x,g1
nsel,r,loc,y,c1+c2+c3+c4+c5/nc5,c1+c2+c3+c4+c5
NUMMRG,NODE, ,
nsel,all


nsel,s,loc,x,g1
nsel,r,loc,y,c1/nc1,c1+c2+c3-c3/nc3
NUMMRG,NODE, ,
nsel,all

nsel,s,loc,x,g1+g2
nsel,r,loc,y,c1/nc1,c1+c2-c2/nc2
NUMMRG,NODE, ,
nsel,all


nsel,s,loc,x,g1+g2
nsel,r,loc,y,c1+c2+c3+c4/nc4,c1+c2+c3+c4+c5
NUMMRG,NODE, ,
nsel,all


nsel,s,loc,x,g1+g2+g3
nsel,r,loc,y,c1+c2+c3/nc3,c1+c2+c3+c4+c5
NUMMRG,NODE, ,
nsel,all

nsel,s,loc,y,c1
nsel,r,loc,x,0,g1+g2+g3-g3/ng3
NUMMRG,NODE, ,
nsel,all

nsel,s,loc,y,c1+c2
nsel,r,loc,x,0,g1+g2-g2/ng2
NUMMRG,NODE, ,
nsel,all

nsel,s,loc,y,c1+c2+c3
nsel,r,loc,x,0,g1-g1/ng1
NUMMRG,NODE, ,
nsel,all

nsel,s,loc,x,g1
nsel,r,loc,y,-c0,-c0/nc0
NUMMRG,NODE, ,
nsel,all

nsel,s,loc,x,g1+g2
nsel,r,loc,y,-c0,-c0/nc0
NUMMRG,NODE, ,
nsel,all
```

GOB3.TXT

```
nsel,s,loc,x,g1+g2+g3
nsel,r,loc,y,-c0,-c0/nc0
NUMMRG,NODE, ,
nsel,all

nsel,s,loc,x,0
NUMMRG,NODE, ,
nsel,all

/PNUM,MAT,1

NUMMRG,NODE, ,

EPLOT


nsel,s,loc,x,0
d,all,ux,0

nsel,s,loc,y,-c0
d,all,uy,0

nsel,s,loc,y,c1+c2+c3+c4+c5
sf,all,pres,1.1*burden

nsel,s,loc,x,g1+g2+g3+w1+p1+w2+p2+w3
sf,all,pres,hstress


nsel,all


/PNUM,MAT,1

/PSF,PRES,NORM,2
/PBF,DEFA, ,1
/PSYMB,CS,0
/PSYMB,NDIR,0
/PSYMB,ESYS,0
/PSYMB,LDIR,0
/PSYMB,LAYR,0
!*
/PBC,ALL,,1
/PBC,NFOR,,0
/PBC,NMOM,,0
/PBC,RFOR,,0
/PBC,RMOM,,0
/REPLOT
!*

/SOLU
FINISH
/SOLU
/STAT,SOLU
SOLVE
/dscale,1,1
/PLOPTS,INFO,ON
/POST1
FINISH
```

GOB3.TXT

```
/POST1
PLNSOL,S,X
PLNSOL,S,Y
PLNSOL,S,XY
/PNUM,KP,0
/PNUM,LINE,0
/PNUM,AREA,1
/PNUM,VOLU,0
/PNUM,NODE,0
/PNUM,SVAL,0
/NUM,0
!*
/PNUM,MAT,0
!
!*
PLVECT,S
```

```
!Model for 2-D, four entry system with a mined out gob
/prep7
/title
/nopr
antype,static


/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,burden,'overburden thickness',400
*ask,hstress,'in-situ horizontal stress',600

*ask,ymfh,'floor hori. Youngs modul(#1)',2.0e5
*ask,ymfv,'floor vertical Youngs modulus',1.0e5
uimp,1,ex,ey,ez,ymfh,ymfv,ymfh,

*ask,ymgob,'gob youngs modul(#2)',1e4
uimp,2,ex,ey,ez,ymgob,ymgob,ymgob,

*ask,ymr1h,'hori.Youngs modul(#3) above gob',1.5e6
*ask,ymr1v,'vertical youngs modulus',5.35e5
uimp,3,ex,ey,ez,ymr1h,ymr1v,ymr1h,

*ask,ymr2h,'hori.Youngs modul(#4) above gob',1.5e6
*ask,ymr2v,'vertical youngs modulus',5.35e5
uimp,4,ex,ey,ez,ymr2h,ymr2v,ymr2h,

*ask,ymr3h,'hori.Youngs modul(#5) above gob',1.5e6
*ask,ymr3v,'vertical youngs modulus',5.35e5
uimp,5,ex,ey,ez,ymr3h,ymr3v,ymr3h,

*ask,ymr4h,'hori.Youngs modul(#6) above gob',1.5e6
*ask,ymr4v,'vertical youngs modulus',5.35e5
uimp,6,ex,ey,ez,ymr4h,ymr4v,ymr4h,

*ask,ymc,'coal Youngs modul(#7)',3.1e5
uimp,7,ex,ey,ez,ymc,ymc,ymc,

*ask,g1,'gob area 1 width',50*12
*ask,g2,'gob area 2 width',50*12
*ask,g3,'gob area 3 width',50*12

*ask,p1,'entry 1 width', 17*12
*ask,p2,'entry 2 width', 17*12
```

```
*ask,p3,'entry 3 width', 17*12

*ask,w1,'pillar 1 width',68*12
*ask,w2,'pillar 2 width', 68*12
*ask,w3,'pillar 3 width', 68*12
*ask,w4,'solid coal width', 150*12


*ask,c0,'floor thickness',80*12
*ask,c1,'coal thickness',6*12
*ask,c2,'roof thickness',25*12
*ask,c3,'roof thickness',25*12
*ask,c4,'roof thickness',25*12
*ask,c5,'roof thickness',80*12


rect,0,g1,0,c1+c2+c3+c4
rect,g1,g1+g2,0,c1+c2+c3
rect,g1+g2,g1+g2+g3,0,c1+c2

rect,g1+g2+g3,g1+g2+g3+w1,0,c1
rect,g1+g2+g3+w1+p1,g1+g2+g3+w1+p1+w2,0,c1

rect,g1+g2+g3+w1+p1+w2+p2,g1+g2+g3+w1+p1+w2+p2+w3,0,c1
rect,g1+g2+g3+w1+p1+w2+p2+w3+p3,g1+g2+g3+w1+p1+w2+p2+w3+p3+w4,0,c1

rect,g1+g2+g3,g1+g2+g3+w1+p1+w2+p2+w3+p3+w4,c1,c1+c2
rect,g1+g2,g1+g2+g3+w1+p1+w2+p2+w3+p3+w4,c1+c2,c1+c2+c3
rect,g1,g1+g2+g3+w1+p1+w2+p2+w3+p3+w4,c1+c2+c3,c1+c2+c3+c4
rect,0,g1+g2+g3+w1+p1+w2+p2+w3+p3+w4,c1+c2+c3+c4,c1+c2+c3+c4+c5
rect,0,g1+g2+g3+w1+p1+w2+p2+w3+p3+w4,-c0,0


aplot

/pnum,area,1
/replot

ET,1,PLANE42
KEYOPT,1,1,0
KEYOPT,1,2,0
KEYOPT,1,3,2
KEYOPT,1,5,0
KEYOPT,1,6,0
!*

*ask,ng1,'# elem. gob area 1 widthwise',4
*ask,ng2,'# elem. gob area 2 widthwise',4
*ask,ng3,'# elem. gob area 3 widthwise',4
*ask,nw1,'# elem. pillar 1 widthwise',6
*ask,nw2,'# elem. pillar 2 widthwise',6
*ask,nw3,'# elem. pillar 3 widthwise',6
*ask,nw4,'# elem. solid coal widthwise',10
```

```
*ask,np1,'# elem. entry widthwise',6
*ask,np2,'# elem. entry widthwise',6
*ask,np3,'# elem. entry widthwise',6
*ask,nc1,'# elem. coal c1 heightwise',4
*ask,nc2,'# elem. roof c2 heightwise',6
*ask,nc3,'# elem. roof c3 heightwise',6
*ask,nc4,'# elem. roof c4 heightwise',6
*ask,nc5,'# elem. roof c5 heightwise',6
*ask,nc0,'# elem. floor heightwise',6

n,1,0,-c0
n,ng1+1,g1,-c0
fill

ngen,nc0+1,ng1+1,1,ng1+1,,,c0/nc0
ngen,nc1+1,ng1+1,(ng1+1)*(nc0)+1,(ng1+1)*(nc0)+ng1+1,,,0
ngen,nc1+1,ng1+1,(ng1+1)*(nc0+1)+1,(ng1+1)*(nc0+1)+ng1+1,,,c1/nc1
ngen,nc2+1,ng1+1,(ng1+1)*(nc0+nc1+1)+1,(ng1+1)*(nc0+nc1+1)+ng1+1,
,,0
ngen,nc2+1,ng1+1,(ng1+1)*(nc0+nc1+2)+1,(ng1+1)*(nc0+nc1+2)+ng1+1,
,,c2/nc2
ngen,nc3+1,ng1+1,(ng1+1)*(nc0+nc1+nc2+2)+1,(ng1+1)*(nc0+nc1+nc2+2
)+ng1+1,,,0
ngen,nc3+1,ng1+1,(ng1+1)*(nc0+nc1+nc2+3)+1,(ng1+1)*(nc0+nc1+nc2+3
)+ng1+1,,,c3/nc3
ngen,nc4+1,ng1+1,(ng1+1)*(nc0+nc1+nc2+nc3+3)+1,(ng1+1)*(nc0+nc1+n
c2+nc3+3)+ng1+1,,,0
ngen,nc4+1,ng1+1,(ng1+1)*(nc0+nc1+nc2+nc3+4)+1,(ng1+1)*(nc0+nc1+n
c2+nc3+4)+ng1+1,,,c4/nc4
ngen,nc5+1,ng1+1,(ng1+1)*(nc0+nc1+nc2+nc3+nc4+4)+1,(ng1+1)*(nc0+n
c1+nc2+nc3+nc4+4)+ng1+1,,,0
ngen,nc5+1,ng1+1,(ng1+1)*(nc0+nc1+nc2+nc3+nc4+5)+1,(ng1+1)*(nc0+n
c1+nc2+nc3+nc4+5)+ng1+1,,,c5/nc5

nt1=(ng1+1)*(nc0+nc1+nc2+nc3+nc4+nc5+6)

n,nt1+1,g1,-c0
n,nt1+ng2+1,g1+g2,-c0
fill

ngen,nc0+1,ng2+1,nt1+1,nt1+ng2+1,,,c0/nc0
ngen,nc1+1,ng2+1,nt1+(ng2+1)*(nc0)+1,nt1+(ng2+1)*(nc0)+ng2+1,,,0
ngen,nc1+1,ng2+1,nt1+(ng2+1)*(nc0+1)+1,nt1+(ng2+1)*(nc0+1)+ng2+1,
,,c1/nc1
ngen,nc2+1,ng2+1,nt1+(ng2+1)*(nc0+nc1+1)+1,nt1+(ng2+1)*(nc0+nc1+1
)+ng2+1,,,0
ngen,nc2+1,ng2+1,nt1+(ng2+1)*(nc0+nc1+2)+1,nt1+(ng2+1)*(nc0+nc1+2
)+ng2+1,,,c2/nc2
ngen,nc3+1,ng2+1,nt1+(ng2+1)*(nc0+nc1+nc2+2)+1,nt1+(ng2+1)*(nc0+n
c1+nc2+2)+ng2+1,,,0
ngen,nc3+1,ng2+1,nt1+(ng2+1)*(nc0+nc1+nc2+3)+1,nt1+(ng2+1)*(nc0+n
c1+nc2+3)+ng2+1,,,c3/nc3
ngen,nc4+1,ng2+1,nt1+(ng2+1)*(nc0+nc1+nc2+nc3+3)+1,nt1+(ng2+1)*(n
c0+nc1+nc2+nc3+3)+ng2+1,,,0
```

```
ngen,nc4+1,ng2+1,nt1+(ng2+1)*(nc0+nc1+nc2+nc3+4)+1,nt1+(ng2+1)*(n
c0+nc1+nc2+nc3+4)+ng2+1,,,c4/nc4
ngen,nc5+1,ng2+1,nt1+(ng2+1)*(nc0+nc1+nc2+nc3+nc4+4)+1,nt1+(ng2+1
)*(nc0+nc1+nc2+nc3+nc4+4)+ng2+1,,,c5/nc5

nt2=nt1+(ng2+1)*(nc0+nc1+nc2+nc3+nc4+nc5+5)

n,nt2+1,g1+g2,-c0
n,nt2+ng3+1,g1+g2+g3,-c0
fill

ngen,nc0+1,ng3+1,nt2+1,nt2+ng3+1,,,c0/nc0
ngen,nc1+1,ng3+1,nt2+(ng3+1)*(nc0)+1,nt2+(ng3+1)*(nc0)+ng3+1,,,0
ngen,nc1+1,ng3+1,nt2+(ng3+1)*(nc0+1)+1,nt2+(ng3+1)*(nc0+1)+ng3+1,
,,c1/nc1
ngen,nc2+1,ng3+1,nt2+(ng3+1)*(nc0+nc1+1)+1,nt2+(ng3+1)*(nc0+nc1+1
)+ng3+1,,,0
ngen,nc2+1,ng3+1,nt2+(ng3+1)*(nc0+nc1+2)+1,nt2+(ng3+1)*(nc0+nc1+2
)+ng3+1,,,c2/nc2
ngen,nc3+1,ng3+1,nt2+(ng3+1)*(nc0+nc1+nc2+2)+1,nt2+(ng3+1)*(nc0+n
c1+nc2+2)+ng3+1,,,0
ngen,nc3+1,ng3+1,nt2+(ng3+1)*(nc0+nc1+nc2+3)+1,nt2+(ng3+1)*(nc0+n
c1+nc2+3)+ng3+1,,,c3/nc3
ngen,nc4+1,ng3+1,nt2+(ng3+1)*(nc0+nc1+nc2+nc3+3)+1,nt2+(ng3+1)*(n
c0+nc1+nc2+nc3+3)+ng3+1,,,c4/nc4
ngen,nc5+1,ng3+1,nt2+(ng3+1)*(nc0+nc1+nc2+nc3+nc4+3)+1,nt2+(ng3+1
)*(nc0+nc1+nc2+nc3+nc4+3)+ng3+1,,,c5/nc5


nt3=nt2+(ng3+1)*(nc0+nc1+nc2+nc3+nc4+nc5+4)

n,nt3+1,g1+g2+g3,-c0
n,nt3+nw1+1,g1+g2+g3+w1,-c0
fill

ngen,nc0+1,nw1+1,nt3+1,nt3+nw1+1,,,c0/nc0
ngen,nc1+1,nw1+1,nt3+(nw1+1)*nc0+1,nt3+(nw1+1)*nc0+nw1+1,,,c1/nc1
ngen,nc2+1,nw1+1,nt3+(nw1+1)*(nc0+nc1)+1,nt3+(nw1+1)*(nc0+nc1)+nw
1+1,,,c2/nc2
ngen,nc3+1,nw1+1,nt3+(nw1+1)*(nc0+nc1+nc2)+1,nt3+(nw1+1)*(nc0+nc1
+nc2)+nw1+1,,,c3/nc3
ngen,nc4+1,nw1+1,nt3+(nw1+1)*(nc0+nc1+nc2+nc3)+1,nt3+(nw1+1)*(nc0
+nc1+nc2+nc3)+nw1+1,,,c4/nc4
ngen,nc5+1,nw1+1,nt3+(nw1+1)*(nc0+nc1+nc2+nc3+nc4)+1,nt3+(nw1+1)*
(nc0+nc1+nc2+nc3+nc4)+nw1+1,,,c5/nc5


nt4=nt3+(nw1+1)*(nc0+nc1+nc2+nc3+nc4+nc5+1)

n,nt4+1,g1+g2+g3+w1,-c0
n,nt4+np1+1,g1+g2+g3+w1+p1,-c0
fill
```

```
ngen,nc0+1,np1+1,nt4+1,nt4+np1+1,,,c0/nc0

nt5=nt4+(np1+1)*(nc0+1)

n,nt5+1,g1+g2+g3+w1,c1
n,nt5+np1+1,g1+g2+g3+w1+p1,c1
fill

ngen,nc2+1,np1+1,nt5+1,nt5+np1+1,,,c2/nc2
ngen,nc3+1,np1+1,nt5+(np1+1)*(nc2)+1,nt5+(np1+1)*(nc2)+np1+1,,,c3
/nc3
ngen,nc4+1,np1+1,nt5+(np1+1)*(nc2+nc3)+1,nt5+(np1+1)*(nc2+nc3)+np
1+1,,,c4/nc4
ngen,nc5+1,np1+1,nt5+(np1+1)*(nc2+nc3+nc4)+1,nt5+(np1+1)*(nc2+nc3
+nc4)+np1+1,,,c5/nc5


nt6=nt5+(np1+1)*(nc2+nc3+nc4+nc5+1)

n,nt6+1,g1+g2+g3+w1+p1,-c0              ! tailgate pillar column
(floor, pillar, roof)
n,nt6+nw2+1,g1+g2+g3+w1+p1+w2,-c0
fill

ngen,nc0+1,nw2+1,nt6+1,nt6+nw2+1,,,c0/nc0
ngen,nc1+1,nw2+1,nt6+(nw2+1)*nc0+1,nt6+(nw2+1)*nc0+nw2+1,,,c1/nc1
ngen,nc2+1,nw2+1,nt6+(nw2+1)*(nc0+nc1)+1,nt6+(nw2+1)*(nc0+nc1)+nw
2+1,,,c2/nc2
ngen,nc3+1,nw2+1,nt6+(nw2+1)*(nc0+nc1+nc2)+1,nt6+(nw2+1)*(nc0+nc1
+nc2)+nw2+1,,,c3/nc3
ngen,nc4+1,nw2+1,nt6+(nw2+1)*(nc0+nc1+nc2+nc3)+1,nt6+(nw2+1)*(nc0
+nc1+nc2+nc3)+nw2+1,,,c4/nc4
ngen,nc5+1,nw2+1,nt6+(nw2+1)*(nc0+nc1+nc2+nc3+nc4)+1,nt6+(nw2+1)*
(nc0+nc1+nc2+nc3+nc4)+nw2+1,,,c5/nc5

nt7=nt6+(nw2+1)*(nc0+nc1+nc2+nc3+nc4+nc5+1)

n,nt7+1,g1+g2+g3+w1+p1+w2,-c0
n,nt7+np2+1,g1+g2+g3+w1+p1+w2+p2,-c0
fill

ngen,nc0+1,np2+1,nt7+1,nt7+np2+1,,,c0/nc0


nt8=nt7+(np2+1)*(nc0+1)

n,nt8+1,g1+g2+g3+w1+p1+w2,c1        !entry next to tailgate entry
roof
n,nt8+np2+1,g1+g2+g3+w1+p1+w2+p2,c1
fill

ngen,nc2+1,np2+1,nt8+1,nt8+np2+1,,,c2/nc2
ngen,nc3+1,np2+1,nt8+(np2+1)*(nc2)+1,nt8+(np2+1)*(nc2)+np2+1,,,c3
/nc3
```

```
ngen,nc4+1,np2+1,nt8+(np2+1)*(nc2+nc3)+1,nt8+(np2+1)*(nc2+nc3)+np
2+1,,,c4/nc4
ngen,nc5+1,np2+1,nt8+(np2+1)*(nc2+nc3+nc4)+1,nt8+(np2+1)*(nc2+nc3
+nc4)+np2+1,,,c5/nc5


nt9=nt8+(np2+1)*(nc2+nc3+nc4+nc5+1)

n,nt9+1,g1+g2+g3+w1+p1+w2+p2,-c0
n,nt9+nw3+1,g1+g2+g3+w1+p1+w2+p2+w3,-c0
fill

ngen,nc0+1,nw3+1,nt9+1,nt9+nw3+1,,,c0/nc0
ngen,nc1+1,nw3+1,nt9+(nw3+1)*nc0+1,nt9+(nw3+1)*nc0+nw3+1,,,c1/nc1
ngen,nc2+1,nw3+1,nt9+(nw3+1)*(nc0+nc1)+1,nt9+(nw3+1)*(nc0+nc1)+nw
3+1,,,c2/nc2
ngen,nc3+1,nw3+1,nt9+(nw3+1)*(nc0+nc1+nc2)+1,nt9+(nw3+1)*(nc0+nc1
+nc2)+nw3+1,,,c3/nc3
ngen,nc4+1,nw3+1,nt9+(nw3+1)*(nc0+nc1+nc2+nc3)+1,nt9+(nw3+1)*(nc0
+nc1+nc2+nc3)+nw3+1,,,c4/nc4
ngen,nc5+1,nw3+1,nt9+(nw3+1)*(nc0+nc1+nc2+nc3+nc4)+1,nt9+(nw3+1)*
(nc0+nc1+nc2+nc3+nc4)+nw3+1,,,c5/nc5


nt10=nt9+(nw3+1)*(nc0+nc1+nc2+nc3+nc4+nc5+1)

n,nt10+1,g1+g2+g3+w1+p1+w2+p2+w3,-c0          !tailgate entry floor
n,nt10+np3+1,g1+g2+g3+w1+p1+w2+p2+w3+p3,-c0
fill

ngen,nc0+1,np3+1,nt10+1,nt10+np3+1,,,c0/nc0


nt11=nt10+(np3+1)*(nc0+1)

n,nt11+1,g1+g2+g3+w1+p1+w2+p2+w3,c1           !tailgate entry roof
n,nt11+np3+1,g1+g2+g3+w1+p1+w2+p2+w3+p3,c1
fill

ngen,nc2+1,np3+1,nt11+1,nt11+np3+1,,,c2/nc2
ngen,nc3+1,np3+1,nt11+(np3+1)*(nc2)+1,nt11+(np3+1)*(nc2)+np3+1,,,
c3/nc3
ngen,nc4+1,np3+1,nt11+(np3+1)*(nc2+nc3)+1,nt11+(np3+1)*(nc2+nc3)+
np3+1,,,c4/nc4
ngen,nc5+1,np3+1,nt11+(np3+1)*(nc2+nc3+nc4)+1,nt11+(np3+1)*(nc2+n
c3+nc4)+np3+1,,,c5/nc5


nt12=nt11+(np3+1)*(nc2+nc3+nc4+nc5+1)

n,nt12+1,g1+g2+g3+w1+p1+w2+p2+w3+p3,-c0
n,nt12+nw4+1,g1+g2+g3+w1+p1+w2+p2+w3+p3+w4,-c0
fill,nt12+1,nt12+nw4+1,,,,,,3
```

```
ngen,nc0+1,nw4+1,nt12+1,nt12+nw4+1,,,c0/nc0
ngen,nc1+1,nw4+1,nt12+(nw4+1)*nc0+1,nt12+(nw4+1)*nc0+nw4+1,,,c1/nc1
ngen,nc2+1,nw4+1,nt12+(nw4+1)*(nc0+nc1)+1,nt12+(nw4+1)*(nc0+nc1)+
nw4+1,,,c2/nc2
ngen,nc3+1,nw4+1,nt12+(nw4+1)*(nc0+nc1+nc2)+1,nt12+(nw4+1)*(nc0+n
c1+nc2)+nw4+1,,,c3/nc3
ngen,nc4+1,nw4+1,nt12+(nw4+1)*(nc0+nc1+nc2+nc3)+1,nt12+(nw4+1)*(n
c0+nc1+nc2+nc3)+nw4+1,,,c4/nc4
ngen,nc5+1,nw4+1,nt12+(nw4+1)*(nc0+nc1+nc2+nc3+nc4)+1,nt12+(nw4+1
)*(nc0+nc1+nc2+nc3+nc4)+nw4+1,,,c5/nc5


mat,1
e,1,2,(ng1+1)+2,(ng1+1)+1      ! generate element on the gob side
egen,ng1,1,-1
egen,nc0,(ng1+1),-ng1


e,(ng1+1)*(nc0+1)+1,(ng1+1)*(nc0+1)+2,(ng1+1)*(nc0+1)+(ng1+1)+2,(
ng1+1)*(nc0+1)+(ng1+1)+1
egen,ng1,1,-1
egen,nc1,ng1+1,-ng1


e,(ng1+1)*(nc0+nc1+2)+1,(ng1+1)*(nc0+nc1+2)+2,(ng1+1)*(nc0+nc1+2)
+(ng1+1)+2,(ng1+1)*(nc0+nc1+2)+(ng1+1)+1
egen,ng1,1,-1
egen,nc2,ng1+1,-ng1


e,(ng1+1)*(nc0+nc1+nc2+3)+1,(ng1+1)*(nc0+nc1+nc2+3)+2,(ng1+1)*(nc
0+nc1+nc2+3)+(ng1+1)+2,(ng1+1)*(nc0+nc1+nc2+3)+(ng1+1)+1
egen,ng1,1,-1
egen,nc3,ng1+1,-ng1

a1=nc0+nc1+nc2+nc3+4

e,(ng1+1)*a1+1,(ng1+1)*a1
+2,(ng1+1)*a1+(ng1+1)+2,(ng1+1)*a1+(ng1+1)+1
egen,ng1,1,-1
egen,nc4,ng1+1,-ng1

a2=nc0+nc1+nc2+nc3+nc4+5
e,(ng1+1)*a2+1,(ng1+1)*a2+2,(ng1+1)*a2+(ng1+1)+2,(ng1+1)*a2+(ng1+
1)+1
egen,ng1,1,-1
egen,nc5,ng1+1,-ng1


e,nt1+1,nt1+2,nt1+ng2+3,nt1+ng2+2
egen,ng2,1,-1
egen,nc0,ng2+1,-ng2
```

```
e,nt1+(ng2+1)*(nc0+1)+1,nt1+(ng2+1)*(nc0+1)+2,nt1+(ng2+1)*(nc0+1)
+(ng2+1)+2,nt1+(ng2+1)*(nc0+1)+(ng2+1)+1
egen,ng2,1,-1
egen,nc1,ng2+1,-ng2

e,nt1+(ng2+1)*(nc0+nc1+2)+1,nt1+(ng2+1)*(nc0+nc1+2)+2,nt1+(ng2+1)
*(nc0+nc1+2)+(ng2+1)+2,nt1+(ng2+1)*(nc0+nc1+2)+(ng2+1)+1
egen,ng2,1,-1
egen,nc2,ng2+1,-ng2

a4=nc0+nc1+nc2+3

e,nt1+(ng2+1)*a4+1,nt1+(ng2+1)*a4+2,nt1+(ng2+1)*a4+(ng2+1)+2,nt1+
(ng2+1)*a4+(ng2+1)+1
egen,ng2,1,-1
egen,nc3,ng2+1,-ng2

a3=nc0+nc1+nc2+nc3+4

e , n t 1 + ( n g 2 + 1 ) * a 3 + 1 , n t 1 + ( n g 2 + 1 ) * a 3
+2,nt1+(ng2+1)*a3+(ng2+1)+2,nt1+(ng2+1)*a3+(ng2+1)+1
egen,ng2,1,-1
egen,nc4,ng2+1,-ng2

a5=nc0+nc1+nc2+nc3+nc4+4
e,nt1+(ng2+1)*a5+1,nt1+(ng2+1)*a5+2,nt1+(ng2+1)*a5+(ng2+1)+2,nt1+
(ng2+1)*a5+(ng2+1)+1
egen,ng2,1,-1
egen,nc5,ng2+1,-ng2


e,nt2+1,nt2+2,nt2+ng3+3,nt2+ng3+2        !g3 area column
egen,ng3,1,-1
egen,nc0,ng3+1,-ng3

e,nt2+(ng3+1)*(nc0+1)+1,nt2+(ng3+1)*(nc0+1)+2,nt2+(ng3+1)*(nc0+1)
+(ng3+1)+2,nt2+(ng3+1)*(nc0+1)+(ng3+1)+1
egen,ng3,1,-1
egen,nc1,ng3+1,-ng3

e,nt2+(ng3+1)*(nc0+nc1+2)+1,nt2+(ng3+1)*(nc0+nc1+2)+2,nt2+(ng3+1)
*(nc0+nc1+2)+(ng3+1)+2,nt2+(ng3+1)*(nc0+nc1+2)+(ng3+1)+1
egen,ng3,1,-1
egen,nc2,ng3+1,-ng3

a6=nc0+nc1+nc2+3

e,nt2+(ng3+1)*a6+1,nt2+(ng3+1)*a6+2,nt2+(ng3+1)*a6+(ng3+1)+2,nt2+
(ng3+1)*a6+(ng3+1)+1
egen,ng3,1,-1
egen,nc3,ng3+1,-ng3

a7=nc0+nc1+nc2+nc3+3
```

```
e , n t 2 + ( n g 3 + 1 ) * a 7 + 1 , n t 2 + ( n g 3 + 1 ) * a 7
+2,nt2+(ng3+1)*a7+(ng3+1)+2,nt2+(ng3+1)*a7+(ng3+1)+1
egen,ng3,1,-1
egen,nc4,ng3+1,-ng3

a8=nc0+nc1+nc2+nc3+nc4+3
e,nt2+(ng3+1)*a8+1,nt2+(ng3+1)*a8+2,nt2+(ng3+1)*a8+(ng3+1)+2,nt2+
(ng3+1)*a8+(ng3+1)+1
egen,ng3,1,-1
egen,nc5,ng3+1,-ng3


e,nt3+1,nt3+2,nt3+nw1+3,nt3+nw1+2        !w1 pillar column
egen,nw1,1,-1
egen,(nc0+nc1+nc2+nc3+nc4+nc5),nw1+1,-nw1

e,nt4+1,nt4+2,nt4+np1+3,nt4+np1+2        !entry p1 floor column
egen,np1,1,-1
egen,(nc0),np1+1,-np1

e,nt5+1,nt5+2,nt5+np1+3,nt5+np1+2        !entry p1 roof column
egen,np1,1,-1
egen,(nc2+nc3+nc4+nc5),np1+1,-np1


e,nt6+1,nt6+2,nt6+nw2+3,nt6+nw2+2        !w2 pillar column
egen,nw2,1,-1
egen,(nc0+nc1+nc2+nc3+nc4+nc5),nw2+1,-nw2


e,nt7+1,nt7+2,nt7+np2+3,nt7+np2+2        !entry p2 floor column
egen,np2,1,-1
egen,(nc0),np2+1,-np2

e,nt8+1,nt8+2,nt8+np2+3,nt8+np2+2        !entry p2 roof column
egen,np2,1,-1
egen,(nc2+nc3+nc4+nc5),np2+1,-np2


e,nt9+1,nt9+2,nt9+nw3+3,nt9+nw3+2        !w3 pillar column
egen,nw3,1,-1
egen,(nc0+nc1+nc2+nc3+nc4+nc5),nw3+1,-nw3


e,nt10+1,nt10+2,nt10+np3+3,nt10+np3+2        !entry p3 floor column
egen,np3,1,-1
egen,(nc0),np3+1,-np3

e,nt11+1,nt11+2,nt11+np3+3,nt11+np3+2        !entry p3 roof column
egen,np3,1,-1
egen,(nc2+nc3+nc4+nc5),np3+1,-np3

e,nt12+1,nt12+2,nt12+nw4+3,nt12+nw4+2        !w4 pillar column
```

```
egen,nw4,1,-1
egen,(nc0+nc1+nc2+nc3+nc4+nc5),nw4+1,-nw4


esel,s, elem,,ng1*nc0+1,ng1*(nc0+nc1+nc2+nc3+nc4)
emodif,all,mat,2
esel,all

esel,s,elem,,ng1*(nc0+nc1+nc2+nc3+nc4)+1,ng1*(nc0+nc1+nc2+nc3+nc4
+nc5)
emodif,all,mat,3
esel,all


s1=ng1*(nc0+nc1+nc2+nc3+nc4+nc5)
esel,s,elem,,s1+ng2*nc0+1,s1+ng2*(nc0+nc1+nc2+nc3)
emodif,all,mat,2
esel,all


esel,s,elem,,s1+ng2*(nc0+nc1+nc2+nc3)+1,s1+ng2*(nc0+nc1+nc2+nc3+n
c4)
emodif,all,mat,4
esel,all

esel,s,elem,,s1+ng2*(nc0+nc1+nc2+nc3+nc4)+1,s1+ng2*(nc0+nc1+nc2+n
c3+nc4+nc5)
emodif,all,mat,3
esel,all


s2=s1+ng2*(nc0+nc1+nc2+nc3+nc4+nc5)
esel,s,elem,,s2+ng3*nc0+1,s2+ng2*(nc0+nc1+nc2)
emodif,all,mat,2
esel,all

esel,s,elem,,s2+ng3*(nc0+nc1+nc2)+1,s2+ng3*(nc0+nc1+nc2+nc3)
emodif,all,mat,5
esel,all


esel,s,elem,,s2+ng3*(nc0+nc1+nc2+nc3)+1,s2+ng3*(nc0+nc1+nc2+nc3+n
c4)
emodif,all,mat,4
esel,all

esel,s,elem,,s2+ng3*(nc0+nc1+nc2+nc3+nc4)+1,s2+ng3*(nc0+nc1+nc2+n
c3+nc4+nc5)
emodif,all,mat,3
esel,all


s3=s2+ng3*(nc0+nc1+nc2+nc3+nc4+nc5)
```

```
esel,s,elem,,s3+nw1*nc0+1,s3+nw1*(nc0+nc1)
emodif,all,mat,7
esel,all

esel,s,elem,,s3+nw1*(nc0+nc1)+1,s3+nw1*(nc0+nc1+nc2)
emodif,all,mat,6
esel,all

esel,s,elem,,s3+nw1*(nc0+nc1+nc2)+1,s3+nw1*(nc0+nc1+nc2+nc3)
emodif,all,mat,5
esel,all

esel,s,elem,,s3+nw1*(nc0+nc1+nc2+nc3)+1,s3+nw1*(nc0+nc1+nc2+nc3+n
c4)
emodif,all,mat,4
esel,all

esel,s,elem,,s3+nw1*(nc0+nc1+nc2+nc3+nc4)+1,s3+nw1*(nc0+nc1+nc2+n
c3+nc4+nc5)
emodif,all,mat,3
esel,all

s4=s3+nw1*(nc0+nc1+nc2+nc3+nc4+nc5)
esel,s,elem,,s4+np1*nc0+1,s4+np1*(nc0+nc2)
emodif,all,mat,6
esel,all

esel,s,elem,,s4+np1*(nc0+nc2)+1,s4+np1*(nc0+nc2+nc3)
emodif,all,mat,5
esel,all

esel,s,elem,,s4+np1*(nc0+nc2+nc3)+1,s4+np1*(nc0+nc2+nc3+nc4)
emodif,all,mat,4
esel,all

esel,s,elem,,s4+np1*(nc0+nc2+nc3+nc4)+1,s4+np1*(nc0+nc2+nc3+nc4+n
c5)
emodif,all,mat,3
esel,all

s5=s4+np1*(nc0+nc2+nc3+nc4+nc5)
esel,s,elem,,s5+nw2*nc0+1,s5+nw2*(nc0+nc1)
emodif,all,mat,7
esel,all

esel,s,elem,,s5+nw2*(nc0+nc1)+1,s5+nw2*(nc0+nc1+nc2)
emodif,all,mat,6
esel,all

esel,s,elem,,s5+nw2*(nc0+nc1+nc2)+1,s5+nw2*(nc0+nc1+nc2+nc3)
emodif,all,mat,5
esel,all

esel,s,elem,,s5+nw2*(nc0+nc1+nc2+nc3)+1,s5+nw2*(nc0+nc1+nc2+nc3+n
```

```
c4)
emodif,all,mat,4
esel,all

esel,s,elem,,s5+nw2*(nc0+nc1+nc2+nc3+nc4)+1,s5+nw2*(nc0+nc1+nc2+n
c3+nc4+nc5)
emodif,all,mat,3
esel,all


s6=s5+nw2*(nc0+nc1+nc2+nc3+nc4+nc5)
esel,s,elem,,s6+np2*nc0+1,s6+np2*(nc0+nc2)
emodif,all,mat,6
esel,all

esel,s,elem,,s6+np2*(nc0+nc2)+1,s6+np2*(nc0+nc2+nc3)
emodif,all,mat,5
esel,all

esel,s,elem,,s6+np2*(nc0+nc2+nc3)+1,s6+np2*(nc0+nc2+nc3+nc4)
emodif,all,mat,4
esel,all

esel,s,elem,,s6+np2*(nc0+nc2+nc3+nc4)+1,s6+np2*(nc0+nc2+nc3+nc4+n
c5)
emodif,all,mat,3
esel,all




s7=s6+np2*(nc0+nc2+nc3+nc4+nc5)

esel,s,elem,,s7+nw3*nc0+1,s7+nw3*(nc0+nc1)
emodif,all,mat,7
esel,all

esel,s,elem,,s7+nw3*(nc0+nc1)+1,s7+nw3*(nc0+nc1+nc2)
emodif,all,mat,6
esel,all

esel,s,elem,,s7+nw3*(nc0+nc1+nc2)+1,s7+nw3*(nc0+nc1+nc2+nc3)
emodif,all,mat,5
esel,all

esel,s,elem,,s7+nw3*(nc0+nc1+nc2+nc3)+1,s7+nw3*(nc0+nc1+nc2+nc3+n
c4)
emodif,all,mat,4
esel,all

esel,s,elem,,s7+nw3*(nc0+nc1+nc2+nc3+nc4)+1,s7+nw3*(nc0+nc1+nc2+n
```

```
c3+nc4+nc5)
emodif,all,mat,3
esel,all


s8=s7+nw3*(nc0+nc1+nc2+nc3+nc4+nc5)

esel,s,elem,,s8+np3*nc0+1,s8+np3*(nc0+nc2)
emodif,all,mat,6
esel,all

esel,s,elem,,s8+np3*(nc0+nc2)+1,s8+np3*(nc0+nc2+nc3)
emodif,all,mat,5
esel,all

esel,s,elem,,s8+np3*(nc0+nc2+nc3)+1,s8+np3*(nc0+nc2+nc3+nc4)
emodif,all,mat,4
esel,all

esel,s,elem,,s8+np3*(nc0+nc2+nc3+nc4)+1,s8+np3*(nc0+nc2+nc3+nc4+n
c5)
emodif,all,mat,3
esel,all


s9=s8+np3*(nc0+nc2+nc3+nc4+nc5)

esel,s,elem,,s9+nw4*nc0+1,s9+nw4*(nc0+nc1)
emodif,all,mat,7
esel,all

esel,s,elem,,s9+nw4*(nc0+nc1)+1,s9+nw4*(nc0+nc1+nc2)
emodif,all,mat,6
esel,all

esel,s,elem,,s9+nw4*(nc0+nc1+nc2)+1,s9+nw4*(nc0+nc1+nc2+nc3)
emodif,all,mat,5
esel,all

esel,s,elem,,s9+nw4*(nc0+nc1+nc2+nc3)+1,s9+nw4*(nc0+nc1+nc2+nc3+n
c4)
emodif,all,mat,4
esel,all

esel,s,elem,,s9+nw4*(nc0+nc1+nc2+nc3+nc4)+1,s9+nw4*(nc0+nc1+nc2+n
c3+nc4+nc5)
emodif,all,mat,3
esel,all


nsel,s,loc,x,g1+g2+g3+w1
NUMMRG,NODE, ,
nsel,all
```

```
nsel,s,loc,x,g1+g2+g3+w1+p1
NUMMRG,NODE, ,
nsel,all

nsel,s,loc,x,g1+g2+g3+w1+p1+w2
NUMMRG,NODE, ,
nsel,all

nsel,s,loc,x,g1+g2+g3+w1+p1+w2+p2
NUMMRG,NODE, ,
nsel,all

nsel,s,loc,x,g1+g2+g3+w1+p1+w2+p2+w3
NUMMRG,NODE, ,
nsel,all

nsel,s,loc,x,g1+g2+g3+w1+p1+w2+p2+w3+p3
NUMMRG,NODE, ,
nsel,all



nsel,s,loc,x,g1
nsel,r,loc,y,c1+c2+c3+c4+c5/nc5,c1+c2+c3+c4+c5
NUMMRG,NODE, ,
nsel,all

nsel,s,loc,x,g1
nsel,r,loc,y,c1/nc1,c1+c2+c3-c3/nc3
NUMMRG,NODE, ,
nsel,all

nsel,s,loc,x,g1+g2
nsel,r,loc,y,c1/nc1,c1+c2-c2/nc2
NUMMRG,NODE, ,
nsel,all


nsel,s,loc,x,g1+g2
nsel,r,loc,y,c1+c2+c3+c4/nc4,c1+c2+c3+c4+c5
NUMMRG,NODE, ,
nsel,all


nsel,s,loc,x,g1+g2+g3
nsel,r,loc,y,c1+c2+c3/nc3,c1+c2+c3+c4+c5
NUMMRG,NODE, ,
nsel,all

nsel,s,loc,y,c1
nsel,r,loc,x,0,g1+g2+g3-g3/ng3
NUMMRG,NODE, ,
nsel,all
```

```
nsel,s,loc,y,c1+c2
nsel,r,loc,x,0,g1+g2-g2/ng2
NUMMRG,NODE, ,
nsel,all

nsel,s,loc,y,c1+c2+c3
nsel,r,loc,x,0,g1-g1/ng1
NUMMRG,NODE, ,
nsel,all

nsel,s,loc,x,g1
nsel,r,loc,y,-c0,-c0/nc0
NUMMRG,NODE, ,
nsel,all

nsel,s,loc,x,g1+g2
nsel,r,loc,y,-c0,-c0/nc0
NUMMRG,NODE, ,
nsel,all

nsel,s,loc,x,g1+g2+g3
nsel,r,loc,y,-c0,-c0/nc0
NUMMRG,NODE, ,
nsel,all

nsel,s,loc,x,0
NUMMRG,NODE, ,
nsel,all

/PNUM,MAT,1

NUMMRG,NODE, ,

EPLOT


nsel,s,loc,x,0
d,all,ux,0

nsel,s,loc,y,-c0
d,all,uy,0

nsel,s,loc,y,c1+c2+c3+c4+c5
sf,all,pres,1.1*burden

nsel,s,loc,x,g1+g2+g3+w1+p1+w2+p2+w3+p3+w4
sf,all,pres,hstress


nsel,all
```

```
/PNUM,MAT,1

/PSF,PRES,NORM,2
/PBF,DEFA, ,1
/PSYMB,CS,0
/PSYMB,NDIR,0
/PSYMB,ESYS,0
/PSYMB,LDIR,0
/PSYMB,LAYR,0
!*
/PBC,ALL,,1
/PBC,NFOR,,0
/PBC,NMOM,,0
/PBC,RFOR,,0
/PBC,RMOM,,0
/REPLOT
!*

/SOLU
FINISH
/SOLU
/STAT,SOLU
SOLVE
/dscale,1,1
/PLOPTS,INFO,ON
/POST1
FINISH
/POST1
PLNSOL,S,X
PLNSOL,S,Y
PLNSOL,S,XY
/PNUM,KP,0
/PNUM,LINE,0
/PNUM,AREA,1
/PNUM,VOLU,0
/PNUM,NODE,0
/PNUM,SVAL,0
/NUM,0
!*
/PNUM,MAT,0
!
!*
PLVECT,S
```

```
! Model for 3 dimensional single entry system, entry can be turned
/prep7
/title
/nopr
antype,static

/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,cburden, 'overburden depth',800
*ask,hstress1,'1st horizontal stress',1000
*ask,hstress2,'2nd horizontal stress',1000

*ask,ymfh,'floor hori. Y.M.',2e6
*ask,ymfv,'floor verti. Y.M.',1e6

*ask,ymc,'coal Y.M.',1e5

*ask,ymrih,'imm. roof hori. Y.M.',2e6
*ask,ymriv,'imm. roof verti. Y.M.',1e6

*ask,ymrmh,'main roof hori. Y.M.',2e6
*ask,ymrmv,'main roof verti. Y.M.',1e6

*ask,w1,'left solid width',100*12
*ask,e1,'entry 1 width',16*12
*ask,w2,'right solid width',100*12

*ask,nw1,'# elem. left solid',3
*ask,ne1,'# elem. entry 1',3
*ask,nw2,'# elem. right solid',3

*ask,l1,' asdsdf',100*12
*ask,nl1,'# elem. along L1',3

*ask,t,'length of entry',50*12
*ask,nt,'# elem. in entry',6

*ask,l2,'from most inby face to boundary',100*12
*ask,nl2,'# elem. in L2',3


*ask,fthick,'floor thickness',80*12
*ask,nf,'# elem. floor heightwise',3
```

```
*ask,cthick,'coal thickness',6*12
*ask,ncoal,'# elem. coal heightwise',2

*ask,rithick,'imm. roof thickness',20*12
*ask,nri,'# elem. imm. roof heightwise',3

*ask,rmthick,'main roof thickness',40*12
*ask,nrm,'# elem. main roof heightwise',2

*ask,alpha,'angle of turn',15

n,1,
n,nw1+1,w1,0,0
fill

n,nw1+1+ne1,w1+e1,0,0
fill,nw1+1,nw1+1+ne1

n,nw1+1+ne1+nw2,w1+e1+w2,0,0
fill,nw1+1+ne1,nw1+1+ne1+nw2

k0=nw1+ne1+nw2
ngen,nl1+1,k0+1,1,k0+1,,,l1/nl1,,
ngen,nt+1,k0+1,(nl1)*(k0+1)+1,(nl1+1)*(k0+1),,,t/nt
ngen,nl2+1,k0+1,(nl1+nt)*(k0+1)+1,(nl1+nt+1)*(k0+1),,,l2/nl2
ngen,nf+1,(nl1+nt+nl2+1)*(k0+1),1,(nl1+nt+nl2+1)*(k0+1),,0,0,fthi
ck/nf

v3=(nl1+nt+nl2+1)*(k0+1)

ngen,ncoal+1,(nl1+nt+nl2+1)*(k0+1),nf*v3+1,(nf+1)*v3,,0,0,cthick/
ncoal
ngen,nri+1,(nl1+nt+nl2+1)*(k0+1),(nf+ncoal)*v3+1,(nf+ncoal+1)*v3,
,0,0,rithick/nri
ngen,nrm+1,(nl1+nt+nl2+1)*(k0+1),(nf+ncoal+nri)*v3+1,(nf+nri+ncoa
l+1)*v3,,0,0,rmthick/nrm


ET,1,solid64

uimp,1,ex,ey,ez,ymfh,ymfh,ymfv
uimp,2,ex,ey,ez,ymc,ymc,ymc
uimp,3,ex,ey,ez,ymrih,ymrih,ymriv
uimp,4,ex,ey,ez,ymrmh,ymrmh,ymrmv

v1=(nl1+nt+nl2+1)*(k0+1)

mat,1
e,1,2,(k0+1)+2,(k0+1)+1,v1+1,v1+2,v1+(k0+1)+2,v1+(k0+1)+1
egen,k0,1,-1
egen,(nl1+nt+nl2),k0+1,-k0
egen,nf+ncoal+nri+nrm,v1,-(nl1+nt+nl2)*k0

esel,s, elem,,nf*(nl1+nt+nl2)*k0+1,(nf+ncoal)*(nl1+nt+nl2)*k0
```

```
emodif,all,mat,2
esel,all

e          s          e          l          ,          s          ,
elem,,(nf+ncoal)*(nl1+nt+nl2)*k0+1,(nf+ncoal+nri)*(nl1+nt+nl2)*k0
emodif,all,mat,3
esel,all

e          s          e          l          ,          s          ,
elem,,(nf+ncoal+nri)*(nl1+nt+nl2)*k0+1,(nf+ncoal+nri+nrm)*(nl1+nt
+nl2)*k0
emodif,all,mat,4
esel,all

incr=(nl1+nt+nl2)*k0


*do,j,1,ncoal

     tot1=nf*(nl1+nt+nl2)*k0
     tot0=tot1+nl1*k0

     *do,i,1,nt

edele,tot0+nw1+1+(i-1)*k0+(j-1)*incr,tot0+nw1+ne1+(i-1)*k0+(j-1)*
incr,
     *enddo

*enddo



*if,alpha,ne,0,then,

local,11,0,0,0,0,alpha,,,1,1        ! for subjoined area 1

wn=(k0+1)*(nl1+nt+nl2+1)*(nf+ncoal+nri+nrm+1)

n,wn+1,0,0,0
n,wn+nl1+1,0,l1*cos(alpha*3.1415926/180),0
fill

n,wn+nl1+nt+1,0,(l1+t)*cos(alpha*3.1415926/180),0
fill,wn+nl1+1,wn+nl1+nt+1

n,wn+nl1+nt+nl2+1,0,(l1+t+l2)*cos(alpha*3.1415926/180),0
fill,wn+nl1+nt+1,wn+nl1+nt+nl2+1

ngen,nl1+1,nl1+nt+nl2+1,wn+1,wn+nl1+nt+nl2+1,,(l1*sin(alpha*3.141
5926/180))/nl1
ngen,nt+1,nl1+nt+nl2+1,wn+nl1*(nl1+nt+nl2+1)+1,wn+(nl1+1)*(nl1+nt
+nl2+1),,(t*sin(alpha*3.1415926/180))/nt
ngen,nl2+1,nl1+nt+nl2+1,wn+(nl1+nt)*(nl1+nt+nl2+1)+1,wn+(nl1+nt+1
)*(nl1+nt+nl2+1),,(l2*sin(alpha*3.1415926/180))/nl2
```

```
x2=nl1+nt+nl2+2
wn1=(nl1+nt+nl2+1)*(nl1+nt+nl2+1)

q=k0+1

ngen,nf+1,wn1,wn+1,wn+wn1,,0,0,fthick/nf

ngen,ncoal+1,wn1,wn+nf*wn1+1,wn+(nf+1)*wn1,,0,0,cthick/ncoal
ngen,nri+1,wn1,wn+(nf+ncoal)*wn1+1,wn+(nf+ncoal+1)*wn1,,0,0,rithi
ck/nri
ngen,nrm+1,wn1,wn+(nf+ncoal+nri)*wn1+1,wn+(nf+nri+ncoal+1)*wn1,,0
,0,rmthick/nrm


*do,k,1,nf+ncoal+nri+nrm

*if,k,le,nf,then
mat,1
*elseif,k,gt,nf,then
*if,k,le,(nf+ncoal),then
mat,2
*elseif,k,gt,(nf+ncoal),then
*if,k,le,(nf+ncoal+nri),then
mat,3
*else
mat,4
*endif
*endif
*endif

o=v3*(k-1)
p=wn1*(k-1)
pp=k*wn1+wn

*do,i,1,nl1+nt+nl2
*do,j,1,nl1+nt+nl2-i+1

*if,j,eq,1,then,

e,o+(i-1)*q+1,o+i*q+1,wn+p+(i-1)*x2+2,wn+p+(i-1)*x2+2,k*v3+(i-1)*
q+1,k*v3+i*q+1,pp+(i-1)*x2+2,pp+(i-1)*x2+2

*elseif,j,eq,2,then,

e,p+wn+(i-1)*x2+2,o+i*q+1,p+wn+i*x2+j,p+wn+(i-1)*x2+3,pp+(i-1)*x2
+2,k*v3+i*q+1,pp+i*x2+j,pp+(i-1)*x2+3

*else

e,p+wn+(i-1)*x2+j,p+wn+i*x2+j-1,p+wn+i*x2+j,p+wn+(i-1)*x2+j+1,pp+
(i-1)*x2+j,pp+i*x2+j-1,pp+i*x2+j,pp+(i-1)*x2+j+1

*endif
```

```
*enddo
*enddo
*enddo

csys,0

!---------------------------------------------
local,11,0,0,l1+t+l2,0,-(90-alpha),,,1,1          ! for subjoined
area 2
xn=(k0+1)*(nl1+nt+nl2+1)*(nf+ncoal+nri+nrm+1)+wn1*(nf+ncoal+nri+n
rm+1)
n,xn+1,0,0,0
n,xn+nw1+1,0,w1*cos(alpha*3.1415926/180),0
fill,xn+1,xn+nw1+1

n,xn+nw1+ne1+1,0,(w1+e1)*cos(alpha*3.1415926/180),0
fill,xn+nw1+1,xn+nw1+ne1+1

n,xn+nw1+ne1+nw2+1,0,(w1+e1+w2)*cos(alpha*3.1415926/180),0
fill,xn+nw1+ne1+1,xn+nw1+ne1+nw2+1

ngen,nw1+1,nw1+ne1+nw2+1,xn+1,xn+nw1+ne1+nw2+1,,(w1*sin(alpha*3.1
415926/180))/nw1
ngen,ne1+1,nw1+ne1+nw2+1,xn+nw1*(nw1+ne1+nw2+1)+1,xn+(nw1+1)*(nw1
+ne1+nw2+1),,(e1*sin(alpha*3.1415926/180))/ne1
ngen,nw2+1,nw1+ne1+nw2+1,xn+(nw1+ne1)*(nw1+ne1+nw2+1)+1,xn+(nw1+n
e1+1)*(nw1+ne1+nw2+1),,(w2*sin(alpha*3.1415926/180))/nw2

x3=nw1+ne1+nw2+2
xn1=(nw1+ne1+nw2+1)*(nw1+ne1+nw2+1)

!q=k0+1

ngen,nf+1,xn1,xn+1,xn+xn1,,0,0,fthick/nf

ngen,ncoal+1,xn1,xn+nf*xn1+1,xn+(nf+1)*xn1,,0,0,cthick/ncoal
ngen,nri+1,xn1,xn+(nf+ncoal)*xn1+1,xn+(nf+ncoal+1)*xn1,,0,0,rithi
ck/nri
ngen,nrm+1,xn1,xn+(nf+ncoal+nri)*xn1+1,xn+(nf+nri+ncoal+1)*xn1,,0
,0,rmthick/nrm

*do,k,1,nf+ncoal+nri+nrm

*if,k,le,nf,then
mat,1
*elseif,k,gt,nf,then
*if,k,le,(nf+ncoal),then
mat,2
*elseif,k,gt,(nf+ncoal),then
*if,k,le,(nf+ncoal+nri),then
mat,3
*else
mat,4
*endif
```

```
*endif
*endif

qq=xn+k*xn1
qqq=xn+(k-1)*xn1

z=(k0+1)*(nl1+nt+nl2)

*do,i,1,nw1+ne1+nw2
*do,j,1,nw1+ne1+nw2-i+1

*if,j,eq,1,then,

e,(k-1)*v3+z+i,(k-1)*v3+z+i+1,qqq+(i-1)*x3+2,qqq+(i-1)*x3+2,k*v3+
z+i,k*v3+z+i+1,qq+(i-1)*x3+2,qq+(i-1)*x3+2

*elseif,j,eq,2,then,

e,qqq+(i-1)*x3+j,(k-1)*v3+z+i+1,qqq+i*x3+j,qqq+(i-1)*x3+3,qq+(i-1
)*x3+j,k*v3+z+i+1,qq+i*x3+j,qq+(i-1)*x3+3

*else

e,qqq+(i-1)*x3+j,qqq+i*x3+j-1,qqq+i*x3+j,qqq+(i-1)*x3+j+1,qq+(i-1
)*x3+j,qq+i*x3+j-1,qq+i*x3+j,qq+(i-1)*x3+j+1

*endif

*enddo
*enddo
*enddo


csys,0
!----------------------------------------
local,11,0,w1+e1+w2,l1+t+l2,0,-(180-alpha),,,1,1              ! for
subjoined area 3

tn=xn+xn1*(nf+ncoal+nri+nrm+1)

n,tn+1,0,0,0
n,tn+nl2+1,0,l2*cos(alpha*3.1415926/180),0
fill

n,tn+nl2+nt+1,0,(l2+t)*cos(alpha*3.1415926/180),0
fill,tn+nl2+1,tn+nl2+nt+1

n,tn+nl2+nt+nl1+1,0,(l2+t+l1)*cos(alpha*3.1415926/180),0
fill,tn+nl2+nt+1,tn+nl2+nt+nl1+1

ngen,nl2+1,nl2+nt+nl1+1,tn+1,tn+nl2+nt+nl1+1,,(l2*sin(alpha*3.141
5926/180))/nl2
ngen,nt+1,nl2+nt+nl1+1,tn+nl2*(nl2+nt+nl1+1)+1,tn+(nl2+1)*(nl2+nt
+nl1+1),,(t*sin(alpha*3.1415926/180))/nt
```

```
ngen,nl1+1,nl2+nt+nl1+1,tn+(nl2+nt)*(nl1+nt+nl2+1)+1,tn+(nl2+nt+1
)*(nl1+nt+nl2+1),,(l1*sin(alpha*3.1415926/180))/nl1

!x2=nl1+nt+nl2+2

!wn1=(nl1+nt+nl2+1)*(nl1+nt+nl2+1)

!q=k0+1

ngen,nf+1,wn1,tn+1,tn+wn1,,0,0,fthick/nf
ngen,ncoal+1,wn1,tn+nf*wn1+1,tn+(nf+1)*wn1,,0,0,cthick/ncoal
ngen,nri+1,wn1,tn+(nf+ncoal)*wn1+1,tn+(nf+ncoal+1)*wn1,,0,0,rithi
ck/nri
ngen,nrm+1,wn1,tn+(nf+ncoal+nri)*wn1+1,tn+(nf+nri+ncoal+1)*wn1,,0
,0,rmthick/nrm


*do,k,1,nf+ncoal+nri+nrm

*if,k,le,nf,then
mat,1
*elseif,k,gt,nf,then
*if,k,le,(nf+ncoal),then
mat,2
*elseif,k,gt,(nf+ncoal),then
*if,k,le,(nf+ncoal+nri),then
mat,3
*else
mat,4
*endif
*endif
*endif

qp=tn+wn1*(k-1)
pq=tn+k*wn1

*do,i,1,nl1+nt+nl2
*do,j,1,nl1+nt+nl2-i+1

*if,j,eq,1,then,
e,v3*(k-1)+(x2-i)*q,v3*(k-1)+(x2-1-i)*q,qp+(i-1)*x2+2,qp+(i-1)*x2
+2,k*v3+(x2-i)*q,k*v3+(x2-1-i)*q,pq+(i-1)*x2+2,pq+(i-1)*x2+2

*elseif,j,eq,2,then,

e,qp+(i-1)*x2+2,v3*(k-1)+(x2-1-i)*q,qp+i*x2+j,qp+(i-1)*x2+3,pq+(i
-1)*x2+2,k*v3+(x2-1-i)*q,pq+i*x2+j,pq+(i-1)*x2+3

*else

e,qp+(i-1)*x2+j,qp+i*x2+j-1,qp+i*x2+j,qp+(i-1)*x2+j+1,pq+(i-1)*x2
+j,pq+i*x2+j-1,pq+i*x2+j,pq+(i-1)*x2+j+1

*endif
```

```
*enddo
*enddo
*enddo

!---------------- ! for subjoined area 4
csys,0

local,11,0,w1+e1+w2,0,0,-(270-alpha),,,1,1

xt=tn+wn1*(nf+ncoal+nri+nrm+1)

n,xt+1,0,0,0
n,xt+nw2+1,0,w2*cos(alpha*3.1415926/180),0
fill,xt+1,xt+nw2+1

n,xt+nw2+ne1+1,0,(w2+e1)*cos(alpha*3.1415926/180),0
fill,xt+nw2+1,xt+nw2+ne1+1

n,xt+nw2+ne1+nw1+1,0,(w1+e1+w2)*cos(alpha*3.1415926/180),0
fill,xt+nw2+ne1+1,xt+nw1+ne1+nw2+1

ngen,nw2+1,nw1+ne1+nw2+1,xt+1,xt+nw1+ne1+nw2+1,,(w2*sin(alpha*3.1
415926/180))/nw2
ngen,ne1+1,nw1+ne1+nw2+1,xt+nw2*(nw1+ne1+nw2+1)+1,xt+(nw2+1)*(nw1
+ne1+nw2+1),,(e1*sin(alpha*3.1415926/180))/ne1
ngen,nw1+1,nw1+ne1+nw2+1,xt+(nw2+ne1)*(nw1+ne1+nw2+1)+1,xt+(nw2+n
e1+1)*(nw1+ne1+nw2+1),,(w1*sin(alpha*3.1415926/180))/nw1

!x3=nw1+ne1+nw2+2
!xn1=(nw1+ne1+nw2+1)*(nw1+ne1+nw2+1)

!q=k0+1

ngen,nf+1,xn1,xt+1,xt+xn1,,0,0,fthick/nf

ngen,ncoal+1,xn1,xt+nf*xn1+1,xt+(nf+1)*xn1,,0,0,cthick/ncoal
ngen,nri+1,xn1,xt+(nf+ncoal)*xn1+1,xt+(nf+ncoal+1)*xn1,,0,0,rithi
ck/nri
ngen,nrm+1,xn1,xt+(nf+ncoal+nri)*xn1+1,xt+(nf+nri+ncoal+1)*xn1,,0
,0,rmthick/nrm

*do,k,1,nf+ncoal+nri+nrm

*if,k,le,nf,then
mat,1
*elseif,k,gt,nf,then
*if,k,le,(nf+ncoal),then
mat,2
*elseif,k,gt,(nf+ncoal),then
*if,k,le,(nf+ncoal+nri),then
mat,3
*else
mat,4
*endif
```

```
*endif
*endif

bq=xt+(k-1)*xn1
cq=xt+k*xn1

*do,i,1,nw1+ne1+nw2
*do,j,1,nw1+ne1+nw2-i+1

*if,j,eq,1,then,

e,(k-1)*v3+(x3-i),(k-1)*v3+x3-i-1,bq+(i-1)*x3+2,bq+(i-1)*x3+2,k*v
3+x3-i,k*v3+x3-i-1,cq+(i-1)*x3+2,cq+(i-1)*x3+2

*elseif,j,eq,2,then,

e,bq+(i-1)*x3+j,(k-1)*v3+x3-i-1,bq+i*x3+j,bq+(i-1)*x3+3,cq+(i-1)*
x3+j,k*v3+x3-i-1,cq+i*x3+j,cq+(i-1)*x3+3

*else

e,bq+(i-1)*x3+j,bq+i*x3+j-1,bq+i*x3+j,bq+(i-1)*x3+j+1,cq+(i-1)*x3
+j,cq+i*x3+j-1,cq+i*x3+j,cq+(i-1)*x3+j+1

*endif

*enddo
*enddo
*enddo

!---------------------------
*endif          ! end of if stmt for if, alpha,nq,0,


local,11,0,0,0,0,alpha,,,1,1        ! for subjoined area 1
nsel,s,loc,x,-5,5
sf,all,pres,hstress1
nsel,all
csys,0


local,11,0,0,l1+t+l2,0,-(90-alpha),,,1,1          ! for subjoined
area 2
nsel,s,loc,x,-5,5
sf,all,pres,hstress2
nsel,all
csys,0

local,11,0,w1+e1+w2,l1+t+l2,0,-(180-alpha),,,1,1  ! for subjoined
area 3
nsel,s,loc,x,-5,5
sf,all,pres,hstress1
nsel,all
csys,0
```

```
local,11,0,w1+e1+w2,0,0,-(270-alpha),,,1,1    ! for subjoined area
4
nsel,s,loc,x,-5,5
sf,all,pres,hstress2
nsel,all
csys,0

nsel,s,loc,z,fthick+cthick+rithick+rmthick
sf,all,pres,1.1*cburden
nsel,all

nsel,s,loc,z,0
d,all,uz,0
nsel,all


local,11,0,0,0,0,alpha,,,1,1        ! for subjoined area 1
nsel,s,loc,x,-5,5
d,all,ux,0
nsel,all
csys,0

local,11,0,w1+e1+w2,0,0,-(270-alpha),,,1,1    ! for subjoined area
4
nsel,s,loc,x,-5,5
d,all,ux,0
nsel,all
csys,0
```

```
!Model for 3 dimensional two entry system, entry can be turned
/prep7
/title
/nopr
antype,static

/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG

*ask,cburden, 'overburden depth',800
*ask,hstress1,'1st horizontal stress',1000
*ask,hstress2,'2nd horizontal stress',500

*ask,ymfh,'floor hori. Y.M.',2e6
*ask,ymfv,'floor verti. Y.M.',1e6

*ask,ymc,'coal Y.M.',1e5

*ask,ymrih,'imm. roof hori. Y.M.',2e6
*ask,ymriv,'imm. roof verti. Y.M.',1e6

*ask,ymrmh,'main roof hori. Y.M.',2e6
*ask,ymrmv,'main roof verti. Y.M.',1e6

*ask,w1,'left solid width',100*12
*ask,e1,'entry 1 width',16*12
*ask,p1,'pillar 1 width',60*12
*ask,e2,'entry 2 width',16*12
*ask,w2,'right solid width',100*12

*ask,nw1,'# elem. left solid',3
*ask,ne1,'# elem. entry 1',2
*ask,np1,'# elem. pillar 1',4
*ask,ne2,'# elem. entry 2',2
*ask,nw2,'# elem. right solid',3
*ask,l1,' asdsdf',100*12
*ask,c,'distance to 1st Xcut',50*12

*ask,c1,'Xcut between entry 1&2',16*12

*ask,nl1,'# elem. along L1',3
*ask,nc,'# elem. to 1st Xcut',3

*ask,nc1,'# elem. 1st Xcut',2
```

```
*ask,t1,'dist. from Xcut inby rib to face for #1',60*12
*ask,t2,'dist. from Xcut inby rib to face for #2',30*12

*if,t1,gt,t2,then
     *ask,nt2,'# elem. in t2',2
     *ask,nt1b,'# elem in t1-t2',2

     M1=NT2
     M2=NT1B

     TT1=T2
     TT2=T1-T2

*elseif,t1,lt,t2,then
     *ask,nt1,'# elem. in t1',2
     *ask,nt2b,'# elem. in t2-t1',2

     M1=NT1
     M2=NT2B

     TT1=T1
     TT2=T2-T1

*elseif,t1,eq,t2,then
     *ask,nt1,'# elem. in t1 or t2',2
     M1=NT1
     M2=0

     TT1=T1
     TT2=0

*endif

nt=M1+M2

*ask,l2,'from most inby face to boundary',100*12
*ask,nl2,'# elem. in L2',3
*ask,fthick,'floor thickness',60*12
*ask,nf,'# elem. floor heightwise',3
*ask,cthick,'coal thickness',6*12
*ask,ncoal,'# elem. coal heightwise',2
*ask,rithick,'imm. roof thickness',20*12
*ask,nri,'# elem. imm. roof heightwise',3
*ask,rmthick,'main roof thickness',40*12
*ask,nrm,'# elem. main roof heightwise',2

*ask,alpha,'angle of turn',20

n,1,
n,nw1+1,w1,0,0
fill

n,nw1+1+ne1,w1+e1,0,0
fill,nw1+1,nw1+1+ne1
```

```
n,nw1+1+ne1+np1,w1+e1+p1,0,0
fill,nw1+1+ne1,nw1+1+ne1+np1

n,nw1+1+ne1+np1+ne2,w1+e1+p1+e2,0,0
fill,nw1+1+ne1+np1,nw1+1+ne1+np1+ne2

n,nw1+1+ne1+np1+ne2+nw2,w1+e1+p1+e2+w2,0,0
fill,nw1+1+ne1+np1+ne2,nw1+1+ne1+np1+ne2+nw2

k0=nw1+ne1+np1+ne2+nw2
ngen,nl1+1,k0+1,1,k0+1,,,l1/nl1,,

     ngen,nc+1,k0+1,(nl1)*(k0+1)+1,(nl1+1)*(k0+1),,,c/nc,,
     ngen,nc1+1,k0+1,(nl1+nc)*(k0+1)+1,(nl1+nc+1)*(k0+1),,,c1/nc1

ngen,m1+1,k0+1,(nl1+nc+nc1)*(k0+1)+1,(nl1+nc+nc1+1)*(k0+1),,,TT1/M1
     *if,M2,ne,0,then

ngen,m2+1,k0+1,(nl1+nc+nc1+m1)*(k0+1)+1,(nl1+nc+nc1+m1+1)*(k0+1),
,,TT2/M2
     *endif

ngen,nl2+1,k0+1,(nl1+nc+nc1+nt)*(k0+1)+1,(nl1+nc+nc1+nt+1)*(k0+1)
,,,l2/nl2

ngen,nf+1,(nl1+nc+nc1+nt+nl2+1)*(k0+1),1,(nl1+nc+nc1+nt+nl2+1)*(k
0+1),,0,0,fthick/nf
     v3=(nl1+nc+nc1+nt+nl2+1)*(k0+1)

ngen,ncoal+1,(nl1+nc+nc1+nt+nl2+1)*(k0+1),nf*v3+1,(nf+1)*v3,,0,0,
cthick/ncoal

ngen,nri+1,(nl1+nc+nc1+nt+nl2+1)*(k0+1),(nf+ncoal)*v3+1,(nf+ncoal
+1)*v3,,0,0,rithick/nri

ngen,nrm+1,(nl1+nc+nc1+nt+nl2+1)*(k0+1),(nf+ncoal+nri)*v3+1,(nf+n
ri+ncoal+1)*v3,,0,0,rmthick/nrm


ET,1,solid64

uimp,1,ex,ey,ez,ymfh,ymfh,ymfv
uimp,2,ex,ey,ez,ymc,ymc,ymc
uimp,3,ex,ey,ez,ymrih,ymrih,ymriv
uimp,4,ex,ey,ez,ymrmh,ymrmh,ymrmv

v1=(nl1+nc+nc1+nt+nl2+1)*(k0+1)

     mat,1
     e,1,2,(k0+1)+2,(k0+1)+1,v1+1,v1+2,v1+(k0+1)+2,v1+(k0+1)+1
     egen,k0,1,-1
     egen,(nl1+nc+nc1+nt+nl2),k0+1,-k0
     egen,nf+ncoal+nri+nrm,v1,-(nl1+nc+nc1+nt+nl2)*k0
```

```
     e         s         e         l         ,         s         ,
elem,,nf*(nl1+nc+nc1+nt+nl2)*k0+1,(nf+ncoal)*(nl1+nc+nc1+nt+nl2)*k0
     emodif,all,mat,2
     esel,all

     e         s         e         l         ,         s         ,
elem,,(nf+ncoal)*(nl1+nc+nc1+nt+nl2)*k0+1,(nf+ncoal+nri)*(nl1+nc+
nc1+nt+nl2)*k0
     emodif,all,mat,3
     esel,all

     e         s         e         l         ,         s         ,
elem,,(nf+ncoal+nri)*(nl1+nc+nc1+nt+nl2)*k0+1,(nf+ncoal+nri+nrm)*
(nl1+nc+nc1+nt+nl2)*k0
     emodif,all,mat,4
     esel,all

incr=(nl1+nc+nc1+nt+nl2)*k0

temp1=nw1+ne1+np1
temp2=nw1+ne1+np1+ne2

*do,j,1,ncoal

tot1=nf*(nl1+nc+nc1+nt+nl2)*k0

tot0=tot1+nl1*k0

*do,i,1,nc
edele,tot0+nw1+1+(i-1)*k0+(j-1)*incr,tot0+nw1+ne1+(i-1)*k0+(j-1)*
incr,
edele,tot0+temp1+1+(i-1)*k0+(j-1)*incr,tot0+temp1+ne2+(i-1)*k0+(j
-1)*incr,
*enddo

tot2=tot1+(nl1+nc)*k0

*do,i,1,nc1
edele,tot2+nw1+1+(i-1)*k0+(j-1)*incr,tot2+temp2+(i-1)*k0+(j-1)*in
cr,
*enddo

tot5=tot2+nc1*k0

*if,t1,gt,t2,then

     *do,i,1,nt2

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp2+(i-1)*k0+(j-1)*
incr
     *enddo
```

```
     tot6=tot5+nt2*k0

     *do,i,1,nt1b

edele,tot6+nw1+1+(i-1)*k0+(j-1)*incr,tot6+nw1+ne1+(i-1)*k0+(j-1)*
incr
     *enddo

*elseif,t1,lt,t2,then
          *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp2+(i-1)*k0+(j-1)*
incr
          *enddo
          tot6=tot5+nt1*k0

          *do,i,1,nt2b

edele,tot6+temp1+1+(i-1)*k0+(j-1)*incr,tot6+temp2+(i-1)*k0+(j-1)*
incr
          *enddo

*elseif,t1,eq,t2,then      !13
     *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr
     *enddo
*endif

*enddo


k1=nl1+nc+nc1+m1+m2+nl2+1

! following is for subjoined areas

*if,alpha,ne,0,then,

local,11,0,0,0,0,alpha,,,1,1        ! for subjoined area 1

wn=(k0+1)*k1*(nf+ncoal+nri+nrm+1)

n,wn+1,0,0,0
n,wn+nl1+1,0,l1*cos(alpha*3.141592654/180),0
fill
```

```
n,wn+nl1+nc+1,0,(l1+c)*cos(alpha*3.141592654/180),0
fill,wn+nl1+1,wn+nl1+nc+1

n,wn+nl1+nc+nc1+1,0,(l1+c+c1)*cos(alpha*3.141592654/180),0
fill,wn+nl1+nc+1,wn+nl1+nc+nc1+1

n,wn+nl1+nc+nc1+m1+1,0,(l1+c+c1+tt1)*cos(alpha*3.141592654/180),0
fill,wn+nl1+nc+nc1+1,wn+nl1+nc+nc1+m1+1

n,wn+nl1+nc+nc1+m1+m2+1,0,(l1+c+c1+tt1+tt2)*cos(alpha*3.141592654
/180),0
fill,wn+nl1+nc+nc1+m1+1,wn+nl1+nc+nc1+m1+m2+1

n,wn+nl1+nc+nc1+m1+m2+nl2+1,0,(l1+c+c1+tt1+tt2+l2)*cos(alpha*3.14
1592654/180),0
fill,wn+nl1+nc+nc1+m1+m2+1,wn+nl1+nc+nc1+m1+m2+nl2+1


ngen,nl1+1,nl1+nc+nc1+m1+m2+nl2+1,wn+1,wn+k1,,(l1*sin(alpha*3.141
592654/180))/nl1
ngen,nc+1,nl1+nc+nc1+m1+m2+nl2+1,wn+nl1*k1+1,wn+(nl1+1)*k1,,(c*si
n(alpha*3.141592654/180))/nc
ngen,nc1+1,nl1+nc+nc1+m1+m2+nl2+1,wn+(nl1+nc)*k1+1,wn+(nl1+nc+1)*
k1,,(c1*sin(alpha*3.141592654/180))/nc1
ngen,m1+1,k1,wn+(nl1+nc+nc1)*k1+1,wn+(nl1+nc+nc1+1)*k1,,(tt1*sin(
alpha*3.141592654/180))/m1
ngen,m2+1,k1,wn+(nl1+nc+nc1+m1)*k1+1,wn+(nl1+nc+nc1+m1+1)*k1,,(tt
2*sin(alpha*3.141592654/180))/m2
ngen,nl2+1,k1,wn+(nl1+nc+nc1+m1+m2)*k1+1,wn+(nl1+nc+nc1+m1+m2+1)*
k1,,(l2*sin(alpha*3.141592654/180))/nl2

x2=k1+1
wn1=k1*k1

q=nw1+ne1+np1+ne2+nw2+1

ngen,nf+1,wn1,wn+1,wn+wn1,,0,0,fthick/nf
ngen,ncoal+1,wn1,wn+nf*wn1+1,wn+(nf+1)*wn1,,0,0,cthick/ncoal
ngen,nri+1,wn1,wn+(nf+ncoal)*wn1+1,wn+(nf+ncoal+1)*wn1,,0,0,rithi
ck/nri
ngen,nrm+1,wn1,wn+(nf+ncoal+nri)*wn1+1,wn+(nf+nri+ncoal+1)*wn1,,0
,0,rmthick/nrm
!ngen,nrm2+1,wn1,wn+(nf+ncoal+nri+nrm1)*wn1+1,wn+(nf+nri+ncoal+nr
m1+1)*wn1,,0,0,rm2thick/nrm2

*do,k,1,nf+ncoal+nri+nrm

*if,k,le,nf,then,
          mat,1
*elseif,k,gt,nf,then

     *if,k,le,(nf+ncoal),then
          mat,2
     *elseif,k,gt,(nf+ncoal),then
```

```
            *if,k,le,(nf+ncoal+nri),then
                 mat,3
            *else
                 mat,4
            *endif
       *endif
*endif

o=v3*(k-1)

p0=wn+wn1*(k-1)
p2=wn+k*wn1

*do,i,1,nl1+nc+nc1+m1+m2+nl2
*do,j,1,nl1+nc+nc1+m1+m2+nl2-i+1

*if,j,eq,1,then,

e,o+(i-1)*q+1,o+i*q+1,p0+(i-1)*x2+2,p0+(i-1)*x2+2,k*v3+(i-1)*q+1,
k*v3+i*q+1,p2+(i-1)*x2+2,p2+(i-1)*x2+2

*elseif,j,eq,2,then,

e,p0+(i-1)*x2+2,o+i*q+1,p0+i*x2+j,p0+(i-1)*x2+3,p2+(i-1)*x2+2,k*v
3+i*q+1,p2+i*x2+j,p2+(i-1)*x2+3

*else

e,p0+(i-1)*x2+j,p0+i*x2+j-1,p0+i*x2+j,p0+(i-1)*x2+j+1,p2+(i-1)*x2
+j,p2+i*x2+j-1,p2+i*x2+j,p2+(i-1)*x2+j+1

*endif

*enddo
*enddo

*enddo


csys,0

!-------------------------------------------
local,11,0,0,l1+c+c1+tt1+tt2+l2,0,-(90-alpha),,,1,1          ! for
subjoined area 2

xn=(k0+1)*k1*(nf+ncoal+nri+nrm+1)+wn1*(nf+ncoal+nri+nrm+1)
n,xn+1,0,0,0
n,xn+nw1+1,0,w1*cos(alpha*3.1415926/180),0
fill,xn+1,xn+nw1+1

n,xn+nw1+ne1+1,0,(w1+e1)*cos(alpha*3.1415926/180),0
fill,xn+nw1+1,xn+nw1+ne1+1

n,xn+nw1+ne1+np1+1,0,(w1+e1+p1)*cos(alpha*3.1415926/180),0
```

```
fill,xn+nw1+ne1+1,xn+nw1+ne1+np1+1

n,xn+nw1+ne1+np1+ne2+1,0,(w1+e1+p1+e2)*cos(alpha*3.1415926/180),0
fill,xn+nw1+ne1+np1+1,xn+nw1+ne1+np1+ne2+1

n,xn+nw1+ne1+np1+ne2+nw2+1,0,(w1+e1+p1+e2+w2)*cos(alpha*3.1415926
/180),0
fill,xn+nw1+ne1+np1+ne2+1,xn+nw1+ne1+np1+ne2+nw2+1

ngen,nw1+1,k0+1,xn+1,xn+k0+1,,(w1*sin(alpha*3.1415926/180))/nw1
ngen,ne1+1,k0+1,xn+nw1*(k0+1)+1,xn+(nw1+1)*(k0+1),,(e1*sin(alpha*
3.1415926/180))/ne1
ngen,np1+1,k0+1,xn+(nw1+ne1)*(k0+1)+1,xn+(nw1+ne1+1)*(k0+1),,(p1*
sin(alpha*3.1415926/180))/np1
ngen,ne2+1,k0+1,xn+(nw1+ne1+np1)*(k0+1)+1,xn+(nw1+ne1+np1+1)*(k0+
1),,(e2*sin(alpha*3.1415926/180))/ne2
ngen,nw2+1,k0+1,xn+(nw1+ne1+np1+ne2)*(k0+1)+1,xn+(nw1+ne1+np1+ne2
+1)*(k0+1),,(w2*sin(alpha*3.1415926/180))/nw2

x3=k0+2
xn1=(k0+1)*(k0+1)

!q=k0+1

ngen,nf+1,xn1,xn+1,xn+xn1,,0,0,fthick/nf
ngen,ncoal+1,xn1,xn+nf*xn1+1,xn+(nf+1)*xn1,,0,0,cthick/ncoal
ngen,nri+1,xn1,xn+(nf+ncoal)*xn1+1,xn+(nf+ncoal+1)*xn1,,0,0,rithi
ck/nri
ngen,nrm+1,xn1,xn+(nf+ncoal+nri)*xn1+1,xn+(nf+nri+ncoal+1)*xn1,,0
,0,rmthick/nrm
!ngen,nrm2+1,xn1,xn+(nf+ncoal+nri+nrm1)*xn1+1,xn+(nf+nri+ncoal+nr
m1+1)*xn1,,0,0,rm2thick/nrm2

*do,k,1,nf+ncoal+nri+nrm

*if,k,le,nf,then,
          mat,1
*elseif,k,gt,nf,then
     *if,k,le,(nf+ncoal),then
          mat,2
     *elseif,k,gt,(nf+ncoal),then

          *if,k,le,(nf+ncoal+nri),then
               mat,3
          *else
               mat,4
          *endif
     *endif
*endif

qq=xn+k*xn1
qqq=xn+(k-1)*xn1

z=(k0+1)*(nl1+nc+nc1+m1+m2+nl2)
```

```
*do,i,1,k0
*do,j,1,k0-i+1

*if,j,eq,1,then,

e,(k-1)*v3+z+i,(k-1)*v3+z+i+1,qqq+(i-1)*x3+2,qqq+(i-1)*x3+2,k*v3+
z+i,k*v3+z+i+1,qq+(i-1)*x3+2,qq+(i-1)*x3+2

*elseif,j,eq,2,then,

e,qqq+(i-1)*x3+j,(k-1)*v3+z+i+1,qqq+i*x3+j,qqq+(i-1)*x3+3,qq+(i-1
)*x3+j,k*v3+z+i+1,qq+i*x3+j,qq+(i-1)*x3+3

*else

e,qqq+(i-1)*x3+j,qqq+i*x3+j-1,qqq+i*x3+j,qqq+(i-1)*x3+j+1,qq+(i-1
)*x3+j,qq+i*x3+j-1,qq+i*x3+j,qq+(i-1)*x3+j+1

*endif

*enddo
*enddo
*enddo


csys,0
!-------------------------------------
local,11,0,w1+e1+p1+e2+w2,l1+c+c1+tt1+tt2+l2,0,-(180-alpha),,,1,1
                ! for subjoined area 3

tn=xn+xn1*(nf+ncoal+nri+nrm+1)

n,tn+1,0,0,0
n,tn+nl2+1,0,l2*cos(alpha*3.1415926/180),0
fill

n,tn+nl2+m2+1,0,(l2+tt2)*cos(alpha*3.1415926/180),0
fill,tn+nl2+1,tn+nl2+m2+1

n,tn+nl2+m2+m1+1,0,(l2+tt2+tt1)*cos(alpha*3.1415926/180),0
fill,tn+nl2+m2+1,tn+nl2+m2+m1+1

n,tn+nl2+m2+m1+nc1+1,0,(l2+tt2+tt1+c1)*cos(alpha*3.1415926/180),0
fill,tn+nl2+m2+m1+1,tn+nl2+m2+m1+nc1+1

n,tn+nl2+m2+m1+nc1+nc+1,0,(l2+tt2+tt1+c1+c)*cos(alpha*3.1415926/1
80),0
fill,tn+nl2+m2+m1+nc1+1,tn+nl2+m2+m1+nc1+nc+1

n,tn+nl2+m2+m1+nc1+nc+nl1+1,0,(l2+tt2+tt1+c1+c+l1)*cos(alpha*3.14
15926/180),0
fill,tn+nl2+m2+m1+nc1+nc+1,tn+nl2+m2+m1+nc1+nc+nl1+1

ngen,nl2+1,k1,tn+1,tn+k1,,(l2*sin(alpha*3.1415926/180))/nl2
```

```
ngen,m2+1,k1,tn+nl2*k1+1,tn+(nl2+1)*k1,,(tt2*sin(alpha*3.1415926/
180))/m2
ngen,m1+1,k1,tn+(nl2+m2)*k1+1,tn+(nl2+m2+1)*k1,,(tt1*sin(alpha*3.
1415926/180))/m1
ngen,nc1+1,k1,tn+(nl2+m2+m1)*k1+1,tn+(nl2+m2+m1+1)*k1,,(c1*sin(al
pha*3.1415926/180))/nc1
ngen,nc+1,k1,tn+(nl2+m2+m1+nc1)*k1+1,tn+(nl2+m2+m1+nc1+1)*k1,,(c*
sin(alpha*3.1415926/180))/nc
ngen,nl1+1,k1,tn+(nl2+m2+m1+nc1+nc)*k1+1,tn+(nl2+m2+m1+nc1+nc+1)*
k1,,(l1*sin(alpha*3.1415926/180))/nl1

!x2=nl1+nt+nl2+2

!wn1=(nl1+nt+nl2+1)*(nl1+nt+nl2+1)

!q=k0+1

ngen,nf+1,wn1,tn+1,tn+wn1,,0,0,fthick/nf
ngen,ncoal+1,wn1,tn+nf*wn1+1,tn+(nf+1)*wn1,,0,0,cthick/ncoal
ngen,nri+1,wn1,tn+(nf+ncoal)*wn1+1,tn+(nf+ncoal+1)*wn1,,0,0,rithi
ck/nri
ngen,nrm+1,wn1,tn+(nf+ncoal+nri)*wn1+1,tn+(nf+nri+ncoal+1)*wn1,,0
,0,rmthick/nrm
!ngen,nrm2+1,wn1,tn+(nf+ncoal+nri+nrm1)*wn1+1,tn+(nf+nri+ncoal+nr
m1+1)*wn1,,0,0,rm2thick/nrm2

*do,k,1,nf+ncoal+nri+nrm

*if,k,le,nf,then,
          mat,1
*elseif,k,gt,nf,then
     *if,k,le,(nf+ncoal),then
          mat,2
     *elseif,k,gt,(nf+ncoal),then

          *if,k,le,(nf+ncoal+nri),then
               mat,3
          *else
               mat,4
          *endif
     *endif
*endif

qp=tn+wn1*(k-1)
pq=tn+k*wn1

*do,i,1,nl1+nc+nc1+m1+m2+nl2
*do,j,1,nl1+nc+nc1+m1+m2+nl2-i+1

*if,j,eq,1,then,

e,v3*(k-1)+(x2-i)*q,v3*(k-1)+(x2-1-i)*q,qp+(i-1)*x2+2,qp+(i-1)*x2
+2,k*v3+(x2-i)*q,k*v3+(x2-1-i)*q,pq+(i-1)*x2+2,pq+(i-1)*x2+2
```

```
*elseif,j,eq,2,then,

e,qp+(i-1)*x2+2,v3*(k-1)+(x2-1-i)*q,qp+i*x2+j,qp+(i-1)*x2+3,pq+(i
-1)*x2+2,k*v3+(x2-1-i)*q,pq+i*x2+j,pq+(i-1)*x2+3

*else

e,qp+(i-1)*x2+j,qp+i*x2+j-1,qp+i*x2+j,qp+(i-1)*x2+j+1,pq+(i-1)*x2
+j,pq+i*x2+j-1,pq+i*x2+j,pq+(i-1)*x2+j+1

*endif

*enddo
*enddo
*enddo


!---------------- ! for subjoined area 4
csys,0

local,11,0,w1+e1+p1+e2+w2,0,0,-(270-alpha),,,1,1

xt=tn+wn1*(nf+ncoal+nri+nrm+1)

n,xt+1,0,0,0
n,xt+nw2+1,0,w2*cos(alpha*3.1415926/180),0
fill,xt+1,xt+nw2+1

n,xt+nw2+ne2+1,0,(w2+e2)*cos(alpha*3.1415926/180),0
fill,xt+nw2+1,xt+nw2+ne2+1

n,xt+nw2+ne2+np1+1,0,(w2+e2+p1)*cos(alpha*3.1415926/180),0
fill,xt+nw2+ne2+1,xt+nw2+ne2+np1+1

n,xt+nw2+ne2+np1+ne1+1,0,(w2+e2+p1+e1)*cos(alpha*3.1415926/180),0
fill,xt+nw2+ne2+np1+1,xt+nw2+ne2+np1+ne1+1

n,xt+nw2+ne2+np1+ne1+nw1+1,0,(w2+e2+p1+e1+w1)*cos(alpha*3.1415926
/180),0
fill,xt+nw2+ne2+np1+ne1+1,xt+nw2+ne2+np1+ne1+nw1+1


ngen,nw2+1,k0+1,xt+1,xt+k0+1,,(w2*sin(alpha*3.1415926/180))/nw2
ngen,ne2+1,k0+1,xt+nw2*(k0+1)+1,xt+(nw2+1)*(k0+1),,(e2*sin(alpha*
3.1415926/180))/ne2
ngen,np1+1,k0+1,xt+(nw2+ne2)*(k0+1)+1,xt+(nw2+ne2+1)*(k0+1),,(p1*
sin(alpha*3.1415926/180))/np1
ngen,ne1+1,k0+1,xt+(nw2+ne2+np1)*(k0+1)+1,xt+(nw2+ne2+np1+1)*(k0+
1),,(e1*sin(alpha*3.1415926/180))/ne1
ngen,nw1+1,k0+1,xt+(nw2+ne2+np1+ne1)*(k0+1)+1,xt+(nw2+ne2+np1+ne1
+1)*(k0+1),,(w1*sin(alpha*3.1415926/180))/nw1

!x3=nw1+ne1+nw2+2
!xn1=(nw1+ne1+nw2+1)*(nw1+ne1+nw2+1)
```

```
!q=k0+1

ngen,nf+1,xn1,xt+1,xt+xn1,,0,0,fthick/nf
ngen,ncoal+1,xn1,xt+nf*xn1+1,xt+(nf+1)*xn1,,0,0,cthick/ncoal
ngen,nri+1,xn1,xt+(nf+ncoal)*xn1+1,xt+(nf+ncoal+1)*xn1,,0,0,rithi
ck/nri
ngen,nrm+1,xn1,xt+(nf+ncoal+nri)*xn1+1,xt+(nf+nri+ncoal+1)*xn1,,0
,0,rmthick/nrm
!ngen,nrm2+1,xn1,xt+(nf+ncoal+nri+nrm1)*xn1+1,xt+(nf+nri+ncoal+nr
m1+1)*xn1,,0,0,rm2thick/nrm2

*do,k,1,nf+ncoal+nri+nrm
*if,k,le,nf,then,
          mat,1
*elseif,k,gt,nf,then
     *if,k,le,(nf+ncoal),then
          mat,2
     *elseif,k,gt,(nf+ncoal),then

          *if,k,le,(nf+ncoal+nri),then
               mat,3
          *else
               mat,4
          *endif
     *endif
*endif

bq=xt+(k-1)*xn1
cq=xt+k*xn1

*do,i,1,nw1+ne1+np1+ne2+nw2
*do,j,1,nw1+ne1+np1+ne2+nw2-i+1

*if,j,eq,1,then,

e,(k-1)*v3+(x3-i),(k-1)*v3+x3-i-1,bq+(i-1)*x3+2,bq+(i-1)*x3+2,k*v
3+x3-i,k*v3+x3-i-1,cq+(i-1)*x3+2,cq+(i-1)*x3+2

*elseif,j,eq,2,then,

e,bq+(i-1)*x3+j,(k-1)*v3+x3-i-1,bq+i*x3+j,bq+(i-1)*x3+3,cq+(i-1)*
x3+j,k*v3+x3-i-1,cq+i*x3+j,cq+(i-1)*x3+3

*else

e,bq+(i-1)*x3+j,bq+i*x3+j-1,bq+i*x3+j,bq+(i-1)*x3+j+1,cq+(i-1)*x3
+j,cq+i*x3+j-1,cq+i*x3+j,cq+(i-1)*x3+j+1

*endif

*enddo
*enddo
*enddo
```

```
csys,0

*endif


nsel,s,loc,z,fthick+cthick+rithick+rmthick
sf,all,pres,1.1*cburden
nsel,all

local,11,0,0,0,0,alpha,,,1,1        ! for subjoined area 1
nsel,s,loc,x,-5,5
sf,all,pres,hstress1
nsel,all
csys,0


local,11,0,0,l1+c+c1+tt1+tt2+l2,0,-(90-alpha),,,1,1          ! for
subjoined area 2
nsel,s,loc,x,-5,5
sf,all,pres,hstress2
nsel,all
csys,0

local,11,0,w1+e1+p1+e2+w2,l1+c+c1+tt1+tt2+l2,0,-(180-alpha),,,1,1
     ! for subjoined area 3
nsel,s,loc,x,-5,5
sf,all,pres,hstress1
nsel,all
csys,0

local,11,0,w1+e1+p1+e2+w2,0,0,-(270-alpha),,,1,1
nsel,s,loc,x,-5,5
sf,all,pres,hstress2
nsel,all


csys,0
nsel,s,loc,x,0
nsel,r,loc,y,0
nsel,r,loc,z,0
d,all,ux,0
d,all,uy,0
nsel,all


EPLOT
/PNUM,KP,0
/PNUM,LINE,0
/PNUM,AREA,0
/PNUM,VOLU,0
/PNUM,NODE,0
/PNUM,SVAL,0
/NUM,0
```

```
/PNUM,MAT,1

/PSF,PRES,NORM,2
/PBF,DEFA, ,1
/PSYMB,CS,0
/PSYMB,NDIR,0
/PSYMB,ESYS,0
/PSYMB,LDIR,0
/PSYMB,PCONV,
/PSYMB,LAYR,0

/PBC,ALL, ,1
/REPLOT


nsel,s,loc,z,0
d,all,uz,0
nsel,all

nsel,s,loc,x,0
nsel,r,loc,y,0
nsel,r,loc,z,0
d,all,ux,0
d,all,uy,0
nsel,all
```

```
!Model for 3-dimensional three entry system, entry can be turned
/prep7
/title
/nopr
antype,static

/PLOPTS,INFO,0
/PLOPTS,LEG1,1
/PLOPTS,LEG2,1
/PLOPTS,LEG3,1
/PLOPTS,FRAME,1
/PLOPTS,TITLE,1
/PLOPTS,MINM,1
/PLOPTS,VERS,0
/PLOPTS,WINS,1
/PLOPTS,WP,0
/TRIAD,ORIG


*ask,cburden, 'overburden depth',800
*ask,hstress1,'1st horizontal stress',1000
*ask,hstress2,'2nd horizontal stress',500

*ask,ymfh,'floor hori. Y.M.',2e6
*ask,ymfv,'floor verti. Y.M.',1e6

*ask,ymc,'coal Y.M.',1e5

*ask,ymrih,'imm. roof hori. Y.M.',2e6
*ask,ymriv,'imm. roof verti. Y.M.',1e6

*ask,ymrmh,'main roof hori. Y.M.',2e6
*ask,ymrmv,'main roof verti. Y.M.',1e6

*ask,w1,'left solid width',100*12
*ask,e1,'entry 1 width',16*12
*ask,p1,'pillar 1 width',60*12
*ask,e2,'entry 2 width',16*12
*ask,p2,'pillar 2 width',50*12
*ask,e3,'entry 3 width',16*12
*ask,w2,'right solid width',100*12

*ask,nw1,'# elem. left solid',3
*ask,ne1,'# elem. entry 1',2
*ask,np1,'# elem. pillar 1',4

*ask,ne2,'# elem. entry 2',2
*ask,np2,'# elem. pillar 3',2

*ask,ne3,'# elem. entry 3',2
*ask,nw2,'# elem. right solid',3


*ask,l1,' asdsdf',100*12
```

```
*ask,c,'distance to 1st Xcut',50*12
*ask,d,'distance to 2nd Xcut',30*12
*ask,c1,'Xcut between entry 1&2',16*12
*ask,c2,'Xcut between entry 2&3',16*12

*ask,nl1,'# elem. along L1',3
*if,c,gt,d,then,
     *ask,nd,'# elem. to 2nd Xcut',2
     *ask,nc2,'# elem. 2nd Xcut',2
     *ask,nl3,'# elem. in C-D',2
     *ask,nc1,'# elem. 1st Xcut',2

     CV1=d
     NCV1=nd
     CV2=c2
     NCV2=nc2
     CV3=c-d
     NCV3=nl3
     CV4=c1
     NCV4=nc1

*elseif,c,eq,d,then,
     *ask,nd,'# elem. to either Xcut',2
     *ask,nc2,'# elem. either Xcut',2

     CV1=d
     NCV1=nd
     CV2=c2
     NCV2=nc2
     CV3=0
     NCV3=0
     CV4=0
     NCV4=0


*elseif,c,lt,d,then,
     *ask,nc,'# elem. to 1st Xcut',2
     *ask,nc1,'# elem. 1st Xcut',2
     *ask,nl3,'# elem. in D-C',2
     *ask,nc2,'# elem. 2nd Xcut',2

     CV1=c
     NCV1=nc
     CV2=c1
     NCV2=nc1
     CV3=d-c
     NCV3=nl3
     CV4=c2
     NCV4=nc2

*endif


*ask,t1,'dist. from inby rib of inby Xcut to face for #1',50*12
```

```
      M1=NT2
      M2=NT1B
      M3=NT3B

      TT1=T2
      TT2=T1-T2
      TT3=T3-T1

      *endif


    *elseif,t1,eq,t3,then

      *ask,nt2,'# elem. in t2',2
      *ask,nt1b,'# elem. in (t1 or t3)-t2',2

      M1=NT2
      M2=NT1B
      M3=0

      TT1=T2
      TT2=T1-T2

   *endif

 *elseif,t1,lt,t2,then

    *if,t1,lt,t3,then
      *if,t2,gt,t3,then
           *ask,nt1,'# elem. in t1',2
           *ask,nt3b,'# elem. in t3-t1',2
           *ask,nt2b,'# elem. in t2-t3',2

      M1=NT1
      M2=NT3B
      M3=NT2B

      TT1=T1
      TT2=T3-T1
      TT3=T2-T3


      *elseif,t2,lt,t3,then
           *ask,nt1,'# elem. in t1',2
           *ask,nt2b,'# elem. in t2-t1',2
           *ask,nt3b,'# elem. in t3-t2',2

      M1=NT1
      M2=NT2B
      M3=NT3B

      TT1=T1
      TT2=T2-T1
      TT3=T3-T2
```

```
      *elseif,t2,eq,t3,then
           *ask,nt1,'# elem. in t1',2
           *ask,nt2b,'# elem. in t2-t1',2

      M1=NT1
      M2=NT2B
      M3=0

      TT1=T1
      TT2=T2-T1

      *endif

    *elseif,t1,gt,t3,then

      *if,t2,gt,t3,then
           *ask,nt3,'# elem. in t3',2
           *ask,nt1b,'# elem. in t1-t3',2
           *ask,nt2b,'# elem. in t2-t1',2

      M1=NT3
      M2=NT1B
      M3=NT2B

      TT1=T3
      TT2=T1-T3
      TT3=T2-T1


      *endif

    *elseif,t1,eq,t3,then
      *ask,nt1,'# elem. in t1 or t3',2
      *ask,nt2b,'# elem. in t2-(t1 or t3)',2

      M1=NT1
      M2=NT2B
      M3=0

      TT1=T1
      TT2=T2-T1

    *endif


  *elseif,t1,eq,t2,then

      *if,t1,lt,t3,then
           *ask,nt1,'# elem. in t1',2
           *ask,nt3b,'# elem. in t3-(t1 or t2)',2

      M1=NT1
      M2=NT3B
```

```
     M3=0

     TT1=T1
     TT2=T3-T1


     *elseif,t1,gt,t3,then
          *ask,nt3,'# elem. in t3',2
          *ask,nt1b,'# elem. in (t1 or t2)-t3',2

     M1=NT3
     M2=NT1B
     M3=0

     TT1=T3
     TT2=T1-T3


     *elseif,t1,eq,t3,then
          *ask,nt1,'# elem. in t1 or t2 or t3',2

     M1=NT1
     M2=0
     M3=0

     TT1=T1

     *endif

*endif


nt=M1+M2+M3


*ask,l2,'from most inby face to boundary',100*12
*ask,nl2,'# elem. in L2',3

*ask,fthick,'floor thickness',60*12
*ask,nf,'# elem. floor heightwise',3

*ask,cthick,'coal thickness',6*12
*ask,ncoal,'# elem. coal heightwise',2

*ask,rithick,'imm. roof thickness',20*12
*ask,nri,'# elem. imm. roof heightwise',3

*ask,rmthick,'main roof thickness',60*12
*ask,nrm,'# elem. main roof heightwise',3

*ask,alpha,'angle of turn',20

n,1,
```

```
n,nw1+1,w1,0,0
fill

n,nw1+1+ne1,w1+e1,0,0
fill,nw1+1,nw1+1+ne1

n,nw1+1+ne1+np1,w1+e1+p1,0,0
fill,nw1+1+ne1,nw1+1+ne1+np1

n,nw1+1+ne1+np1+ne2,w1+e1+p1+e2,0,0
fill,nw1+1+ne1+np1,nw1+1+ne1+np1+ne2

n,nw1+1+ne1+np1+ne2+np2,w1+e1+p1+e2+p2,0,0
fill,nw1+1+ne1+np1+ne2,nw1+1+ne1+np1+ne2+np2

n,nw1+1+ne1+np1+ne2+np2+ne3,w1+e1+p1+e2+p2+e3,0,0
fill,nw1+1+ne1+np1+ne2+np2,nw1+1+ne1+np1+ne2+np2+ne3

n,nw1+1+ne1+np1+ne2+np2+ne3+nw2,w1+e1+p1+e2+p2+e3+w2,0,0
fill,nw1+1+ne1+np1+ne2+np2+ne3,nw1+1+ne1+np1+ne2+np2+ne3+nw2

k0=nw1+ne1+np1+ne2+np2+ne3+nw2
ngen,nl1+1,k0+1,1,k0+1,,,l1/nl1,,

*if,c,gt,d,then

     ngen,nd+1,k0+1,(nl1)*(k0+1)+1,(nl1+1)*(k0+1),,,d/nd,,
     ngen,nc2+1,k0+1,(nl1+nd)*(k0+1)+1,(nl1+nd+1)*(k0+1),,,c2/nc2

ngen,nl3+1,k0+1,(nl1+nd+nc2)*(k0+1)+1,(nl1+nd+nc2+1)*(k0+1),,,(c-
d)/nl3

ngen,nc1+1,k0+1,(nl1+nd+nc2+nl3)*(k0+1)+1,(nl1+nd+nc2+nl3+1)*(k0+
1),,,c1/nc1

ngen,m1+1,k0+1,(nl1+nd+nc2+nl3+nc1)*(k0+1)+1,(nl1+nd+nc2+nl3+nc1+
1)*(k0+1),,,TT1/M1
     *if,M2,ne,0,then

ngen,m2+1,k0+1,(nl1+nd+nc2+nl3+nc1+m1)*(k0+1)+1,(nl1+nd+nc2+nl3+n
c1+m1+1)*(k0+1),,,TT2/M2
     *endif

     *if,M3,ne,0,then

ngen,m3+1,k0+1,(nl1+nd+nc2+nl3+nc1+m1+m2)*(k0+1)+1,(nl1+nd+nc2+nl
3+nc1+m1+m2+1)*(k0+1),,,TT3/M3
     *endif


ngen,nl2+1,k0+1,(nl1+nd+nc2+nl3+nc1+nt)*(k0+1)+1,(nl1+nd+nc2+nl3+
nc1+nt+1)*(k0+1),,,l2/nl2

ngen,nf+1,(nl1+nd+nc2+nl3+nc1+nt+nl2+1)*(k0+1),1,(nl1+nd+nc2+nl3+
```

```
nc1+nt+nl2+1)*(k0+1),,0,0,fthick/nf
      v1=(nl1+nd+nc2+nl3+nc1+nt+nl2+1)*(k0+1)

ngen,ncoal+1,(nl1+nd+nc2+nl3+nc1+nt+nl2+1)*(k0+1),nf*v1+1,(nf+1)*
v1,,0,0,cthick/ncoal

ngen,nri+1,(nl1+nd+nc2+nl3+nc1+nt+nl2+1)*(k0+1),(nf+ncoal)*v1+1,(
nf+ncoal+1)*v1,,0,0,rithick/nri

ngen,nrm+1,(nl1+nd+nc2+nl3+nc1+nt+nl2+1)*(k0+1),(nf+ncoal+nri)*v1
+1,(nf+nri+ncoal+1)*v1,,0,0,rmthick/nrm

*elseif,c,eq,d,then,
      ngen,nd+1,k0+1,(nl1)*(k0+1)+1,(nl1+1)*(k0+1),,,d/nd,,
      ngen,nc2+1,k0+1,(nl1+nd)*(k0+1)+1,(nl1+nd+1)*(k0+1),,,c2/nc2

ngen,m1+1,k0+1,(nl1+nd+nc2)*(k0+1)+1,(nl1+nd+nc2+1)*(k0+1),,,TT1/M1
      *if,M2,ne,0,then

ngen,m2+1,k0+1,(nl1+nd+nc2+m1)*(k0+1)+1,(nl1+nd+nc2+m1+1)*(k0+1),
,,TT2/M2
      *endif

      *if,M3,ne,0,then

ngen,m3+1,k0+1,(nl1+nd+nc2+m1+m2)*(k0+1)+1,(nl1+nd+nc2+m1+m2+1)*(
k0+1),,,TT3/M3
      *endif

ngen,nl2+1,k0+1,(nl1+nd+nc2+nt)*(k0+1)+1,(nl1+nd+nc2+nt+1)*(k0+1)
,,,l2/nl2

ngen,nf+1,(nl1+nd+nc2+nt+nl2+1)*(k0+1),1,(nl1+nd+nc2+nt+nl2+1)*(k
0+1),,0,0,fthick/nf

      v2=(nl1+nd+nc2+nt+nl2+1)*(k0+1)

ngen,ncoal+1,(nl1+nd+nc2+nt+nl2+1)*(k0+1),nf*v2+1,(nf+1)*v2,,0,0,
cthick/ncoal

ngen,nri+1,(nl1+nd+nc2+nt+nl2+1)*(k0+1),(nf+ncoal)*v2+1,(nf+ncoal
+1)*v2,,0,0,rithick/nri

ngen,nrm+1,(nl1+nd+nc2+nt+nl2+1)*(k0+1),(nf+ncoal+nri)*v2+1,(nf+n
ri+ncoal+1)*v2,,0,0,rmthick/nrm
```

```
*elseif,c,lt,d,then
     ngen,nc+1,k0+1,(nl1)*(k0+1)+1,(nl1+1)*(k0+1),,,c/nc,,
     ngen,nc1+1,k0+1,(nl1+nc)*(k0+1)+1,(nl1+nc+1)*(k0+1),,,c1/nc1

ngen,nl3+1,k0+1,(nl1+nc+nc1)*(k0+1)+1,(nl1+nc+nc1+1)*(k0+1),,,(d-
c)/nl3

ngen,nc2+1,k0+1,(nl1+nc+nc1+nl3)*(k0+1)+1,(nl1+nc+nc1+nl3+1)*(k0+
1),,,c2/nc2


ngen,m1+1,k0+1,(nl1+nc+nc2+nl3+nc1)*(k0+1)+1,(nl1+nc+nc2+nl3+nc1+
1)*(k0+1),,,TT1/M1

     *if,M2,ne,0,then

ngen,m2+1,k0+1,(nl1+nc+nc2+nl3+nc1+m1)*(k0+1)+1,(nl1+nc+nc2+nl3+n
c1+m1+1)*(k0+1),,,TT2/M2
     *endif

     *if,M3,ne,0,then

ngen,m3+1,k0+1,(nl1+nc+nc2+nl3+nc1+m1+m2)*(k0+1)+1,(nl1+nc+nc2+nl
3+nc1+m1+m2+1)*(k0+1),,,TT3/M3
     *endif


ngen,nl2+1,k0+1,(nl1+nc+nc1+nl3+nc2+nt)*(k0+1)+1,(nl1+nc+nc1+nl3+
nc2+nt+1)*(k0+1),,,l2/nl2


ngen,nf+1,(nl1+nc+nc1+nl3+nc2+nt+nl2+1)*(k0+1),1,(nl1+nc+nc1+nl3+
nc2+nt+nl2+1)*(k0+1),,0,0,fthick/nf

     v3=(nl1+nc+nc1+nl3+nc2+nt+nl2+1)*(k0+1)


ngen,ncoal+1,(nl1+nc+nc2+nl3+nc1+nt+nl2+1)*(k0+1),nf*v3+1,(nf+1)*
v3,,0,0,cthick/ncoal

ngen,nri+1,(nl1+nc+nc2+nl3+nc1+nt+nl2+1)*(k0+1),(nf+ncoal)*v3+1,(
nf+ncoal+1)*v3,,0,0,rithick/nri

ngen,nrm+1,(nl1+nc+nc2+nl3+nc1+nt+nl2+1)*(k0+1),(nf+ncoal+nri)*v3
+1,(nf+nri+ncoal+1)*v3,,0,0,rmthick/nrm


*endif

ET,1,solid64

uimp,1,ex,ey,ez,ymfh,ymfh,ymfv
```

```
uimp,2,ex,ey,ez,ymc,ymc,ymc
uimp,3,ex,ey,ez,ymrih,ymrih,ymriv
uimp,4,ex,ey,ez,ymrmh,ymrmh,ymrmv


*if,c,gt,d,then,

     mat,1
     e,1,2,(k0+1)+2,(k0+1)+1,v1+1,v1+2,v1+(k0+1)+2,v1+(k0+1)+1
     egen,k0,1,-1
     egen,(nl1+nd+nc2+nl3+nc1+nt+nl2),k0+1,-k0
     egen,nf+ncoal+nri+nrm,v1,-(nl1+nd+nc2+nl3+nc1+nt+nl2)*k0

     e         s         e         l         ,         s         ,
elem,,nf*(nl1+nd+nc2+nl3+nc1+nt+nl2)*k0+1,(nf+ncoal)*(nl1+nd+nc2+
nl3+nc1+nt+nl2)*k0
     emodif,all,mat,2
     esel,all

     e         s         e         l         ,         s         ,
elem,,(nf+ncoal)*(nl1+nd+nc2+nl3+nc1+nt+nl2)*k0+1,(nf+ncoal+nri)*
(nl1+nd+nc2+nl3+nc1+nt+nl2)*k0
     emodif,all,mat,3
     esel,all

     e         s         e         l         ,         s         ,
elem,,(nf+ncoal+nri)*(nl1+nd+nc2+nl3+nc1+nt+nl2)*k0+1,(nf+ncoal+n
ri+nrm)*(nl1+nd+nc2+nl3+nc1+nt+nl2)*k0
     emodif,all,mat,4
     esel,all


incr=(nl1+nd+nc2+nl3+nc1+nt+nl2)*k0

temp1=nw1+ne1+np1
temp2=nw1+ne1+np1+ne2+np2

*do,j,1,ncoal

tot1=nf*(nl1+nd+nc2+nl3+nc1+nt+nl2)*k0

tot0=tot1+nl1*k0

*do,i,1,nd

edele,tot0+nw1+1+(i-1)*k0+(j-1)*incr,tot0+nw1+ne1+(i-1)*k0+(j-1)*
incr,
edele,tot0+temp1+1+(i-1)*k0+(j-1)*incr,tot0+temp1+ne2+(i-1)*k0+(j
-1)*incr,
edele,tot0+temp2+1+(i-1)*k0+(j-1)*incr,tot0+temp2+ne3+(i-1)*k0+(j
-1)*incr,

*enddo
```

```
tot2=tot1+(nl1+nd)*k0

*do,i,1,nc2
edele,tot2+nw1+1+(i-1)*k0+(j-1)*incr,tot2+nw1+ne1+(i-1)*k0+(j-1)*
incr,
edele,tot2+temp1+1+(i-1)*k0+(j-1)*incr,tot2+temp2+ne3+(i-1)*k0+(j
-1)*incr
*enddo

tot3=tot2+nc2*k0

*do,i,1,nl3
edele,tot3+nw1+1+(i-1)*k0+(j-1)*incr,tot3+nw1+ne1+(i-1)*k0+(j-1)*
incr
edele,tot3+temp1+1+(i-1)*k0+(j-1)*incr,tot3+temp1+ne2+(i-1)*k0+(j
-1)*incr
edele,tot3+temp2+1+(i-1)*k0+(j-1)*incr,tot3+temp2+ne3+(i-1)*k0+(j
-1)*incr
*enddo

tot4=tot3+nl3*k0

*do,i,1,nc1
edele,tot4+nw1+1+(i-1)*k0+(j-1)*incr,tot4+temp1+ne2+(i-1)*k0+(j-1
)*incr
edele,tot4+temp2+1+(i-1)*k0+(j-1)*incr,tot4+temp2+ne3+(i-1)*k0+(j
-1)*incr
*enddo

tot5=tot4+nc1*k0


!-----------------------

*if,t1,gt,t2,then

   *if,t1,gt,t3,then

     *if,t2,gt,t3,then    ! 1

          *do,i,1,nt3

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt3*k0
```

```
          *do,i,1,nt2b
edele,tot6+nw1+1+(i-1)*k0+(j-1)*incr,tot6+nw1+ne1+(i-1)*k0+(j-1)*
incr
edele,tot6+temp1+1+(i-1)*k0+(j-1)*incr,tot6+temp1+ne2+(i-1)*k0+(j
-1)*incr
          *enddo
          tot7=tot6+nt2b*k0
          *do,i,1,nt1b
edele,tot7+nw1+1+(i-1)*k0+(j-1)*incr,tot7+nw1+ne1+(i-1)*k0+(j-1)*
incr
          *enddo


     *elseif,t2,eq,t3,then     !2
          *do,i,1,nt2
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
-1)*incr
          *enddo
          tot6=tot5+nt2*k0
          *do,i,1,nt1b
edele,tot6+mw1+1+(i-1)*k0+(j-1)*incr,tot6+nw1+ne1+(i-1)*k0+(j-1)*
incr
          *enddo


     *elseif,t2,lt,t3,then     !3


          *do,i,1,nt2
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
```

```
-1)*incr
          *enddo

          tot6=tot5+nt2*k0

          *do,i,1,nt3b

edele,tot6+nw1+1+(i-1)*k0+(j-1)*incr,tot6+nw1+ne1+(i-1)*k0+(j-1)*
incr

edele,tot6+temp2+1+(i-1)*k0+(j-1)*incr,tot6+temp2+ne3+(i-1)*k0+(j
-1)*incr
          *enddo

          tot7=tot6+nt3b*k0

          *do,i,1,nt1b

edele,tot7+mw1+1+(i-1)*k0+(j-1)*incr,tot7+nw1+ne1+(i-1)*k0+(j-1)*
incr
          *enddo

     *endif


  *elseif,t1,lt,t3,then

     *if,t2,lt,t3,then    !4

          *do,i,1,nt2

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt2*k0

          *do,i,1,nt1b

edele,tot6+nw1+1+(i-1)*k0+(j-1)*incr,tot6+nw1+ne1+(i-1)*k0+(j-1)*
incr

edele,tot6+temp2+1+(i-1)*k0+(j-1)*incr,tot6+temp2+ne3+(i-1)*k0+(j
-1)*incr
          *enddo

          tot7=tot6+nt1b*k0
```

```
          *do,i,1,nt3b
edele,tot7+temp2+1+(i-1)*k0+(j-1)*incr,tot7+temp2+ne3+(i-1)*k0+(j
-1)*incr
          *enddo
     *endif

   *elseif,t1,eq,t3,then !5
          *do,i,1,nt2
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
-1)*incr
          *enddo
          tot6=tot5+nt2*k0

          *do,i,1,nt1b
edele,tot6+nw1+1+(i-1)*k0+(j-1)*incr,tot6+nw1+ne1+(i-1)*k0+(j-1)*
incr
edele,tot6+temp2+1+(i-1)*k0+(j-1)*incr,tot6+temp2+ne3+(i-1)*k0+(j
-1)*incr
          *enddo
     *endif
*elseif,t1,lt,t2,then
   *if,t1,lt,t3,then
     *if,t2,gt,t3,then   !6
          *do,i,1,nt1
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
-1)*incr
          *enddo
```

```
          tot6=tot5+nt1*k0

          *do,i,1,nt3b

edele,tot6+temp1+1+(i-1)*k0+(j-1)*incr,tot6+temp1+ne2+(i-1)*k0+(j
-1)*incr

edele,tot6+temp2+1+(i-1)*k0+(j-1)*incr,tot6+temp2+ne3+(i-1)*k0+(j
-1)*incr
          *enddo

          tot7=tot6+nt3b*k0

          *do,i,1,nt2b

edele,tot7+temp1+1+(i-1)*k0+(j-1)*incr,tot7+temp1+ne2+(i-1)*k0+(j
-1)*incr
          *enddo


     *elseif,t2,lt,t3,then     !7

          *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt1*k0

          *do,i,1,nt2b

edele,tot6+temp1+1+(i-1)*k0+(j-1)*incr,tot6+temp1+ne2+(i-1)*k0+(j
-1)*incr

edele,tot6+temp2+1+(i-1)*k0+(j-1)*incr,tot6+temp2+ne3+(i-1)*k0+(j
-1)*incr
          *enddo

          tot7=tot6+nt2b*k0

          *do,i,1,nt3b

edele,tot7+temp2+1+(i-1)*k0+(j-1)*incr,tot7+temp2+ne3+(i-1)*k0+(j
-1)*incr
          *enddo
```

```
     *elseif,t2,eq,t3,then     !8
          *do,i,1,nt1
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
-1)*incr
          *enddo
          tot6=tot5+nt1*k0
          *do,i,1,nt2b
edele,tot6+temp1+1+(i-1)*k0+(j-1)*incr,tot6+temp1+ne2+(i-1)*k0+(j
-1)*incr
edele,tot6+temp2+1+(i-1)*k0+(j-1)*incr,tot6+temp2+ne3+(i-1)*k0+(j
-1)*incr
          *enddo


     *endif
   *elseif,t1,gt,t3,then
     *if,t2,gt,t3,then    !9
          *do,i,1,nt3
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
-1)*incr
          *enddo
          tot6=tot5+nt3*k0
          *do,i,1,nt1b
edele,tot6+nw1+1+(i-1)*k0+(j-1)*incr,tot6+nw1+ne1+(i-1)*k0+(j-1)*
incr
edele,tot6+temp1+1+(i-1)*k0+(j-1)*incr,tot6+temp1+ne2+(i-1)*k0+(j
```

```
-1)*incr
          *enddo

          tot7=tot6+nt1b*k0

          *do,i,1,nt2b

edele,tot7+temp1+1+(i-1)*k0+(j-1)*incr,tot7+temp1+ne2+(i-1)*k0+(j
-1)*incr
          *enddo


     *endif

   *elseif,t1,eq,t3,then !10


          *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt1*k0

          *do,i,1,nt2b

edele,tot6+temp1+1+(i-1)*k0+(j-1)*incr,tot6+temp1+ne2+(i-1)*k0+(j
-1)*incr
          *enddo


   *endif


*elseif,t1,eq,t2,then

     *if,t1,lt,t3,then   !11


          *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr
```

```
edele,tot5+temp2+1+(i-1)*k0+(j-1)*incr,tot5+temp2+ne3+(i-1)*k0+(j
-1)*incr
          *enddo

          tot6=tot5+nt1*k0

          *do,i,1,nt3b

edele,tot6+temp2+1+(i-1)*k0+(j-1)*incr,tot6+temp2+ne3+(i-1)*k0+(j
-1)*incr
          *enddo


     *elseif,t1,gt,t3,then     !12


          *do,i,1,nt3

edele,tot5+mw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt3*k0

          *do,i,1,nt1b


edele,tot6+nw1+1+(i-1)*k0+(j-1)*incr,tot6+nw1+ne1+(i-1)*k0+(j-1)*
incr

edele,tot6+temp1+1+(i-1)*k0+(j-1)*incr,tot6+temp1+ne2+(i-1)*k0+(j
-1)*incr


          *enddo


     *elseif,t1,eq,t3,then      !13

     *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr
```

```
edele,tot5+temp2+1+(i-1)*k0+(j-1)*incr,tot5+temp2+ne3+(i-1)*k0+(j
-1)*incr
          *enddo


     *endif

*endif

*enddo
!----------------------------------------


*elseif,c,eq,d,then,

     mat,1
     e,1,2,(k0+1)+2,(k0+1)+1,v2+1,v2+2,v2+(k0+1)+2,v2+(k0+1)+1
     egen,k0,1,-1
     egen,(nl1+nd+nc2+nt+nl2),k0+1,-k0
     egen,nf+ncoal+nri+nrm,v2,-(nl1+nd+nc2+nt+nl2)*k0

     e         s         e         l         ,         s         ,
elem,,nf*(nl1+nd+nc2+nt+nl2)*k0+1,(nf+ncoal)*(nl1+nd+nc2+nt+nl2)*k0
     emodif,all,mat,2
     esel,all

     e         s         e         l         ,         s         ,
elem,,(nf+ncoal)*(nl1+nd+nc2+nt+nl2)*k0+1,(nf+ncoal+nri)*(nl1+nd+
nc2+nt+nl2)*k0
     emodif,all,mat,3
     esel,all

     e         s         e         l         ,         s         ,
elem,,(nf+ncoal+nri)*(nl1+nd+nc2+nt+nl2)*k0+1,(nf+ncoal+nri+nrm)*
(nl1+nd+nc2+nt+nl2)*k0
     emodif,all,mat,4
     esel,all


incr=(nl1+nd+nc2+nt+nl2)*k0

temp1=nw1+ne1+np1
temp2=nw1+ne1+np1+ne2+np2

*do,j,1,ncoal

tot1=nf*(nl1+nd+nc2+nt+nl2)*k0

tot0=tot1+nl1*k0

*do,i,1,nd
```

```
edele,tot0+nw1+1+(i-1)*k0+(j-1)*incr,tot0+nw1+ne1+(i-1)*k0+(j-1)*
incr,
edele,tot0+temp1+1+(i-1)*k0+(j-1)*incr,tot0+temp1+ne2+(i-1)*k0+(j
-1)*incr,
edele,tot0+temp2+1+(i-1)*k0+(j-1)*incr,tot0+temp2+ne3+(i-1)*k0+(j
-1)*incr,

*enddo


tot2=tot1+(nl1+nd)*k0

*do,i,1,nc2
edele,tot2+nw1+1+(i-1)*k0+(j-1)*incr,tot2+temp2+ne3+(i-1)*k0+(j-1
)*incr
*enddo


tot5=tot2+nc2*k0     !assume nc1=nc2

!-----------------------

*if,t1,gt,t2,then

   *if,t1,gt,t3,then

     *if,t2,gt,t3,then    ! 1

          *do,i,1,nt3

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt3*k0

          *do,i,1,nt2b

edele,tot6+nw1+1+(i-1)*k0+(j-1)*incr,tot6+nw1+ne1+(i-1)*k0+(j-1)*
incr

edele,tot6+temp1+1+(i-1)*k0+(j-1)*incr,tot6+temp1+ne2+(i-1)*k0+(j
-1)*incr
          *enddo

          tot7=tot6+nt2b*k0

          *do,i,1,nt1b
```

```
edele,tot7+nw1+1+(i-1)*k0+(j-1)*incr,tot7+nw1+ne1+(i-1)*k0+(j-1)*
incr
          *enddo


     *elseif,t2,eq,t3,then     !2

          *do,i,1,nt2

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt2*k0

          *do,i,1,nt1b

edele,tot6+mw1+1+(i-1)*k0+(j-1)*incr,tot6+nw1+ne1+(i-1)*k0+(j-1)*
incr
          *enddo


     *elseif,t2,lt,t3,then     !3


          *do,i,1,nt2

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt2*k0

          *do,i,1,nt3b

edele,tot6+nw1+1+(i-1)*k0+(j-1)*incr,tot6+nw1+ne1+(i-1)*k0+(j-1)*
incr

edele,tot6+temp2+1+(i-1)*k0+(j-1)*incr,tot6+temp2+ne3+(i-1)*k0+(j
-1)*incr
```

```
          *enddo
          tot7=tot6+nt3b*k0
          *do,i,1,nt1b
edele,tot7+mw1+1+(i-1)*k0+(j-1)*incr,tot7+nw1+ne1+(i-1)*k0+(j-1)*
incr
          *enddo
     *endif

  *elseif,t1,lt,t3,then
     *if,t2,lt,t3,then   !4
          *do,i,1,nt2
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
-1)*incr
          *enddo
          tot6=tot5+nt2*k0
          *do,i,1,nt1b
edele,tot6+nw1+1+(i-1)*k0+(j-1)*incr,tot6+nw1+ne1+(i-1)*k0+(j-1)*
incr
edele,tot6+temp2+1+(i-1)*k0+(j-1)*incr,tot6+temp2+ne3+(i-1)*k0+(j
-1)*incr
          *enddo
          tot7=tot6+nt1b*k0
          *do,i,1,nt3b
edele,tot7+temp2+1+(i-1)*k0+(j-1)*incr,tot7+temp2+ne3+(i-1)*k0+(j
-1)*incr
          *enddo
     *endif

   *elseif,t1,eq,t3,then !5
          *do,i,1,nt2
```

```
edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt2*k0


          *do,i,1,nt1b

edele,tot6+nw1+1+(i-1)*k0+(j-1)*incr,tot6+nw1+ne1+(i-1)*k0+(j-1)*
incr

edele,tot6+temp2+1+(i-1)*k0+(j-1)*incr,tot6+temp2+ne3+(i-1)*k0+(j
-1)*incr
          *enddo

     *endif

*elseif,t1,lt,t2,then

   *if,t1,lt,t3,then
     *if,t2,gt,t3,then    !6

          *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt1*k0

          *do,i,1,nt3b

edele,tot6+temp1+1+(i-1)*k0+(j-1)*incr,tot6+temp1+ne2+(i-1)*k0+(j
-1)*incr

edele,tot6+temp2+1+(i-1)*k0+(j-1)*incr,tot6+temp2+ne3+(i-1)*k0+(j
-1)*incr
          *enddo

          tot7=tot6+nt3b*k0
```

```
          *do,i,1,nt2b
edele,tot7+temp1+1+(i-1)*k0+(j-1)*incr,tot7+temp1+ne2+(i-1)*k0+(j
-1)*incr
          *enddo


     *elseif,t2,lt,t3,then     !7
          *do,i,1,nt1
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
-1)*incr
          *enddo
          tot6=tot5+nt1*k0
          *do,i,1,nt2b
edele,tot6+temp1+1+(i-1)*k0+(j-1)*incr,tot6+temp1+ne2+(i-1)*k0+(j
-1)*incr
edele,tot6+temp2+1+(i-1)*k0+(j-1)*incr,tot6+temp2+ne3+(i-1)*k0+(j
-1)*incr
          *enddo
          tot7=tot6+nt2b*k0
          *do,i,1,nt3b
edele,tot7+temp2+1+(i-1)*k0+(j-1)*incr,tot7+temp2+ne3+(i-1)*k0+(j
-1)*incr
          *enddo


     *elseif,t2,eq,t3,then     !8
          *do,i,1,nt1
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
```

```
-1)*incr
          *enddo

          tot6=tot5+nt1*k0

          *do,i,1,nt2b

edele,tot6+temp1+1+(i-1)*k0+(j-1)*incr,tot6+temp1+ne2+(i-1)*k0+(j
-1)*incr

edele,tot6+temp2+1+(i-1)*k0+(j-1)*incr,tot6+temp2+ne3+(i-1)*k0+(j
-1)*incr
          *enddo


     *endif

   *elseif,t1,gt,t3,then

     *if,t2,gt,t3,then    !9

          *do,i,1,nt3

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt3*k0

          *do,i,1,nt1b

edele,tot6+nw1+1+(i-1)*k0+(j-1)*incr,tot6+nw1+ne1+(i-1)*k0+(j-1)*
incr

edele,tot6+temp1+1+(i-1)*k0+(j-1)*incr,tot6+temp1+ne2+(i-1)*k0+(j
-1)*incr
          *enddo

          tot7=tot6+nt1b*k0

          *do,i,1,nt2b

edele,tot7+temp1+1+(i-1)*k0+(j-1)*incr,tot7+temp1+ne2+(i-1)*k0+(j
-1)*incr
          *enddo
```

```
      *endif

    *elseif,t1,eq,t3,then !10

            *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
            *enddo

            tot6=tot5+nt1*k0

            *do,i,1,nt2b

edele,tot6+temp1+1+(i-1)*k0+(j-1)*incr,tot6+temp1+ne2+(i-1)*k0+(j
-1)*incr
            *enddo


    *endif


*elseif,t1,eq,t2,then

      *if,t1,lt,t3,then    !11


            *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
            *enddo

            tot6=tot5+nt1*k0

            *do,i,1,nt3b

edele,tot6+temp2+1+(i-1)*k0+(j-1)*incr,tot6+temp2+ne3+(i-1)*k0+(j
-1)*incr
            *enddo
```

```
     *elseif,t1,gt,t3,then     !12

          *do,i,1,nt3

edele,tot5+mw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt3*k0

          *do,i,1,nt1b


edele,tot6+nw1+1+(i-1)*k0+(j-1)*incr,tot6+nw1+ne1+(i-1)*k0+(j-1)*
incr

edele,tot6+temp1+1+(i-1)*k0+(j-1)*incr,tot6+temp1+ne2+(i-1)*k0+(j
-1)*incr


          *enddo


     *elseif,t1,eq,t3,then      !13

     *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo


     *endif

*endif

*enddo          ! end loop for j
!----------------------------------------
```

```
*elseif,c,lt,d,then,

     mat,1
     e,1,2,(k0+1)+2,(k0+1)+1,v3+1,v3+2,v3+(k0+1)+2,v3+(k0+1)+1
     egen,k0,1,-1
     egen,(nl1+nc+nc1+nl3+nc2+nt+nl2),k0+1,-k0
     egen,nf+ncoal+nri+nrm,v3,-(nl1+nc+nc1+nl3+nc2+nt+nl2)*k0


     e         s         e         l         ,         s         ,
elem,,nf*(nl1+nc+nc2+nl3+nc1+nt+nl2)*k0+1,(nf+ncoal)*(nl1+nc+nc2+
nl3+nc1+nt+nl2)*k0
     emodif,all,mat,2
     esel,all

     e         s         e         l         ,         s         ,
elem,,(nf+ncoal)*(nl1+nc+nc2+nl3+nc1+nt+nl2)*k0+1,(nf+ncoal+nri)*
(nl1+nc+nc2+nl3+nc1+nt+nl2)*k0
     emodif,all,mat,3
     esel,all

     e         s         e         l         ,         s         ,
elem,,(nf+ncoal+nri)*(nl1+nc+nc2+nl3+nc1+nt+nl2)*k0+1,(nf+ncoal+n
ri+nrm)*(nl1+nc+nc2+nl3+nc1+nt+nl2)*k0
     emodif,all,mat,4
     esel,all


incr=(nl1+nc+nc2+nl3+nc1+nt+nl2)*k0

temp1=nw1+ne1+np1
temp2=nw1+ne1+np1+ne2+np2

*do,j,1,ncoal

tot1=nf*(nl1+nc+nc2+nl3+nc1+nt+nl2)*k0

tot0=tot1+nl1*k0

*do,i,1,nc

edele,tot0+nw1+1+(i-1)*k0+(j-1)*incr,tot0+nw1+ne1+(i-1)*k0+(j-1)*
incr,
edele,tot0+temp1+1+(i-1)*k0+(j-1)*incr,tot0+temp1+ne2+(i-1)*k0+(j
-1)*incr,
edele,tot0+temp2+1+(i-1)*k0+(j-1)*incr,tot0+temp2+ne3+(i-1)*k0+(j
-1)*incr,

*enddo


tot2=tot1+(nl1+nc)*k0
```

```
*do,i,1,nc1
edele,tot2+nw1+1+(i-1)*k0+(j-1)*incr,tot2+temp1+ne2+(i-1)*k0+(j-1
)*incr,
edele,tot2+temp2+1+(i-1)*k0+(j-1)*incr,tot2+temp2+ne3+(i-1)*k0+(j
-1)*incr
*enddo

tot3=tot2+nc1*k0

*do,i,1,nl3
edele,tot3+nw1+1+(i-1)*k0+(j-1)*incr,tot3+nw1+ne1+(i-1)*k0+(j-1)*
incr
edele,tot3+temp1+1+(i-1)*k0+(j-1)*incr,tot3+temp1+ne2+(i-1)*k0+(j
-1)*incr
edele,tot3+temp2+1+(i-1)*k0+(j-1)*incr,tot3+temp2+ne3+(i-1)*k0+(j
-1)*incr
*enddo

tot4=tot3+nl3*k0

*do,i,1,nc2
edele,tot4+nw1+1+(i-1)*k0+(j-1)*incr,tot4+nw1+ne1+(i-1)*k0+(j-1)*
incr
edele,tot4+temp1+1+(i-1)*k0+(j-1)*incr,tot4+temp2+ne3+(i-1)*k0+(j
-1)*incr
*enddo

tot5=tot4+nc2*k0


!-----------------------

*if,t1,gt,t2,then

   *if,t1,gt,t3,then

     *if,t2,gt,t3,then    ! 1

          *do,i,1,nt3

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt3*k0

          *do,i,1,nt2b
```

```
edele,tot6+nw1+1+(i-1)*k0+(j-1)*incr,tot6+nw1+ne1+(i-1)*k0+(j-1)*
incr

edele,tot6+temp1+1+(i-1)*k0+(j-1)*incr,tot6+temp1+ne2+(i-1)*k0+(j
-1)*incr
          *enddo

          tot7=tot6+nt2b*k0

          *do,i,1,nt1b

edele,tot7+nw1+1+(i-1)*k0+(j-1)*incr,tot7+nw1+ne1+(i-1)*k0+(j-1)*
incr
          *enddo


     *elseif,t2,eq,t3,then     !2

          *do,i,1,nt2

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt2*k0

          *do,i,1,nt1b

edele,tot6+mw1+1+(i-1)*k0+(j-1)*incr,tot6+nw1+ne1+(i-1)*k0+(j-1)*
incr
          *enddo


     *elseif,t2,lt,t3,then     !3


          *do,i,1,nt2

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo
```

```
          tot6=tot5+nt2*k0

          *do,i,1,nt3b

edele,tot6+nw1+1+(i-1)*k0+(j-1)*incr,tot6+nw1+ne1+(i-1)*k0+(j-1)*
incr

edele,tot6+temp2+1+(i-1)*k0+(j-1)*incr,tot6+temp2+ne3+(i-1)*k0+(j
-1)*incr
          *enddo

          tot7=tot6+nt3b*k0

          *do,i,1,nt1b

edele,tot7+mw1+1+(i-1)*k0+(j-1)*incr,tot7+nw1+ne1+(i-1)*k0+(j-1)*
incr
          *enddo

     *endif


  *elseif,t1,lt,t3,then

     *if,t2,lt,t3,then    !4

          *do,i,1,nt2

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt2*k0

          *do,i,1,nt1b

edele,tot6+nw1+1+(i-1)*k0+(j-1)*incr,tot6+nw1+ne1+(i-1)*k0+(j-1)*
incr

edele,tot6+temp2+1+(i-1)*k0+(j-1)*incr,tot6+temp2+ne3+(i-1)*k0+(j
-1)*incr
          *enddo

          tot7=tot6+nt1b*k0

          *do,i,1,nt3b

edele,tot7+temp2+1+(i-1)*k0+(j-1)*incr,tot7+temp2+ne3+(i-1)*k0+(j
```

```
-1)*incr
          *enddo

     *endif

   *elseif,t1,eq,t3,then !5

          *do,i,1,nt2

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt2*k0


          *do,i,1,nt1b

edele,tot6+nw1+1+(i-1)*k0+(j-1)*incr,tot6+nw1+ne1+(i-1)*k0+(j-1)*
incr

edele,tot6+temp2+1+(i-1)*k0+(j-1)*incr,tot6+temp2+ne3+(i-1)*k0+(j
-1)*incr
          *enddo

     *endif

*elseif,t1,lt,t2,then

   *if,t1,lt,t3,then
     *if,t2,gt,t3,then    !6

          *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt1*k0

          *do,i,1,nt3b
```

```
edele,tot6+temp1+1+(i-1)*k0+(j-1)*incr,tot6+temp1+ne2+(i-1)*k0+(j
-1)*incr

edele,tot6+temp2+1+(i-1)*k0+(j-1)*incr,tot6+temp2+ne3+(i-1)*k0+(j
-1)*incr
          *enddo

          tot7=tot6+nt3b*k0

          *do,i,1,nt2b

edele,tot7+temp1+1+(i-1)*k0+(j-1)*incr,tot7+temp1+ne2+(i-1)*k0+(j
-1)*incr
          *enddo


     *elseif,t2,lt,t3,then     !7

          *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt1*k0

          *do,i,1,nt2b

edele,tot6+temp1+1+(i-1)*k0+(j-1)*incr,tot6+temp1+ne2+(i-1)*k0+(j
-1)*incr

edele,tot6+temp2+1+(i-1)*k0+(j-1)*incr,tot6+temp2+ne3+(i-1)*k0+(j
-1)*incr
          *enddo

          tot7=tot6+nt2b*k0

          *do,i,1,nt3b

edele,tot7+temp2+1+(i-1)*k0+(j-1)*incr,tot7+temp2+ne3+(i-1)*k0+(j
-1)*incr
          *enddo


     *elseif,t2,eq,t3,then     !8
```

```
          *do,i,1,nt1
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
-1)*incr
          *enddo
          tot6=tot5+nt1*k0
          *do,i,1,nt2b
edele,tot6+temp1+1+(i-1)*k0+(j-1)*incr,tot6+temp1+ne2+(i-1)*k0+(j
-1)*incr
edele,tot6+temp2+1+(i-1)*k0+(j-1)*incr,tot6+temp2+ne3+(i-1)*k0+(j
-1)*incr
          *enddo


     *endif
   *elseif,t1,gt,t3,then
     *if,t2,gt,t3,then    !9
          *do,i,1,nt3
edele,tot5+nw1+1+(i-1)*k0+(j-1)*incr,tot5+nw1+ne1+(i-1)*k0+(j-1)*
incr
edele,tot5+temp1+1+(i-1)*k0+(j-1)*incr,tot5+temp1+ne2+(i-1)*k0+(j
-1)*incr
edele,tot5+temp2+1+(i-1)*k0+(j-1)*incr,tot5+temp2+ne3+(i-1)*k0+(j
-1)*incr
          *enddo
          tot6=tot5+nt3*k0
          *do,i,1,nt1b
edele,tot6+nw1+1+(i-1)*k0+(j-1)*incr,tot6+nw1+ne1+(i-1)*k0+(j-1)*
incr
edele,tot6+temp1+1+(i-1)*k0+(j-1)*incr,tot6+temp1+ne2+(i-1)*k0+(j
-1)*incr
          *enddo
```

```
          tot7=tot6+nt1b*k0

          *do,i,1,nt2b

edele,tot7+temp1+1+(i-1)*k0+(j-1)*incr,tot7+temp1+ne2+(i-1)*k0+(j
-1)*incr
          *enddo

     *endif

   *elseif,t1,eq,t3,then !10

          *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt1*k0

          *do,i,1,nt2b

edele,tot6+temp1+1+(i-1)*k0+(j-1)*incr,tot6+temp1+ne2+(i-1)*k0+(j
-1)*incr
          *enddo

   *endif

*elseif,t1,eq,t2,then

     *if,t1,lt,t3,then   !11

          *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo
```

```
          tot6=tot5+nt1*k0

          *do,i,1,nt3b

edele,tot6+temp2+1+(i-1)*k0+(j-1)*incr,tot6+temp2+ne3+(i-1)*k0+(j
-1)*incr
          *enddo


     *elseif,t1,gt,t3,then     !12


          *do,i,1,nt3

edele,tot5+mw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo

          tot6=tot5+nt3*k0

          *do,i,1,nt1b


edele,tot6+nw1+1+(i-1)*k0+(j-1)*incr,tot6+nw1+ne1+(i-1)*k0+(j-1)*
incr

edele,tot6+temp1+1+(i-1)*k0+(j-1)*incr,tot6+temp1+ne2+(i-1)*k0+(j
-1)*incr


          *enddo


     *elseif,t1,eq,t3,then      !13

     *do,i,1,nt1

edele,tot5+nw1+1+(i-1)*k0+(j-1)*incr,tot5+nw1+ne1+(i-1)*k0+(j-1)*
incr

edele,tot5+temp1+1+(i-1)*k0+(j-1)*incr,tot5+temp1+ne2+(i-1)*k0+(j
-1)*incr

edele,tot5+temp2+1+(i-1)*k0+(j-1)*incr,tot5+temp2+ne3+(i-1)*k0+(j
-1)*incr
          *enddo
```

```
    *endif
*endif
*enddo    ! do loop for j
!----------------------------------------

*endif    ! end stmt for if c,lt,d,


av=ncv1+ncv2+ncv3+ncv4

k1=nl1+ncv1+ncv2+ncv3+ncv4+m1+m2+m3+nl2+1

vv=k1*(k0+1)

! following is for subjoined areas

*if,alpha,ne,0,then,

local,11,0,0,0,0,alpha,,,1,1        ! for subjoined area 1

wn=(k0+1)*k1*(nf+ncoal+nri+nrm+1)

n,wn+1,0,0,0
n,wn+nl1+1,0,l1*cos(alpha*3.141592654/180),0
fill

n,wn+nl1+ncv1+1,0,(l1+cv1)*cos(alpha*3.141592654/180),0
fill,wn+nl1+1,wn+nl1+ncv1+1

n,wn+nl1+ncv1+ncv2+1,0,(l1+cv1+cv2)*cos(alpha*3.141592654/180),0
fill,wn+nl1+ncv1+1,wn+nl1+ncv1+ncv2+1

n,wn+nl1+ncv1+ncv2+ncv3+1,0,(l1+cv1+cv2+cv3)*cos(alpha*3.14159265
4/180),0
fill,wn+nl1+ncv1+ncv2+1,wn+nl1+ncv1+ncv2+ncv3+1
```

```
n,wn+nl1+ncv1+ncv2+ncv3+ncv4+1,0,(l1+cv1+cv2+cv3+cv4)*cos(alpha*3
.141592654/180),0
fill,wn+nl1+ncv1+ncv2+ncv3+1,wn+nl1+ncv1+ncv2+ncv3+ncv4+1

n,wn+nl1+ncv1+ncv2+ncv3+ncv4+m1+1,0,(l1+cv1+cv2+cv3+cv4+tt1)*cos(
alpha*3.141592654/180),0
fill,wn+nl1+ncv1+ncv2+ncv3+ncv4+1,wn+nl1+ncv1+ncv2+ncv3+ncv4+m1+1

n,wn+nl1+ncv1+ncv2+ncv3+ncv4+m1+m2+1,0,(l1+cv1+cv2+cv3+cv4+tt1+tt
2)*cos(alpha*3.141592654/180),0
fill,wn+nl1+ncv1+ncv2+ncv3+ncv4+m1+1,wn+nl1+ncv1+ncv2+ncv3+ncv4+m
1+m2+1

n,wn+nl1+av+nt+1,0,(l1+cv1+cv2+cv3+cv4+tt1+tt2+tt3)*cos(alpha*3.1
41592654/180),0
fill,wn+nl1+ncv1+ncv2+ncv3+ncv4+m1+m2+1,wn+nl1+ncv1+ncv2+ncv3+ncv
4+m1+m2+m3+1

n,wn+nl1+av+nt+nl2+1,0,(l1+cv1+cv2+cv3+cv4+tt1+tt2+tt3+l2)*cos(al
pha*3.141592654/180),0
fill,wn+nl1+av+nt+1,wn+nl1+av+nt+nl2+1

ngen,nl1+1,k1,wn+1,wn+k1,,(l1*sin(alpha*3.141592654/180))/nl1
ngen,ncv1+1,k1,wn+nl1*k1+1,wn+(nl1+1)*k1,,(cv1*sin(alpha*3.141592
654/180))/ncv1
ngen,ncv2+1,k1,wn+(nl1+ncv1)*k1+1,wn+(nl1+ncv1+1)*k1,,(cv2*sin(al
pha*3.141592654/180))/ncv2
ngen,ncv3+1,k1,wn+(nl1+ncv1+ncv2)*k1+1,wn+(nl1+ncv1+ncv2+1)*k1,,(
cv3*sin(alpha*3.141592654/180))/ncv3
ngen,ncv4+1,k1,wn+(nl1+ncv1+ncv2+ncv3)*k1+1,wn+(nl1+ncv1+ncv2+ncv
3+1)*k1,,(cv4*sin(alpha*3.141592654/180))/ncv4
ngen,m1+1,k1,wn+(nl1+av)*k1+1,wn+(nl1+av+1)*k1,,(tt1*sin(alpha*3.
141592654/180))/m1
ngen,m2+1,k1,wn+(nl1+av+m1)*k1+1,wn+(nl1+av+m1+1)*k1,,(tt2*sin(al
pha*3.141592654/180))/m2
ngen,m3+1,k1,wn+(nl1+av+m1+m2)*k1+1,wn+(nl1+av+m1+m2+1)*k1,,(tt3*
sin(alpha*3.141592654/180))/m3
ngen,nl2+1,k1,wn+(nl1+av+m1+m2+m3)*k1+1,wn+(nl1+av+m1+m2+m3+1)*k1
,,(l2*sin(alpha*3.141592654/180))/nl2

x2=k1+1
wn1=k1*k1

q=nw1+ne1+np1+ne2+np2+ne3+nw2+1

ngen,nf+1,wn1,wn+1,wn+wn1,,0,0,fthick/nf
ngen,ncoal+1,wn1,wn+nf*wn1+1,wn+(nf+1)*wn1,,0,0,cthick/ncoal
ngen,nri+1,wn1,wn+(nf+ncoal)*wn1+1,wn+(nf+ncoal+1)*wn1,,0,0,rithi
ck/nri
ngen,nrm+1,wn1,wn+(nf+ncoal+nri)*wn1+1,wn+(nf+nri+ncoal+1)*wn1,,0
,0,rmthick/nrm

*do,k,1,nf+ncoal+nri+nrm
```

```
*if,k,le,nf,then,
          mat,1
*elseif,k,gt,nf,then

     *if,k,le,(nf+ncoal),then
          mat,2
     *elseif,k,gt,(nf+ncoal),then

          *if,k,le,(nf+ncoal+nri),then
               mat,3
          *else
               mat,4
          *endif
     *endif
*endif

o=vv*(k-1)

p0=wn+wn1*(k-1)
jp2=wn+k*wn1

*do,i,1,nl1+av+m1+m2+m3+nl2
*do,j,1,nl1+av+m1+m2+m3+nl2-i+1

*if,j,eq,1,then,

e,o+(i-1)*q+1,o+i*q+1,p0+(i-1)*x2+2,p0+(i-1)*x2+2,k*vv+(i-1)*q+1,
k*vv+i*q+1,jp2+(i-1)*x2+2,jp2+(i-1)*x2+2

*elseif,j,eq,2,then,

e,p0+(i-1)*x2+2,o+i*q+1,p0+i*x2+j,p0+(i-1)*x2+3,jp2+(i-1)*x2+2,k*
vv+i*q+1,jp2+i*x2+j,jp2+(i-1)*x2+3

*else

e,p0+(i-1)*x2+j,p0+i*x2+j-1,p0+i*x2+j,p0+(i-1)*x2+j+1,jp2+(i-1)*x
2+j,jp2+i*x2+j-1,jp2+i*x2+j,jp2+(i-1)*x2+j+1

*endif

*enddo
*enddo
*enddo


csys,0

!-----------------------------------------------
local,11,0,0,l1+cv1+cv2+cv3+cv4+tt1+tt2+tt3+l2,0,-(90-alpha),,,1,
1          ! for subjoined area 2

xn=(k0+1)*k1*(nf+ncoal+nri+nrm+1)+wn1*(nf+ncoal+nri+nrm+1)
n,xn+1,0,0,0
```

```
n,xn+nw1+1,0,w1*cos(alpha*3.1415926/180),0
fill,xn+1,xn+nw1+1

n,xn+nw1+ne1+1,0,(w1+e1)*cos(alpha*3.1415926/180),0
fill,xn+nw1+1,xn+nw1+ne1+1

n,xn+nw1+ne1+np1+1,0,(w1+e1+p1)*cos(alpha*3.1415926/180),0
fill,xn+nw1+ne1+1,xn+nw1+ne1+np1+1

n,xn+nw1+ne1+np1+ne2+1,0,(w1+e1+p1+e2)*cos(alpha*3.1415926/180),0
fill,xn+nw1+ne1+np1+1,xn+nw1+ne1+np1+ne2+1

n,xn+nw1+ne1+np1+ne2+np2+1,0,(w1+e1+p1+e2+p2)*cos(alpha*3.1415926
/180),0
fill,xn+nw1+ne1+np1+ne2+1,xn+nw1+ne1+np1+ne2+np2+1

n,xn+nw1+ne1+np1+ne2+np2+ne3+1,0,(w1+e1+p1+e2+p2+e3)*cos(alpha*3.
1415926/180),0
fill,xn+nw1+ne1+np1+ne2+np2+1,xn+nw1+ne1+np1+ne2+np2+ne3+1

n,xn+nw1+ne1+np1+ne2+np2+ne3+nw2+1,0,(w1+e1+p1+e2+p2+e3+w2)*cos(a
lpha*3.1415926/180),0
fill,xn+nw1+ne1+np1+ne2+np2+ne3+1,xn+nw1+ne1+np1+ne2+np2+ne3+nw2+1

ngen,nw1+1,k0+1,xn+1,xn+k0+1,,(w1*sin(alpha*3.1415926/180))/nw1
ngen,ne1+1,k0+1,xn+nw1*(k0+1)+1,xn+(nw1+1)*(k0+1),,(e1*sin(alpha*
3.1415926/180))/ne1
ngen,np1+1,k0+1,xn+(nw1+ne1)*(k0+1)+1,xn+(nw1+ne1+1)*(k0+1),,(p1*
sin(alpha*3.1415926/180))/np1
ngen,ne2+1,k0+1,xn+(nw1+ne1+np1)*(k0+1)+1,xn+(nw1+ne1+np1+1)*(k0+
1),,(e2*sin(alpha*3.1415926/180))/ne2
bv=nw1+ne1+np1+ne2
ngen,np2+1,k0+1,xn+bv*(k0+1)+1,xn+(bv+1)*(k0+1),,(p2*sin(alpha*3.
1415926/180))/np2
ngen,ne3+1,k0+1,xn+(bv+np2)*(k0+1)+1,xn+(bv+np2+1)*(k0+1),,(e3*si
n(alpha*3.1415926/180))/ne3
ngen,nw2+1,k0+1,xn+(bv+np2+ne3)*(k0+1)+1,xn+(bv+np2+ne3+1)*(k0+1)
,,(w2*sin(alpha*3.1415926/180))/nw2

x3=k0+2
xn1=(k0+1)*(k0+1)

!q=k0+1

ngen,nf+1,xn1,xn+1,xn+xn1,,0,0,fthick/nf
ngen,ncoal+1,xn1,xn+nf*xn1+1,xn+(nf+1)*xn1,,0,0,cthick/ncoal
ngen,nri+1,xn1,xn+(nf+ncoal)*xn1+1,xn+(nf+ncoal+1)*xn1,,0,0,rithi
ck/nri
ngen,nrm+1,xn1,xn+(nf+ncoal+nri)*xn1+1,xn+(nf+nri+ncoal+1)*xn1,,0
,0,rmthick/nrm

*do,k,1,nf+ncoal+nri+nrm

*if,k,le,nf,then,
```

```
          mat,1
*elseif,k,gt,nf,then
     *if,k,le,(nf+ncoal),then
          mat,2
     *elseif,k,gt,(nf+ncoal),then

          *if,k,le,(nf+ncoal+nri),then
               mat,3
          *else
               mat,4
          *endif
     *endif
*endif

qq=xn+k*xn1
qqq=xn+(k-1)*xn1

z=(k0+1)*(nl1+ncv1+ncv2+ncv3+ncv4+m1+m2+m3+nl2)

*do,i,1,k0
*do,j,1,k0-i+1

*if,j,eq,1,then,

e,(k-1)*vv+z+i,(k-1)*vv+z+i+1,qqq+(i-1)*x3+2,qqq+(i-1)*x3+2,k*vv+
z+i,k*vv+z+i+1,qq+(i-1)*x3+2,qq+(i-1)*x3+2

*elseif,j,eq,2,then,

e,qqq+(i-1)*x3+j,(k-1)*vv+z+i+1,qqq+i*x3+j,qqq+(i-1)*x3+3,qq+(i-1
)*x3+j,k*vv+z+i+1,qq+i*x3+j,qq+(i-1)*x3+3

*else

e,qqq+(i-1)*x3+j,qqq+i*x3+j-1,qqq+i*x3+j,qqq+(i-1)*x3+j+1,qq+(i-1
)*x3+j,qq+i*x3+j-1,qq+i*x3+j,qq+(i-1)*x3+j+1

*endif

*enddo
*enddo
*enddo


csys,0
!-------------------------------------
local,11,0,w1+e1+p1+e2+p2+e3+w2,l1+cv1+cv2+cv3+cv4+tt1+tt2+tt3+l2
,0,-(180-alpha),,,1,1          ! for area 3

tn=xn+xn1*(nf+ncoal+nri+nrm+1)

n,tn+1,0,0,0
n,tn+nl2+1,0,l2*cos(alpha*3.1415926/180),0
fill
```

```
n,tn+nl2+m3+1,0,(l2+tt3)*cos(alpha*3.1415926/180),0
fill,tn+nl2+1,tn+nl2+m3+1

n,tn+nl2+m3+m2+1,0,(l2+tt3+tt2)*cos(alpha*3.1415926/180),0
fill,tn+nl2+m3+1,tn+nl2+m3+m2+1

n,tn+nl2+m3+m2+m1+1,0,(l2+tt3+tt2+tt1)*cos(alpha*3.1415926/180),0
fill,tn+nl2+m3+m2+1,tn+nl2+m3+m2+m1+1

n,tn+nl2+m3+m2+m1+ncv4+1,0,(l2+tt3+tt2+tt1+cv4)*cos(alpha*3.14159
26/180),0
fill,tn+nl2+m3+m2+m1+1,tn+nl2+m3+m2+m1+ncv4+1

n,tn+nl2+m3+m2+m1+ncv4+ncv3+1,0,(l2+tt3+tt2+tt1+cv4+cv3)*cos(alph
a*3.1415926/180),0
fill,tn+nl2+m3+m2+m1+ncv4+1,tn+nl2+m3+m2+m1+ncv4+ncv3+1

n,tn+nl2+m3+m2+m1+ncv4+ncv3+ncv2+1,0,(l2+tt3+tt2+tt1+cv4+cv3+cv2)
*cos(alpha*3.1415926/180),0
fill,tn+nl2+m3+m2+m1+ncv4+ncv3+1,tn+nl2+m3+m2+m1+ncv4+ncv3+ncv2+1

n,tn+nl2+nt+av+1,0,(l2+tt3+tt2+tt1+cv4+cv3+cv2+cv1)*cos(alpha*3.1
415926/180),0
fill,tn+nl2+m3+m2+m1+ncv4+ncv3+ncv2+1,tn+nl2+m3+m2+m1+ncv4+ncv3+n
cv2+ncv1+1

n,tn+nl2+nt+av+nl1+1,0,(l2+tt3+tt2+tt1+cv4+cv3+cv2+cv1+l1)*cos(al
pha*3.1415926/180),0
fill,tn+nl2+nt+av+1,tn+nl2+nt+av+nl1+1

ngen,nl2+1,k1,tn+1,tn+k1,,(l2*sin(alpha*3.1415926/180))/nl2
ngen,m3+1,k1,tn+nl2*k1+1,tn+(nl2+1)*k1,,(tt3*sin(alpha*3.1415926/
180))/m3
ngen,m2+1,k1,tn+(nl2+m3)*k1+1,tn+(nl2+m3+1)*k1,,(tt2*sin(alpha*3.
1415926/180))/m2
ngen,m1+1,k1,tn+(nl2+m3+m2)*k1+1,tn+(nl2+m3+m2+1)*k1,,(tt1*sin(al
pha*3.1415926/180))/m1
ngen,ncv4+1,k1,tn+(nl2+nt)*k1+1,tn+(nl2+nt+1)*k1,,(cv4*sin(alpha*
3.1415926/180))/ncv4
ngen,ncv3+1,k1,tn+(nl2+nt+ncv4)*k1+1,tn+(nl2+nt+ncv4+1)*k1,,(cv3*
sin(alpha*3.1415926/180))/ncv3
ngen,ncv2+1,k1,tn+(nl2+nt+ncv4+ncv3)*k1+1,tn+(nl2+nt+ncv4+ncv3+1)
*k1,,(cv2*sin(alpha*3.1415926/180))/ncv2
ngen,ncv1+1,k1,tn+(nl2+nt+av-ncv1)*k1+1,tn+(nl2+nt+av-ncv1+1)*k1,
,(cv1*sin(alpha*3.1415926/180))/ncv1
ngen,nl1+1,k1,tn+(nl2+nt+av)*k1+1,tn+(nl2+nt+av+1)*k1,,(l1*sin(al
pha*3.1415926/180))/nl1

!x2=nl1+nt+nl2+2

!wn1=(nl1+nt+nl2+1)*(nl1+nt+nl2+1)

!q=k0+1
```

```
ngen,nf+1,wn1,tn+1,tn+wn1,,0,0,fthick/nf
ngen,ncoal+1,wn1,tn+nf*wn1+1,tn+(nf+1)*wn1,,0,0,cthick/ncoal
ngen,nri+1,wn1,tn+(nf+ncoal)*wn1+1,tn+(nf+ncoal+1)*wn1,,0,0,rithi
ck/nri
ngen,nrm+1,wn1,tn+(nf+ncoal+nri)*wn1+1,tn+(nf+nri+ncoal+1)*wn1,,0
,0,rmthick/nrm

*do,k,1,nf+ncoal+nri+nrm

*if,k,le,nf,then,
          mat,1
*elseif,k,gt,nf,then
     *if,k,le,(nf+ncoal),then
          mat,2
     *elseif,k,gt,(nf+ncoal),then

          *if,k,le,(nf+ncoal+nri),then
               mat,3
          *else
               mat,4
          *endif
     *endif
*endif

qp=tn+wn1*(k-1)
pq=tn+k*wn1

*do,i,1,nl1+nt+av+nl2
*do,j,1,nl1+nt+av+nl2-i+1

*if,j,eq,1,then,

e,vv*(k-1)+(x2-i)*q,vv*(k-1)+(x2-1-i)*q,qp+(i-1)*x2+2,qp+(i-1)*x2
+2,k*vv+(x2-i)*q,k*vv+(x2-1-i)*q,pq+(i-1)*x2+2,pq+(i-1)*x2+2

*elseif,j,eq,2,then,

e,qp+(i-1)*x2+2,vv*(k-1)+(x2-1-i)*q,qp+i*x2+j,qp+(i-1)*x2+3,pq+(i
-1)*x2+2,k*vv+(x2-1-i)*q,pq+i*x2+j,pq+(i-1)*x2+3

*else

e,qp+(i-1)*x2+j,qp+i*x2+j-1,qp+i*x2+j,qp+(i-1)*x2+j+1,pq+(i-1)*x2
+j,pq+i*x2+j-1,pq+i*x2+j,pq+(i-1)*x2+j+1

*endif

*enddo
*enddo
*enddo


!---------------- ! for subjoined area 4
csys,0
```

```
local,11,0,w1+e1+p1+e2+p2+e3+w2,0,0,-(270-alpha),,,1,1

xt=tn+wn1*(nf+ncoal+nri+nrm+1)

n,xt+1,0,0,0
n,xt+nw2+1,0,w2*cos(alpha*3.1415926/180),0
fill,xt+1,xt+nw2+1

n,xt+nw2+ne3+1,0,(w2+e3)*cos(alpha*3.1415926/180),0
fill,xt+nw2+1,xt+nw2+ne3+1

n,xt+nw2+ne3+np2+1,0,(w2+e3+p2)*cos(alpha*3.1415926/180),0
fill,xt+nw2+ne3+1,xt+nw2+ne3+np2+1

n,xt+nw2+ne3+np2+ne2+1,0,(w2+e3+p2+e2)*cos(alpha*3.1415926/180),0
fill,xt+nw2+ne3+np2+1,xt+nw2+ne3+np2+ne2+1

n,xt+nw2+ne3+np2+ne2+np1+1,0,(w2+e3+p2+e2+p1)*cos(alpha*3.1415926
/180),0
fill,xt+nw2+ne3+np2+ne2+1,xt+nw2+ne3+np2+ne2+np1+1

n,xt+nw2+ne3+np2+ne2+np1+ne1+1,0,(w2+e3+p2+e2+p1+e1)*cos(alpha*3.
1415926/180),0
fill,xt+nw2+ne3+np2+ne2+ne1+1,xt+nw2+ne3+np2+ne2+np1+ne1+1

n,xt+nw2+ne3+np2+ne2+np1+ne1+nw1+1,0,(w2+e3+p2+e2+p1+e1+w1)*cos(a
lpha*3.1415926/180),0
fill,xt+nw2+ne3+np2+ne2+np1+ne1+1,xt+nw2+ne3+np2+ne2+np1+ne1+nw1+1


ngen,nw2+1,k0+1,xt+1,xt+k0+1,,(w2*sin(alpha*3.1415926/180))/nw2
ngen,ne3+1,k0+1,xt+nw2*(k0+1)+1,xt+(nw2+1)*(k0+1),,(e3*sin(alpha*
3.1415926/180))/ne3
ngen,np2+1,k0+1,xt+(nw2+ne3)*(k0+1)+1,xt+(nw2+ne3+1)*(k0+1),,(p2*
sin(alpha*3.1415926/180))/np2
ngen,ne2+1,k0+1,xt+(nw2+ne3+np2)*(k0+1)+1,xt+(nw2+ne3+np2+1)*(k0+
1),,(e2*sin(alpha*3.1415926/180))/ne2

rv=nw2+ne3+np2+ne2

ngen,np1+1,k0+1,xt+rv*(k0+1)+1,xt+(rv+1)*(k0+1),,(p1*sin(alpha*3.
1415926/180))/np1
ngen,ne1+1,k0+1,xt+(rv+np1)*(k0+1)+1,xt+(rv+np1+1)*(k0+1),,(e1*si
n(alpha*3.1415926/180))/ne1
ngen,nw1+1,k0+1,xt+(rv+np1+ne1)*(k0+1)+1,xt+(rv+np1+ne1+1)*(k0+1)
,,(w1*sin(alpha*3.1415926/180))/nw1

!x3=nw1+ne1+nw2+2
!xn1=(nw1+ne1+nw2+1)*(nw1+ne1+nw2+1)

!q=k0+1

ngen,nf+1,xn1,xt+1,xt+xn1,,0,0,fthick/nf
ngen,ncoal+1,xn1,xt+nf*xn1+1,xt+(nf+1)*xn1,,0,0,cthick/ncoal
```

```
ngen,nri+1,xn1,xt+(nf+ncoal)*xn1+1,xt+(nf+ncoal+1)*xn1,,0,0,rithi
ck/nri
ngen,nrm+1,xn1,xt+(nf+ncoal+nri)*xn1+1,xt+(nf+nri+ncoal+1)*xn1,,0
,0,rmthick/nrm

*do,k,1,nf+ncoal+nri+nrm
*if,k,le,nf,then,
          mat,1
*elseif,k,gt,nf,then
     *if,k,le,(nf+ncoal),then
          mat,2
     *elseif,k,gt,(nf+ncoal),then

          *if,k,le,(nf+ncoal+nri),then
               mat,3
          *else
               mat,4
          *endif
     *endif
*endif

bq=xt+(k-1)*xn1
cq=xt+k*xn1


*do,i,1,bv+np2+ne3+nw2
*do,j,1,bv+np2+ne3+nw2-i+1

*if,j,eq,1,then,

e,(k-1)*vv+(x3-i),(k-1)*vv+x3-i-1,bq+(i-1)*x3+2,bq+(i-1)*x3+2,k*v
v+x3-i,k*vv+x3-i-1,cq+(i-1)*x3+2,cq+(i-1)*x3+2

*elseif,j,eq,2,then,

e,bq+(i-1)*x3+j,(k-1)*vv+x3-i-1,bq+i*x3+j,bq+(i-1)*x3+3,cq+(i-1)*
x3+j,k*vv+x3-i-1,cq+i*x3+j,cq+(i-1)*x3+3

*else

e,bq+(i-1)*x3+j,bq+i*x3+j-1,bq+i*x3+j,bq+(i-1)*x3+j+1,cq+(i-1)*x3
+j,cq+i*x3+j-1,cq+i*x3+j,cq+(i-1)*x3+j+1

*endif

*enddo
*enddo
*enddo

csys,0

*endif          ! end stmt for if, alpha, ne, 0
```

```
nsel,s,loc,z,fthick+cthick+rithick+rmthick
sf,all,pres,1.1*cburden
nsel,all

local,11,0,0,0,0,alpha,,,1,1        ! for subjoined area 1
nsel,s,loc,x,-5,5
sf,all,pres,hstress1
nsel,all
csys,0


local,11,0,0,l1+cv1+cv2+cv3+cv4+tt1+tt2+tt3+l2,0,-(90-alpha),,,1,
1          ! for subjoined area 2
nsel,s,loc,x,-5,5
sf,all,pres,hstress2
nsel,all
csys,0

local,11,0,w1+e1+p1+e2+p2+e3+w2,l1+cv1+cv2+cv3+cv4+tt1+tt2+tt3+l2
,0,-(180-alpha),,,1,1     ! for subjoined area 3
nsel,s,loc,x,-5,5
sf,all,pres,hstress1
nsel,all
csys,0

local,11,0,w1+e1+p1+e2+p2+e3+w2,0,0,-(270-alpha),,,1,1
nsel,s,loc,x,-5,5
sf,all,pres,hstress2
nsel,all


csys,0
nsel,s,loc,x,0
nsel,r,loc,y,0
nsel,r,loc,z,0
d,all,ux,0
d,all,uy,0
nsel,all


EPLOT
/PNUM,KP,0
/PNUM,LINE,0
/PNUM,AREA,0
/PNUM,VOLU,0
/PNUM,NODE,0
/PNUM,SVAL,0
/NUM,0

/PNUM,MAT,1

/PSF,PRES,NORM,2
/PBF,DEFA, ,1
/PSYMB,CS,0
```

```
/PSYMB,NDIR,0
/PSYMB,ESYS,0
/PSYMB,LDIR,0
/PSYMB,PCONV,
/PSYMB,LAYR,0

/PBC,ALL, ,1
/REPLOT


nsel,s,loc,z,0
d,all,uz,0
nsel,all

nsel,s,loc,x,0
nsel,r,loc,y,0
nsel,r,loc,z,0
d,all,ux,0
d,all,uy,0
nsel,all
```

What is claimed is:

1. A method of determining stresses in a model mine layout comprising the steps of:

(a) obtaining mechanical properties of a mine site including orthogonal properties of at least one of Young's modulus and Poisson's ratio;

(b) applying said mechanical properties to the model layout of said mine, the model layout of said mine excluding material to be mined from said mine site; and (c) determining from said applying of said mechanical properties, stresses in the model layout of said mine, wherein said orthogonal properties include a property obtained in a direction alone a main force axis and another property obtained in a direction substantially perpendicular to the main force axis.

2. The method as set forth in claim 1 wherein the model layout of said mine includes at least one of an entry and an array of pillars formed in a stratum of material in said mine site.

3. The method as set forth in claim 2 further comprising the steps of:

(d) determining a position for an array of bolts in a roof of the model layout of said mine;

(e) determining mechanical properties of the bolts; and (f) determining, from the mechanical properties of said mine and the mechanical properties of the bolts applied to the model layout of said mine, stresses in the model layout of said mine.

4. The method as set forth in claim 3 further comprising the steps of:

(g) adjusting one or both of the model layout of said mine and the position of said array of bolts to alter the stresses in the model layout of said mine;

(h) repeating steps (b) through (f) in response to adjusting the model layout of said mine; and (i) repeating step (f) in response to adjusting the position of said array of bolts.

5. The method as set forth in claim 2 wherein said mine site is comprised of strata, wherein at least one of said strata includes the material to be mined out of said mine site.

6. The method as set forth in claim 4 wherein the model layout of said mine includes gob.

7. The method as set forth in claim 6 wherein the stresses in the model layout of said mine include an abutment pressure.

8. A method for determining stress in a given area of an underground mine comprising the steps of:

(a) accumulating mine site specific data including orthogonal properties of at least one of Young's modulus and Poisson's ratio for one or more strata in the mine site;

(b) determining a model layout for said underground mine, the model layout excluding material from the given area; and (c) converting said mine site specific data and the model layout into a stress analysis of the given area with the model layout formed therein, wherein said orthogonal properties include a property obtained in a direction alone a main force axis and another property obtained in a direction substantially perpendicular to the main force axis.

9. A method of determining bolt length and tension in a roof support system of an underground mine comprising the steps of:

(a) accumulating mine site specific data including orthogonal properties of at least one of Young's modulus and Poisson's ratio for one or more strata in said mine;

(b) accumulating roof bolt specific data;

(c) applying one or more roof bolts to a model layout of said mine, the model layout excluding material to be removed from a stratum of said mine;

(d) combining said mine site specific data, said roof bolt specific data and the model layout including roof bolts therein to a mesh to be utilized for stress analysis of the model layout;

(e) performing a stress analysis for said combined data; and (f) determining from said stress analysis a roof bolt length that provides a roof of the model layout with a desired extent of support, wherein said orthogonal properties include a property obtained in a direction along a main force axis and another property obtained in a direction substantially perpendicular to the main force axis.

10. A method for determining stress in a given area of an underground mine comprising the steps of:

(a) accumulating mine site specific data including in-situ stresses of one or more strata in said mine site and orthogonal properties of said one or more strata, wherein said orthogonal properties include at least one of Young's modulus and Poisson's ratio and said orthogonal properties include a property obtained in a direction along a main force axis and another property obtained in a direction substantially perpendicular to the main force axis;

(b) determining a model mine layout in one of said strata;

(c) converting said mine site specific data and said model mine layout to a stress analysis of said given area; and (d) determining from said stress analysis, stresses occurring in said given area in response to the formation of said model mine layout in said mine site.

11. A method of predicting surface subsidence over an underground mine comprising the steps of:

(a) accumulating mechanical data specific to strata between said mine and a surface thereabove, said mechanical data including orthogonal properties of one or more of said strata including at least one of Young's modulus and Poisson's ratio;

(b) applying said mechanical data to a model layout of said mine to obtain a stress analysis of the model layout excluding material to be removed from said mine; and (c) determining from said stress analysis an amount of surface subsidence, wherein said orthogonal properties include a property obtained in a direction along a main force axis and another property obtained in a direction substantially perpendicular to the main force axis.

12. A method for determining roof support in a layered underground mine including a plurality of strata wherein one of said strata contains a material to be mined, said method comprising the steps of:

(a) determining for at least one of said plurality of strata, orthogonal properties thereof including at least one of Young's modulus and Poisson's ratio;

(b) implementing a model layout of said mine including at least one of pillars and an entry in said one of said strata containing the material to be mined, the model layout excluding the material to be removed from said mine; and (c) determining stresses in the at least one of said plurality of strata utilizing said orthogonal properties and the model layout of said mine, wherein said orthogonal properties include a property determined in a direction along a main force axis and another property determined in a direction substantially perpendicular to the main force axis.

13. The method as set forth in claim 12 further including:

(d) arraying in the model layout of said mine a plurality of model roof bolts transverse to a stratum immediately above said one of said strata containing the material to be mined;

(e) determining a length and installed load for said model roof bolts; and (f) determining for the combination length and installed load for said model roof bolts and the model layout of said mine, said stresses in the at least one of said plurality of strata utilizing said orthogonal properties.

14. The method as set forth in claim 13 further comprising the step of determining an isotropic property of said model roof bolts, wherein said isotropic property is utilized to determine said stresses in the at least one of said plurality of strata.

15. A method of determining stresses in an underground site having an opening defined by at least one stratum of material comprising the steps of:

(a) identifying the underground site;

(b) obtaining mechanical properties of the underground site including at least one orthogonal property of Young's modulus and Poisson's ratio;

(c) defining a model layout of the underground site with the opening defined therein;

(d) mathematically modeling the model layout of the underground site having the opening defined therein, said mathematical model using the obtained orthogonal property; and (e) determining stresses in the model layout of the underground site from said mathematical model, wherein said at least one orthogonal property of Young's modulus and Poisson's ratio includes a property measured in a direction alone a main force axis and another property measured in a direction substantially perpendicular to the main force axis.

16. The method as set forth in claim 13 wherein step (f) further includes utilizing a boundary condition between said model roof bolts and one or more of said plurality of strata.

17. The method as set forth in claim 13 wherein said stresses are determined through finite element analysis and step (f) further includes utilizing a gap finite element between two or more adjacent strata.

18. The method as set forth in claim 13 further comprising the step of:

(g) determining mechanical properties of a model gob disposed relative to a face of the material to be mined, the mechanical properties of the model gob including at least one of Young's modulus and Poisson's ratio; and (h) determining at least one of a peak frontal abutment pressure produced on the face of the material to be mined and a peak side abutment pressure produced on pillars in the model layout of said mine.

19. The method as set forth in claim 12 wherein step (c) includes determining for the model layout of said mine a distribution of stresses in two dimensions.

20. The method as set forth in claim 13 wherein step (f) includes determining for the combination of the model layout of said mine and said model roof bolts, said stresses in two dimensions.

21. A method of stress analysis in an underground mine having a plurality of strata, said method comprising the steps of:

(a) determining in at least one of said plurality of strata one orthogonal material property thereof;

(b) establishing a model pattern of pillars in one of said plurality of strata by excluding material to be mined from the one of said plurality of strata; and (c) determining stresses in said plurality of strata utilizing said one orthogonal property and said model pattern of pillars, wherein said one orthogonal property includes a property determined in a direction along a main force axis and another property determined in a direction substantially perpendicular to the main force axis.

22. The method of stress analysis as set forth in claim 21 further comprising the step of:

(d) determining a length, tension and arrangement of a plurality of model bolts to be applied to a roof in said mine so that overlapping influence zones are created between adjacent strata to achieve an optimum beaming effect.

23. The method as set forth in claim 21 wherein said one orthogonal property includes one of Young's modulus and Poisson's ratio.

24. The method as set forth in claim 21 wherein step (c) includes determining said stresses in two dimensions.

25. The method as set forth in claim 22 wherein step (d) includes determining said stresses in two dimensions.

26. A method of determining roof support in an underground mine having a mineral seam and a stratum of rock thereabove by ascertaining the distribution of stresses by applying finite element analysis to a model of the mineral seam and a model of the stratum of rock, wherein:

said finite element analysis includes utilizing the stress/strain relationship of at least one of the mineral seam and the stratum of rock; and at least one of the model of the mineral seam and the model of the stratum of rock has material to be mined excluded therefrom, the improvement comprising:

implementing the finite element analysis by taking into account an orthogonal property of at least one of the mineral seam and the stratum of rock, wherein said orthogonal property includes a property obtained in a direction along a main force axis and another property obtained in a direction substantially perpendicular to the main force axis.

27. The method as set forth in claim 15 wherein the underground site is a mine site defined by a mineral seam.

28. The method as set forth in claim 27 wherein the underground site further includes a stratum of rock.

29. The method as set forth in claim 15 further comprising the step of:

(f) identifying model structural information associated with the model layout of the underground site, wherein said mathematical model includes said model structural information.

* * * * *

UNITED STATES PATENT AND TRADEMARK OFFICE

CERTIFICATE OF CORRECTION

PATENT NO. : 5,824,912

DATED : October 20, 1998

INVENTOR(S) : John C. Stankus and Song Guo

It is certified that error appears in the above-identified patent and that said Letters Patent is hereby corrected as shown below:

Title Page, under Related U.S. Application Data, after "abandoned" insert: --; U.S. Provisional Application Ser. No. 60/000,002 filed June 8, 1995 and U.S. Provisional Application Ser. No. 60/008,976 filed December 21, 1995--.

Column 3 Line 52 before "orthogonal" delete --an--.

Column 5 Line 6 "where $E_x$" should read --where $E_z$--.

Signed and Sealed this

Fifteenth Day of June, 1999

*Attest:*

Q. TODD DICKINSON

*Attesting Officer*

*Acting Commissioner of Patents and Trademarks*